US010559883B2

(12) United States Patent
Tenno

(10) Patent No.: US 10,559,883 B2
(45) Date of Patent: Feb. 11, 2020

(54) ANTENNA DEVICE AND ELECTRONIC APPARATUS

(71) Applicant: Murata Manufacturing Co., Ltd., Nagaokakyo-shi, Kyoto-fu (JP)

(72) Inventor: Nobuyuki Tenno, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/296,358

(22) Filed: Mar. 8, 2019

(65) Prior Publication Data

US 2019/0207311 A1 Jul. 4, 2019

Related U.S. Application Data

(63) Continuation of application No. 15/722,015, filed on Oct. 2, 2017, now Pat. No. 10,276,936, which is a (Continued)

(30) Foreign Application Priority Data

Jan. 14, 2016 (JP) ..... 2016-004898
Sep. 26, 2016 (JP) ..... 2016-186559

(51) Int. Cl.
*H01Q 7/00* (2006.01)
*H01Q 1/38* (2006.01)
(Continued)

(52) U.S. Cl.
CPC ..... *H01Q 7/00* (2013.01); *H01Q 1/38* (2013.01); *H01Q 7/08* (2013.01); *H01Q 13/16* (2013.01); *H01Q 1/243* (2013.01)

(58) Field of Classification Search
CPC ..... H01Q 7/00; H01Q 7/08; H01Q 13/16
See application file for complete search history.

(56) References Cited

U.S. PATENT DOCUMENTS

2014/0203992 A1* 7/2014 Nakano ..... H01Q 7/00 343/867
2015/0207223 A1 7/2015 Nakano
(Continued)

FOREIGN PATENT DOCUMENTS

WO 2015/022859 A1 2/2015

OTHER PUBLICATIONS

Tenno, "Antenna Device and Electronic Apparatus", U.S. Appl. No. 15/722,015, filed Oct. 2, 2017.

*Primary Examiner* — Jessica Han
*Assistant Examiner* — Amal Patel
(74) *Attorney, Agent, or Firm* — Keating & Bennett, LLP

(57) ABSTRACT

An antenna device includes a wiring board, a conductive member including a first conductor portion and a second conductor portion electrically connected to each other, a coil element including a coupling coil to be connected to a feed circuit, and a capacitor. The first conductor portion includes a conductor opening and a gap that connects the conductor opening and an outer edge of the first conductor portion, and the capacitor crosses the gap. The second conductor portion is connected to two points of an inner edge of the conductor opening, and, together with a portion of the first conductor portion and the capacitor, defines a loop-shaped current path. The coupling coil is magnetically coupled to the loop-shaped current path.

6 Claims, 49 Drawing Sheets

Related U.S. Application Data continuation of application No. PCT/JP2017/000961, filed on Jan. 13, 2017.

(51) Int. Cl.

| | |
|---|---|
| ***H01Q 7/08*** | (2006.01) |
| ***H01Q 13/16*** | (2006.01) |
| *H01Q 1/24* | (2006.01) |

(56) References Cited

U.S. PATENT DOCUMENTS

| | | | | |
|---|---|---|---|---|
| 2015/0207913 | A1* | 7/2015 | Nakano | H01Q 7/00 455/41.1 |
| 2017/0005391 | A1* | 1/2017 | Tenno | H01Q 1/2225 |
| 2017/0040663 | A1* | 2/2017 | Ito | H01Q 7/00 |

* cited by examiner

Comparative Example 220
210
20

20
210

220
20
210

20
220
210

20
210

20
220
210

20
220
210

20
220
210

20
210

20
220
210

20
220
210

20
220
210
Y
X 210
220
20
E1
E2
X
Y 210
220
20
E1
E2
X
Y

ANTENNA DEVICE AND ELECTRONIC APPARATUS

CROSS REFERENCE TO RELATED APPLICATIONS

This application claims the benefit of priority to Japanese Patent Application No. 2016-004898 filed on Jan. 14, 2016 and Japanese Patent Application No. 2016-186559 filed on Sep. 26, 2016 and is a Continuation Application of PCT Application No. PCT/JP2017/000961 filed on Jan. 13, 2017. The entire contents of each application are hereby incorporated herein by reference.

BACKGROUND OF THE INVENTION

1. Field of the Invention

The present invention relates to an antenna device that has a coil element, and an electronic apparatus provided with such an antenna device.

2. Description of the Related Art

An antenna device that uses a metal member, such as a metal housing of an electronic apparatus, as a radiation element is disclosed in, for example, International Publication No. 2014/003163. This antenna device is configured so that a feed coil connected to a feed circuit may be co upled with a loop mainly by a metal member of an electronic apparatus, and the loop defines and functions as a radiator of magnetic flux.

While, in the antenna device that uses a metal member, such as a metal housing of an electronic apparatus, as a radiation element, in order to improve the function of a loop as a radiator of magnetic flux, an opening of the loop may be enlarged, the restriction of space is strict. In other words, it is difficult to provide an antenna device that achieves both space-saving and a high gain.

SUMMARY OF THE INVENTION

Preferred embodiments of the present invention provide antenna devices in which radiator function is improved without any size increase of the antenna devices, and electronic apparatuses including such antenna devices.

An antenna device according to a preferred embodiment of the present invention includes a conductive member including a first conductor portion; and a second conductor portion with a linear shape, the first conductor portion and the second conductor portion being electrically connected to each other; a coil element including a coupling coil to be connected to a feed circuit; and a capacitor, and the first conductor portion includes a conductor opening and a gap that connects the conductor opening and an outer edge of the first conductor portion; wherein the capacitor crosses the gap; the second conductor portion is connected to two points of an inner edge of the conductor opening, and, together with a portion of the first conductor portion and the capacitor, defines a loop-shaped current path; and the coupling coil is magnetically coupled to the loop-shaped current path.

With the above configuration, a resonant current of a circuit defined by the loop-shaped current path and the capacitor flows through a loop-shaped conductor, and the coupling between a portion into which the resonant current flows and a communication partner antenna increases.

The coil element may preferably include an auxiliary conductor to be magnetically coupled to the coupling coil, and the second conductor portion includes the connection portion of the auxiliary conductor. Accordingly, the coupling between the coupling coil and the auxiliary conductor, that is, the magnetic field coupling between the coupling coil and a loop-shaped conductor, is able to be increased easily. In addition, the variation in the degree of coupling between the coupling coil and the loop-shaped conductor due to the variation in the mounting position of the coupling coil is able to be reduced.

The first conductor portion may preferably include a planar conductor pattern. With this configuration, the conductor pattern that expands into a planar shape along the surface of a base material is able to be used as a first conductor portion.

At least a portion of the first conductor portion may preferably be a ground conductor pattern. Accordingly, the potential of the first conductor portion is stabilized. In addition, this makes it possible to prevent the first conductor portion from being a radiation source of noise.

The capacitor may preferably be adjacent to the outer edge of the first conductor portion. This improves the radiation characteristics of an antenna since the conductor opening expands significantly.

The antenna device may preferably further include a housing including a conductor portion including an end edge portion, and the coil element is adjacent to the end edge portion. With this configuration, the magnetic flux that passes through a portion other than the housing conductor portion easily passes through the coupling coil of the coil element. In addition, the housing conductor portion defines and functions as a radiation portion.

The antenna device may preferably further include a base material, and the first conductor portion and the second conductor portion may preferably be provided on the base material; and the coil element and the capacitor may preferably be mounted on the base material. Accordingly, the loop-shaped conductor and the coupling coil are strongly coupled. In addition, the accuracy of the positions of the first conductor portion, the second conductor portion, and the coil element is increased easily.

The base material may preferably include a surface, the coupling coil may preferably include a coil winding axis that is in parallel or substantially parallel to the surface of the base material, and the coil element may preferably include an end portion in a coil winding axis direction of the coupling coil, and, in a plan view of the base material, the end portion may preferably overlap the conductor opening. Accordingly, the degree of coupling between the coupling coil and the first conductor portion increases.

The base material may preferably include a surface, the coupling coil may preferably include a coil winding axis that is perpendicular or substantially perpendicular to the surface of the base material, the coupling coil may preferably include a coil opening, and, in a plan view of the base material, the coil opening may preferably overlap the conductor opening. Accordingly, the degree of coupling between the coupling coil and the first conductor portion increases.

An antenna device according to a preferred embodiment of the present invention includes a loop-shaped conductor; a coil element including a coupling coil to be connected to a feed circuit; a capacitor; and a conductive member, and the conductive member is connected to two different points of the loop-shaped conductor; the loop-shaped conductor, together with the capacitor, defines a loop-shaped current path; and the coupling coil is magnetically coupled to the loop-shaped current path.

With the above configuration, a resonant current of a circuit defined by the loop-shaped current path and the capacitor flows through a loop-shaped conductor, and the coupling between a portion into which the resonant current flows and a communication partner antenna increases.

The antenna device may preferably further include a housing including a conductor portion, and a portion or a whole of the conductive member may preferably be the conductor portion of the housing. Since, with this configuration, a portion of the housing of the electronic apparatus is able to be used as an antenna device, members dedicated to the antenna device are reduced, so that the miniaturization of the electronic apparatus or the higher gain of the antenna device is able to be achieved. In addition, the loop-shaped conductor defines and functions as a radiator of magnetic flux, and the coupling to a communication partner antenna is able to be further increased.

A portion or a whole of the conductive member may preferably be a ground conductor. This makes it possible to configure an antenna device without providing a member dedicated to a conductive member.

An electronic apparatus according to a preferred embodiment of the present invention includes an antenna device including a conductive member including a first conductor portion; and a second conductor portion with a linear shape, the first conductor portion and the second conductor portion being electrically connected to each other; a coil element including a coupling coil to be connected to a feed circuit; and a capacitor, and the first conductor portion includes a conductor opening; and a gap that connects the conductor opening and an outer edge of the first conductor portion; the capacitor crosses the gap; the second conductor portion is connected to two points of an inner edge of the conductor opening, and, together with a portion of the first conductor portion and the capacitor, defines a loop-shaped current path; and the coupling coil is magnetically coupled to the loop-shaped current path.

With the above configuration, members dedicated to the antenna device are reduced, so that the miniaturization of the electronic apparatus or the higher gain of the antenna device is able to be achieved. In addition, the loop-shaped current path defines and functions as a radiator of magnetic flux, and the coupling to a communication partner antenna is able to be further increased.

An electronic apparatus according to a preferred embodiment of the present invention includes an antenna device including a loop-shaped conductor; a coil element including a coupling coil to be connected to a feed circuit; a capacitor; and a conductive member; the conductive member is connected to two different points of the loop-shaped conductor; the loop-shaped conductor, together with the capacitor, defines a loop-shaped current path; and the coupling coil is magnetically coupled to the loop-shaped current path.

With the above configuration, members dedicated to the antenna device are reduced, so that the miniaturization of the electronic apparatus or the higher gain of the antenna device is able to be achieved. In addition, the loop-shaped conductor defines and functions as a radiator of magnetic flux, and the coupling to a communication partner antenna is able to be further increased.

According to preferred embodiments of the present invention, antenna devices that improve radiator function without any increase in size, and electronic apparatuses including such antenna devices are provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
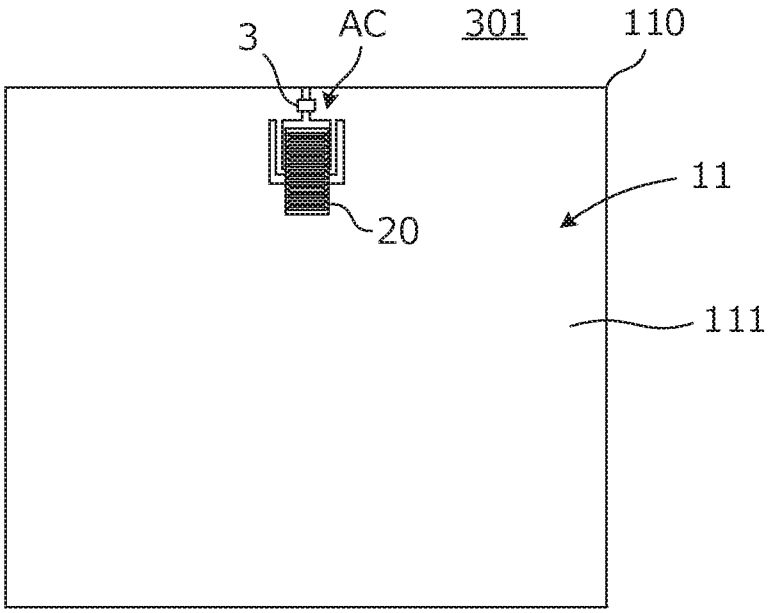
FIG. 1A is a plan view of an antenna device 301 according to a first preferred embodiment of the present invention.

Hereinafter, a plurality of preferred embodiments of the present invention will be described with reference to the attached drawings and several specific examples. In the drawings, components and elements assigned with the same reference numerals or symbols will represent identical components and elements. While a plurality of preferred embodiments are described for the sake of convenience in consideration of easiness of description or understanding of main points, elements and features described in different preferred embodiments are able to be partially replaced and combined with each other. In each of the plurality of preferred embodiments, a description of matters that are the same as those will be omitted, and, in particular, the differences will be described. In addition, the same operational effects by the same configuration will not be described one by one for each preferred embodiment.

In each preferred embodiment described below, an "antenna device" is an antenna that emits magnetic flux, for example. The antenna device is an antenna that is preferably used for near field communication using magnetic field coupling to a communication partner side antenna and is used for communication such as an NFC (Near Field Communication), for example. The antenna device may preferably be used in a frequency band such as an HF band, for example, and may preferably be used, in particular, at a frequency of 13.56 MHz or near 13.56 MHz. Since the size of an antenna device is extremely small compared with a wavelength $\lambda$ in the frequency to be used, the high radiation characteristics of electromagnetic waves are fundamentally difficult to obtain. The length of a coil conductor when the coil conductor of a coil antenna with which an antenna device described below is provided is extended is less than or equal to about $\lambda/10$, for example. It is to be noted that a wavelength that is referred to herein indicates an effective wavelength in consideration of wavelength shortening effect by the dielectricity and permeability of a base material in which an antenna is formed. Both ends of the coil conductor included in the coil antenna are connected to a feed circuit that operates in a desired frequency band (for example, an HF band, in particular, near 13.56 MHz). Therefore, along a coil conductor, that is, in a direction through which a current flows, a roughly uniform current flows through the coil conductor, and the current distribution along the coil conductor is uniform or substantially uniform as in a case in which the length of the coil conductor is less than or equal to the wavelength.

First Preferred Embodiment

Figure 1B:
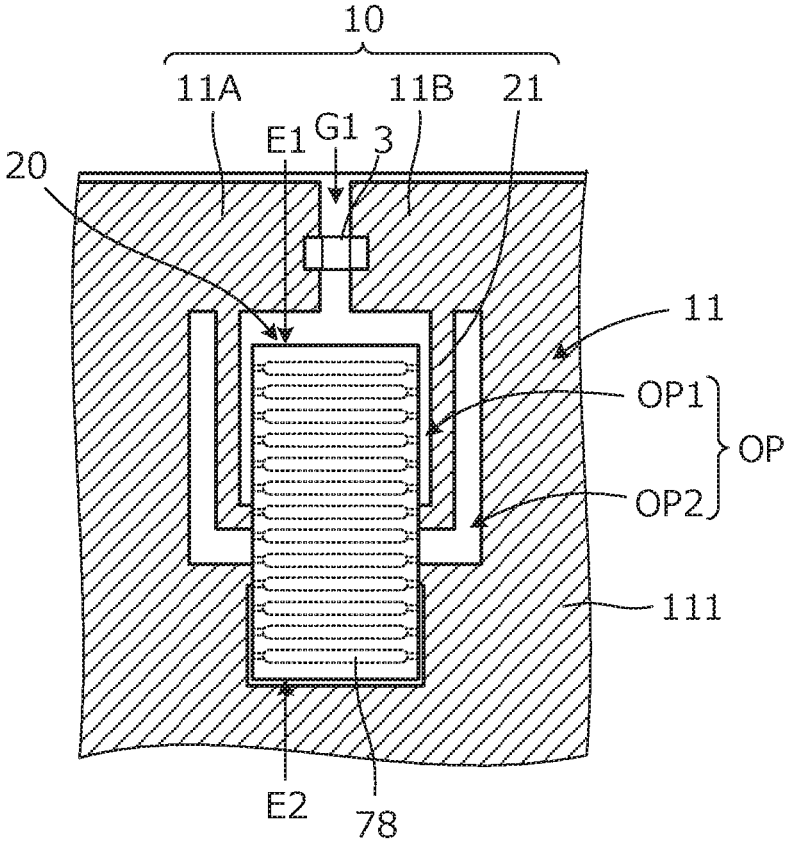
FIG. 1B is a plan view of a coil element arrangement portion AC of the antenna device.
Figure 2:
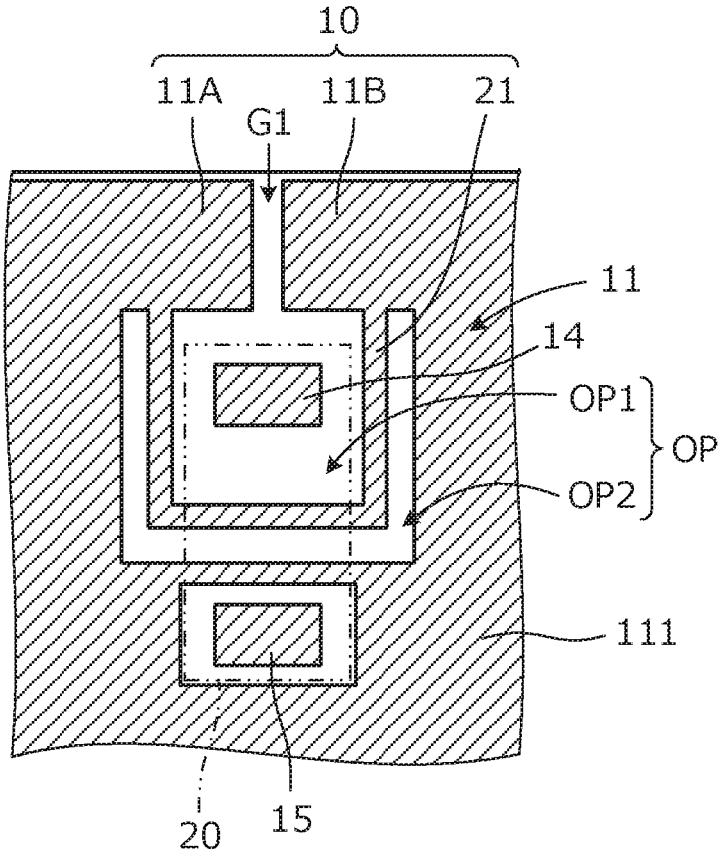
FIG. 2 is a plan view of the coil element arrangement portion prior to mounting of a coil element 20.

FIG. 1A is a plan view of an antenna device 301 according to a first preferred embodiment of the present invention, and FIG. 1B is a plan view of a coil element arrangement portion AC of the antenna device. FIG. 2 is a plan view of the coil element arrangement portion prior to mounting of a coil element 20.

The antenna device 301 is provided with a wiring board 110, a conductive member including a first conductor portion 11 and a second conductor portion 21 that are provided on the surface of this wiring board 110, a coil element 20 that includes a coupling coil to be connected to a feed circuit, and a capacitor 3. The wiring board 110 is an example of a "base material".

The first conductor portion 11 is provided with a planar conductor 111 that expands into a planar shape, and extension portions 11A and 11B are extended partially. The first conductor portion 11 includes a conductor opening OP, and a gap G1 that connects an outer edge of the first conductor portion 11 and the conductor opening OP. The capacitor 3 is arranged to cross the gap G1. This gap G1 is also referred to as a "slit."

The second conductor portion 21 is connected to two points of an internal edge of the conductor opening OP and divides the conductor opening OP into two conductor openings OP1 and OP2. In other words, the second conductor portion 21 is a linear conductor pattern along a boundary between a first conductor opening OP1 and a second conductor opening OP2. This second conductor portion 21 and the extension portions 11A and 11B being a portion of the first conductor portion 11 define a loop-shaped conductor 10. This loop-shaped conductor 10 and the capacitor 3 define a current path, which is an example of a "loop-shaped current path".

The coil element 20 is connected to a feed circuit that is not illustrated, and a coupling coil in the coil element 20 is magnetically coupled to the above described loop-shaped current path. In the first preferred embodiment, a state of being "magnetically coupled to a loop-shaped current path" means a state of being magnetically coupled to a portion defining a loop-shaped current path. Thus, such a state includes "being magnetically coupled to the loop-shaped conductor," and "being magnetically coupled to the second conductor portion 21."

The wiring board 110 includes coil element connection pads 14 and 15. Both ends of a coil conductor 78 of the coupling coil of the coil element 20 are connected to the coil element connection pads 14 and 15. The wiring board 110 is provided with a feed circuit connected to the coil element connection pads 14 and 15. Accordingly, the both ends of the coil conductor 78 of the coupling coil of the coil element 20 are connected to the feed circuit through the coil element connection pads 14 and 15.

Since the conductor opening OP has the gap G1 that connects the outer edge of the first conductor portion 11 and the conductor opening OP, the conductor opening OP does not cancel the magnetic flux passing through the inside of the conductor opening OP. In the present preferred embodiment, the conductor opening OP1, in particular, includes the gap G1 that connects the outer edge of the first conductor portion 11 and the conductor opening OP1.

The coil element 20 includes a coil conductor 78 of the coupling coil that is wound in a helical shape around a winding axis, and a first end E1 of the coil element 20 and a second end E2 of the coil element 20 that face each other across this coil conductor. While FIG. 1B illustrates the coil conductor 78 of the coupling coil in the coil element 20, the coil conductor 78 of this coupling coil has a reference numeral marked representatively, and, as details are described below, the coupling coil includes a plurality of linear conductors, an interlayer connection conductor, an end surface conductor, and the like. In this example, while the winding axis of the coupling coil of the coil element 20 is parallel to the planar conductor 111, the winding axis may not be completely parallel and may only include a parallel component.

The first end E1 of the coil element 20 overlaps the first conductor opening OP1 that is connected to the gap G1, in a plan view of the wiring board 110. In other words, the first end E1 of the coil element 20 is closer to the inside of the loop of the loop-shaped conductor 10 than to the planar conductor 111. In addition, the second end E2 of the coil element 20 is closer to the planar conductor 111 than to the inside of the loop of the loop-shaped conductor 10. By the arrangement of such a coil element 20, the coupling coil in the coil element 20 is magnetically coupled to the planar conductor 111 and the loop-shaped current path.

While, in the example illustrated in FIG. 1B, the coupling coil in the coil element 20, in a plan view, overlaps the second conductor portion 21, the coupling coil does not necessarily need to overlap the second conductor portion 21, and the coupling coil may be positioned to be magnetically coupled to the loop-shaped current path.

As illustrated in FIG. 2, the gap G1 of the conductor pattern is located at the one end portion of the first conductor portion 11, and the capacitor 3 is connected so as to cross (so as to link) this gap G1.

According to the present preferred embodiment, as described above, since the coupling coil in the coil element 20 is arranged so as to be magnetically coupled to the planar conductor 111 and the loop-shaped current path, a current flowing through the planar conductor 111 when the coupling coil of the coil element 20 is coupled to the planar conductor 111 and a current flowing through the loop-shaped current path when the coupling coil of the coil element 20 is coupled to the loop-shaped current path that the loop-shaped conductor 10 forms are superimposed, so that the function of the loop-shaped conductor 10 and the planar conductor 111 as a radiator is improved.

Second Preferred Embodiment

Figure 3A:
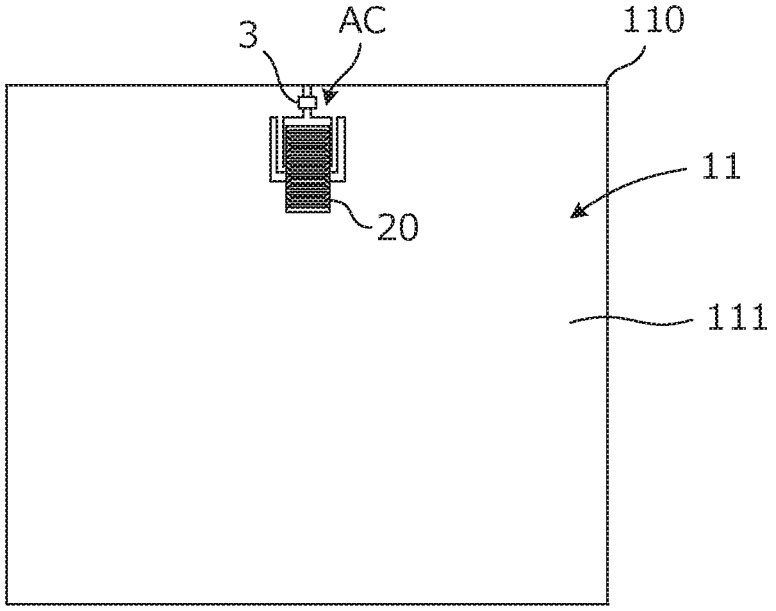
FIG. 3A is a plan view of an antenna device according to a second preferred embodiment of the present invention.
Figure 3B:
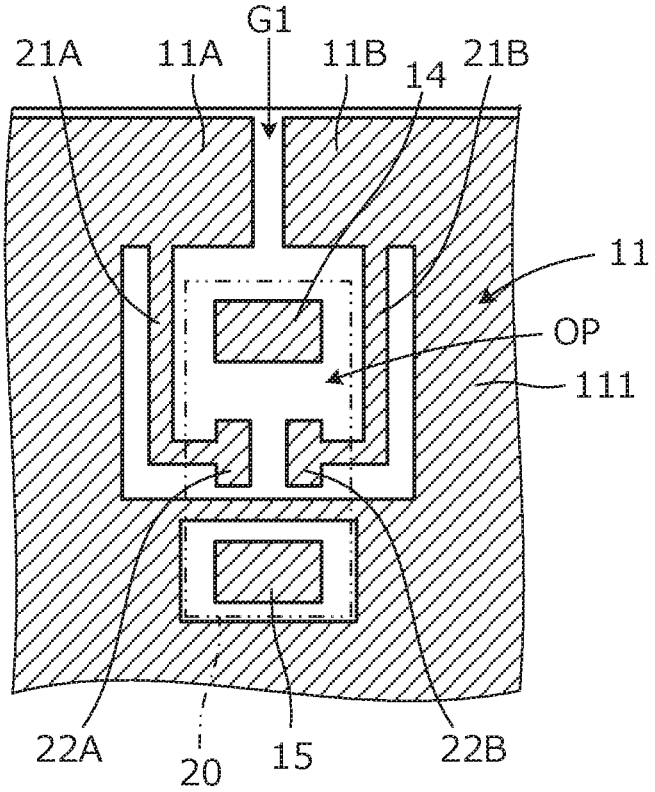
FIG. 3B is a plan view of the coil element arrangement portion AC.

FIG. 3A is a plan view of an antenna device according to a second preferred embodiment of the present invention, and FIG. 3B is a plan view of the coil element arrangement portion AC. The coil element 20 is provided with an auxiliary conductor, and the second conductor includes second conductor portions 21A and 21B. Other configurations are the same as the configurations described in the first preferred embodiment.

Auxiliary coil connection pads 22A and 22B are provided at each end portion of the second conductor portions 21A and 21B. In addition, the wiring board 110 further includes coil element connection pads 14 and 15. The coil element 20 is connected to the auxiliary coil connection pads 22A and 22B and the coil element connection pads 14 and 15. The wiring board 110 is provided with a feed circuit connected to the coil element connection pads 14 and 15.

Figure 4:
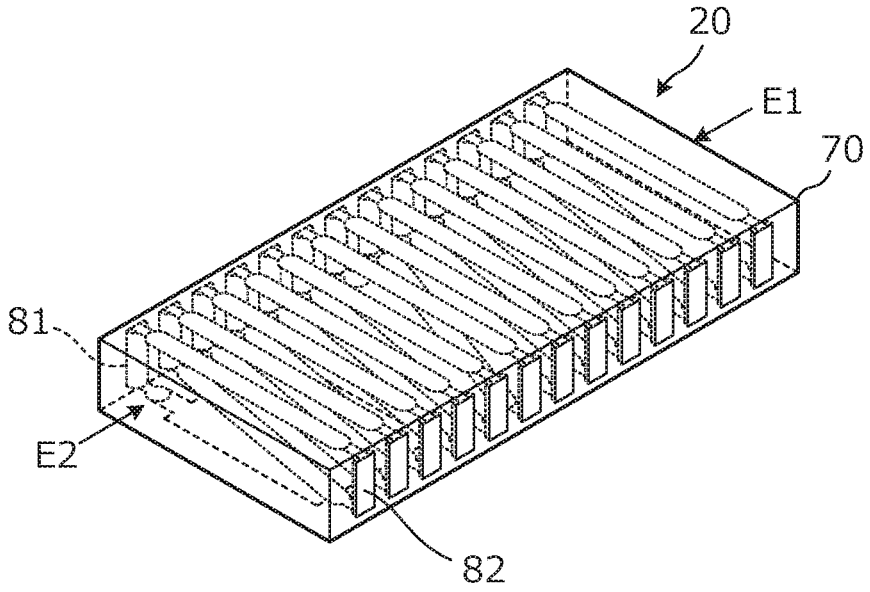
FIG. 4 is a perspective view of a coil element 20.
Figure 5:
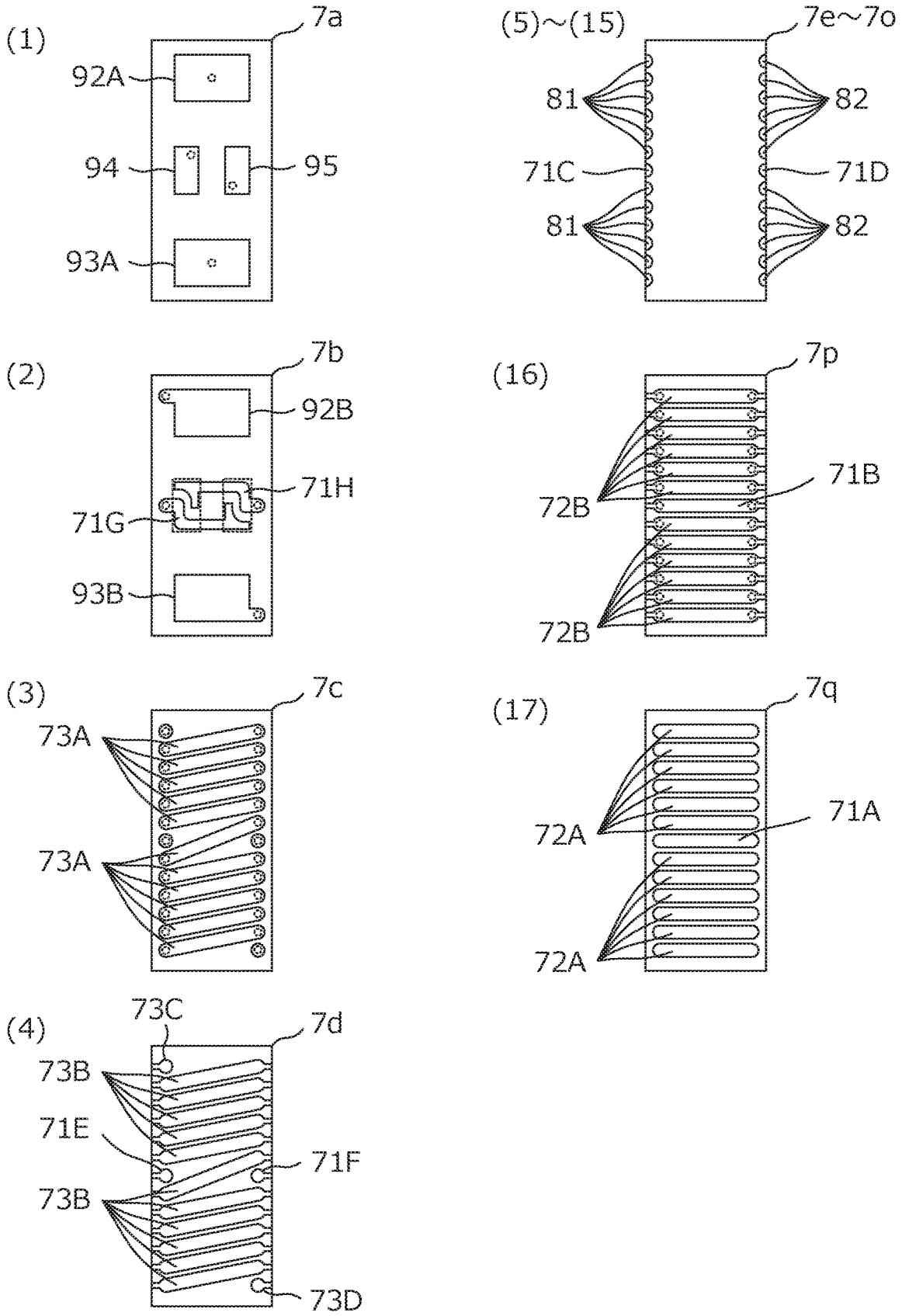
FIG. 5 is an exploded plan view of an electrode pattern and the like of each base material layer of a multilayer substrate 70 in the coil element 20.
Figure 6:
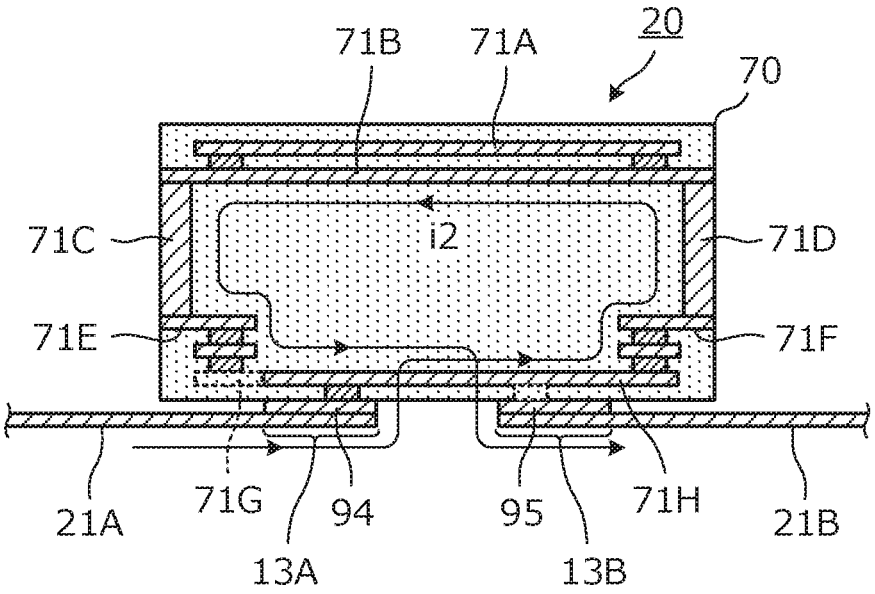
FIG. 6 is a sectional view showing a path of a current flowing through an auxiliary conductor in the coil element 20.

Subsequently, a description is given of a detailed structure of a coupling coil element. FIG. 4 is a perspective view of the coil element 20. FIG. 5 is an exploded plan view of an electrode pattern and the like of each base material layer of a multilayer substrate 70 in the coil element 20. FIG. 6 is a sectional view showing a path of a current flowing through an auxiliary conductor configured in the coil element 20.

The coil element 20 is an element in which an auxiliary conductor to be connected to the loop-shaped conductor 10 in series and a helical-shaped coupling coil with a square tubular shape are in contact with a rectangular parallelepiped-shaped multilayer substrate 70.

On the bottom surface (mounting surface) of the coil element 20, two terminals 92A and 93A to connect a feed circuit such as an RFIC and two terminals 94 and 95 to connect the auxiliary coil connection pads 22A and 22B are formed.

The multilayer substrate 70 is obtained preferably by stacking in the order of a plurality of base material layers 7*a* to 7*q* as illustrated from (1) to (17) in FIG. 5. In FIG. 5, (1) is the bottom layer and (17) is the top layer. In FIGS. 5, (1) to (17) are bottom surfaces of the base material layers 7*a* to 7*q*, and the bottom surface of the base material layer 7*a* is a mounting surface of the multilayer substrate 70.

The base material layers 7*a*, 7*b*, 7*c*, 7*p*, and 7*q* are rectangular parallelepiped-shaped nonmagnetic layers, for example, nonmagnetic material ferrites. The base material layers 7*d* to 7*o* are rectangular parallelepiped-shaped magnetic layers, for example, magnetic body ferrites. In other words, the multilayer substrate 70 is structured so that the base material layers 7*d* to 7*o* defining magnetic layers are sandwiched between the base material layers 7*a*, 7*b*, 7*c*, 7*p*, and 7*q* being nonmagnetic layers. It is to be noted that the base material layers 7*a* to 7*q* may not necessarily be a magnetic layer or a nonmagnetic layer, but may only be insulators. In addition, a nonmagnetic layer in the preferred embodiments of the present invention represents a layer of which the permeability is lower than the permeability of a magnetic layer, and may not necessarily be a nonmagnetic material; and a nonmagnetic layer may be a magnetic body of which the relative magnetic permeability is more than 1 and lower than the relative magnetic permeability of a magnetic layer.

The terminals 92A and 93A and the terminals 94 and 95 are provided on the bottom surface of the base material layer 7*a* illustrated in (1) in FIG. 5.

External connection conductors 92B and 93B and linear conductors 71G and 71H are provided on the bottom surface of the base material layer 7*b* illustrated in (2) in FIG. 5. The external connection conductors 92B and 93B and the terminals 92A and 93A are respectively connected to each other through an interlayer connection conductor. The linear conductors 71G and 71H are respectively connected to the terminals 94 and 95 through an interlayer connection conductor.

A plurality of linear conductors 73A are provided on the bottom surface of the base material layer 7*c* illustrated in (3) in FIG. 5. A plurality of linear conductors 73B and linear conductors 71E and 71F, and 73C and 73D are provided on the bottom surface of the base material layer 7*d* illustrated in (4) in FIG. 5. The plurality of linear conductors 73A and the plurality of linear conductors 73B are respectively connected in parallel to each other through an interlayer connection conductor.

A plurality of end surface conductors 81 and a plurality of end surface conductors 82 are provided on the base material layers 7*e* to 7*o* illustrated in (5) to (15) in FIG. 5.

A plurality of linear conductors 72B and one linear conductor 71B are provided on the bottom surface of the base material layer 7*p* illustrated in (16) in FIG. 5. A plurality of linear conductors 72A and one linear conductor 71A are provided on the bottom surface of the base material layer 7*q* illustrated in (17) in FIG. 5. The plurality of linear conductors 72A and the linear conductors 72B are respectively connected in parallel to each other through an interlayer connection conductor. In addition, the linear conductor 71A and the linear conductor 71B are connected in parallel to each other through an interlayer connection conductor.

The plurality of linear conductors 73B are sequentially connected in series to the plurality of linear conductors 72B through the end surface conductors 81 and 82. Moreover, the linear conductors 71E and 71F are connected to the linear conductor 71B through the end surface conductors 71C and 71D.

The linear conductors 72A, 72B, 73A, and 73B and the end surface conductors 81 and 82 define a rectangular helical-shaped coupling coil of about 12 turns, for example.

Furthermore, the linear conductors 71A, 71B, 71E, 71F, 71G, and 71H, the end surface conductors 71C and 71D, and the like define a rectangular loop-shaped auxiliary conductor of about one turn, for example.

In FIG. 6, a current i2 indicates a path of the current that flows through the auxiliary conductor. In this manner, the coil element 20 together with the coupling coil is provided with an auxiliary conductor in the center in the winding axial direction of this coupling coil. The auxiliary conductor, together with the loop-shaped conductor 10 and the capacitor C3, defines a loop-shaped current path.

Since, in the present preferred embodiment, the auxiliary conductor in the coil element 20 is also a portion of the loop-shaped current path, a state of being "magnetically coupled to a loop-shaped current path" includes "being magnetically coupled to the loop-shaped conductor," "being magnetically coupled to the second conductor portion 21," and "being magnetically coupled to the auxiliary conductor in the coil element 20."

As described above, since the auxiliary conductor in the coil element 20 is also a portion of the loop-shaped current path, compared with a case in which the auxiliary conductor is not formed in the coil element 20, the loop-shaped current path and the coil conductor of the coupling coil of the coil element 20 are closer to each other. Therefore, the coupling between the loop-shaped current path and the coupling coil is able to be strengthened. In addition, the variation in the degree of coupling between the coupling coil and the loop-shaped current path due to the variation in the mounting position of the coupling coil is able to be reduced. However, the present invention is not limited to a case in which the coupling coil and the auxiliary conductor are configured as a single element as in this example.

It is to be noted that, while an example in which the coil element 20 includes a stacked body obtained by stacking a plurality of base materials including the conductor pattern is shown, the present invention is not limited to this example. For example, a winding coil element obtained by winding a conductor around a magnetic body core or a coil element obtained by providing a planar coil in a base material may be used.

In addition, the above described "loop-shaped conductor" is a conductor defining the loop-shaped current path around the conductor opening (OP, in particular, OP1). A capacitor, a portion of a coil element, and a portion through other components may be included in order to define this loop-shaped current path.

The above described various modifications are applicable not only to the modification of the present preferred embodiment but also similarly to the modifications of all preferred embodiments.

According to the present preferred embodiment, similarly to the first preferred embodiment, since the coupling coil in the coil element 20 is arranged so as to be magnetically coupled to the planar conductor 111 and the loop-shaped current path, a current flowing through the planar conductor 111 when the coupling coil of the coil element 20 is coupled to the planar conductor 111 and a current flowing through the loop-shaped current path when the coupling coil of the coil element 20 is coupled to the loop-shaped current path are superimposed, so that the function of the loop-shaped conductor 10 and the planar conductor 111 as a radiator is improved.

Figure 7:
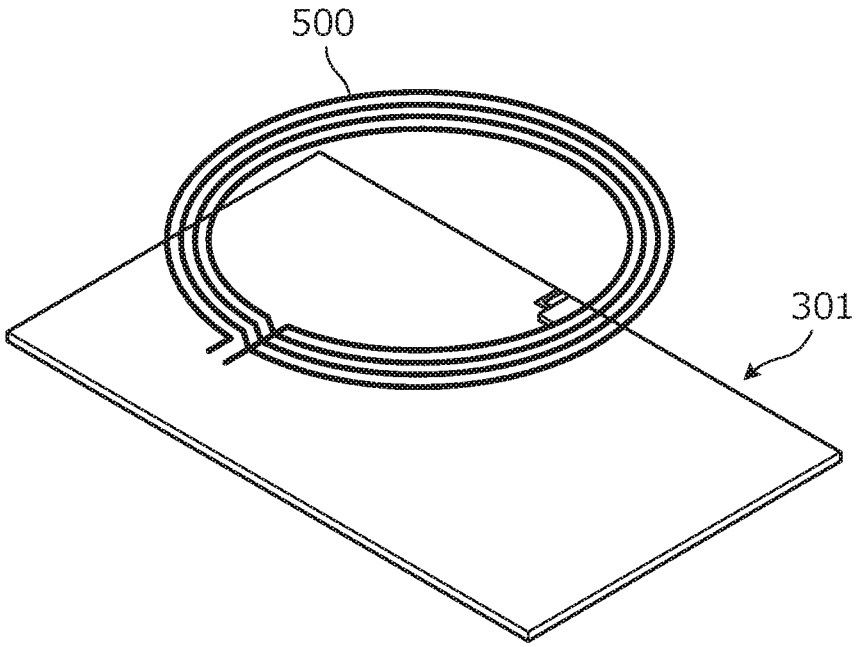
FIG. 7 is a perspective view of a positional relationship of the antenna device 301 according to the second preferred embodiment of the present invention and a communication partner antenna 500.
Figure 8:
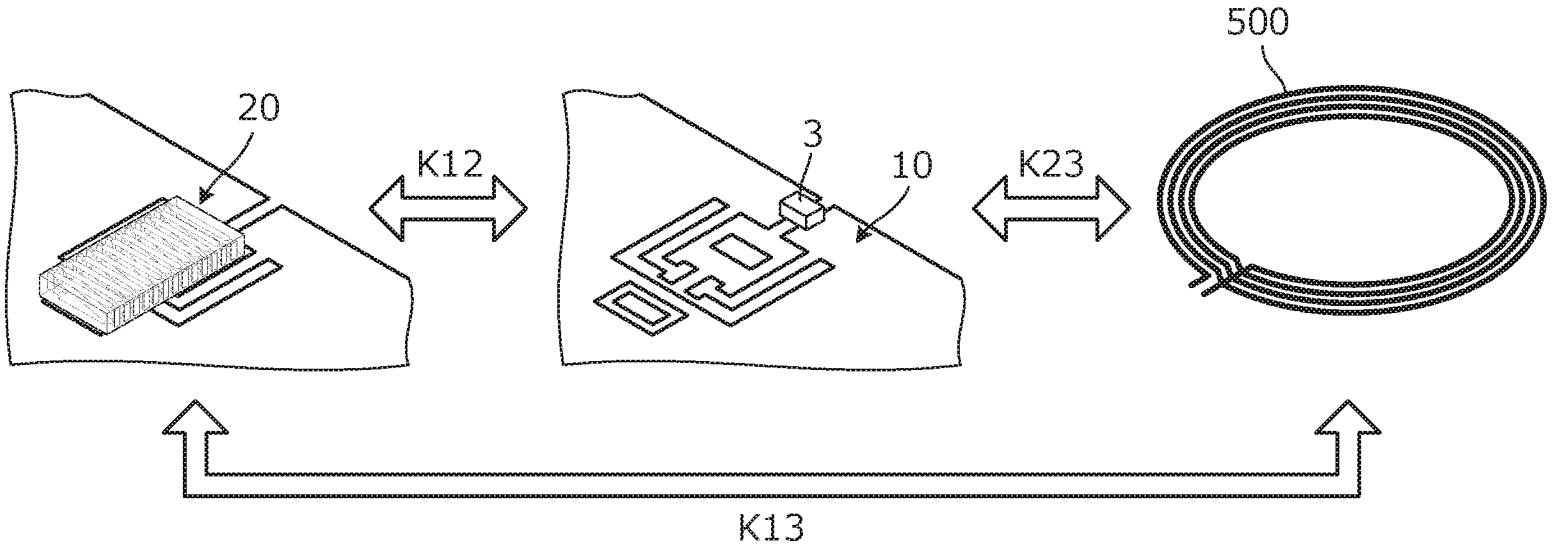
FIG. 8 is a diagram showing a method of coupling the antenna device 301 and the communication partner antenna 500.

FIG. 7 is a perspective view of a positional relationship of the antenna device 301 according to the present preferred embodiment of the present invention and a communication partner antenna 500. In addition, FIG. 8 is a diagram showing a method of coupling the antenna device 301 and the communication partner antenna 500. In FIG. 8, the coupling coil of the coil element 20 and the loop-shaped current path are coupled by a coupling coefficient k12, and the loop-shaped current path and the communication partner antenna 500 are coupled by a coupling coefficient k23. Further, the coupling coil of the coil element 20 and the communication partner antenna 500 are coupled by a coupling coefficient k13. Accordingly, compared with an antenna device in which a coupling coil is simply located at an edge portion of the planar conductor 111 of the wiring board, the coupling to the communication partner antenna 500 is roughly increased by the coupling coefficient k23.

The following shows a plurality of antenna devices as comparative examples and the results of characteristics comparison between the plurality of antenna devices.

Figure 46A:
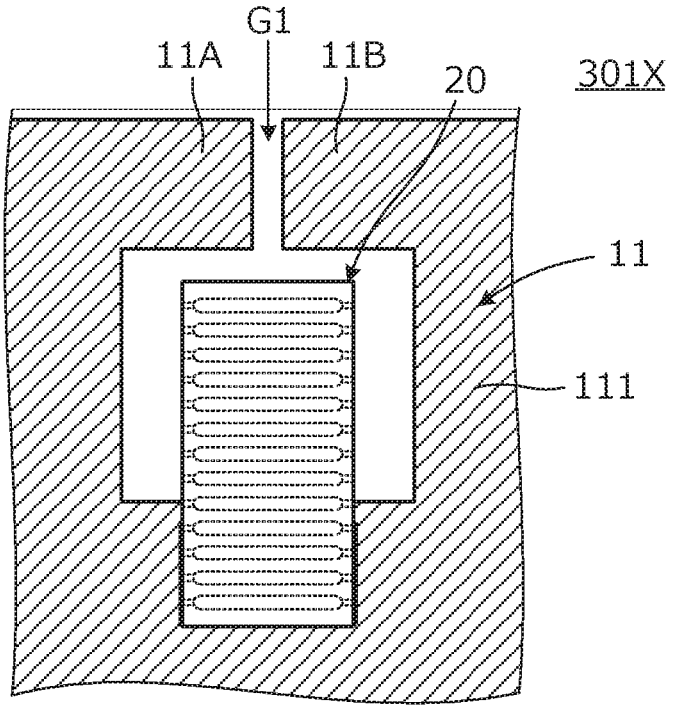
FIG. 46A is a partial plan view of the antenna device 301X of a comparative example.
Figure 46B:
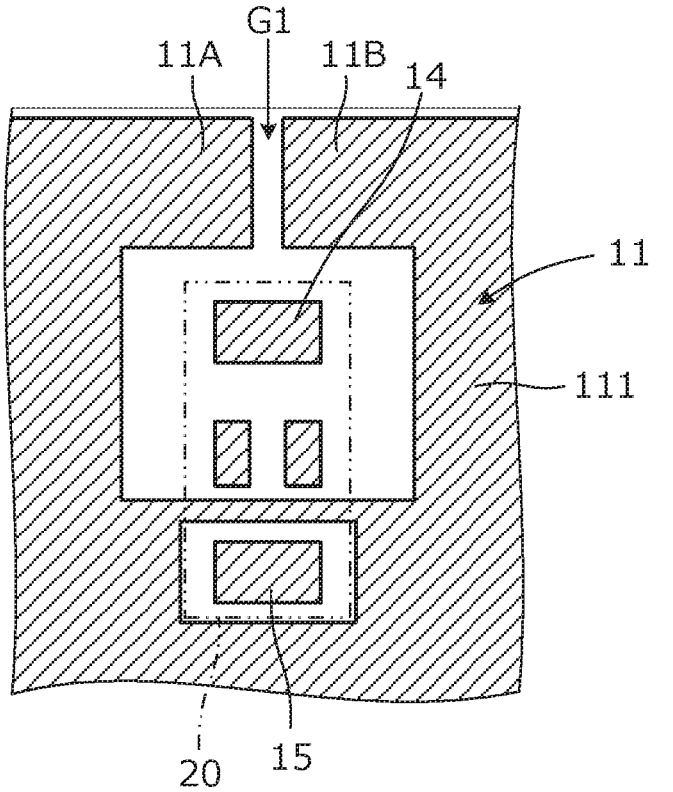
FIG. 46B is a plan view of a coil element arrangement portion prior to mounting of a coil element 20 of the antenna device 301X.

FIG. 46A is a partial plan view of an antenna device 301X of a comparative example, and FIG. 46B is a plan view of a coil element arrangement portion prior to mounting of a coil element 20 of the antenna device 301X.

Figure 47A:
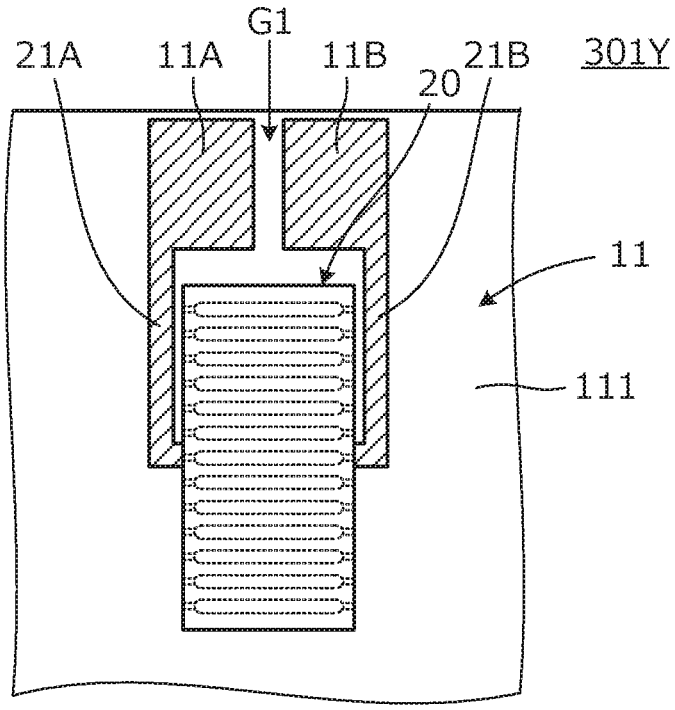
FIG. 47A is a partial plan view of the antenna device 301Y of a comparative example.
Figure 47B:
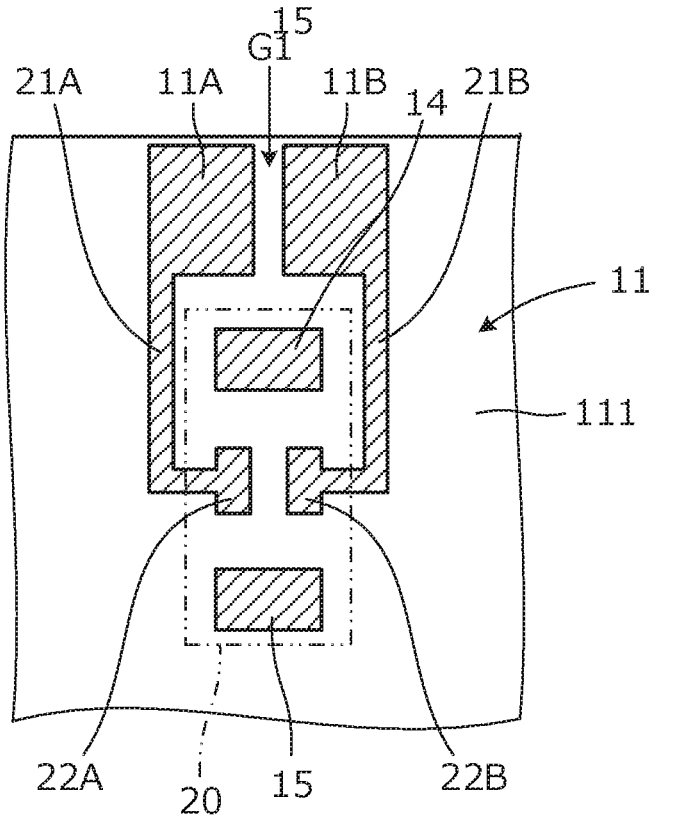
FIG. 47B is a plan view of a coil element arrangement portion prior to mounting of a coil element 20 of the antenna device 301Y.

FIG. 47A is a partial plan view of an antenna device 301Y of a comparative example, and FIG. 47B is a plan view of a coil element arrangement portion prior to mounting of a coil element 20 of the antenna device 301Y.

Figure 48A:
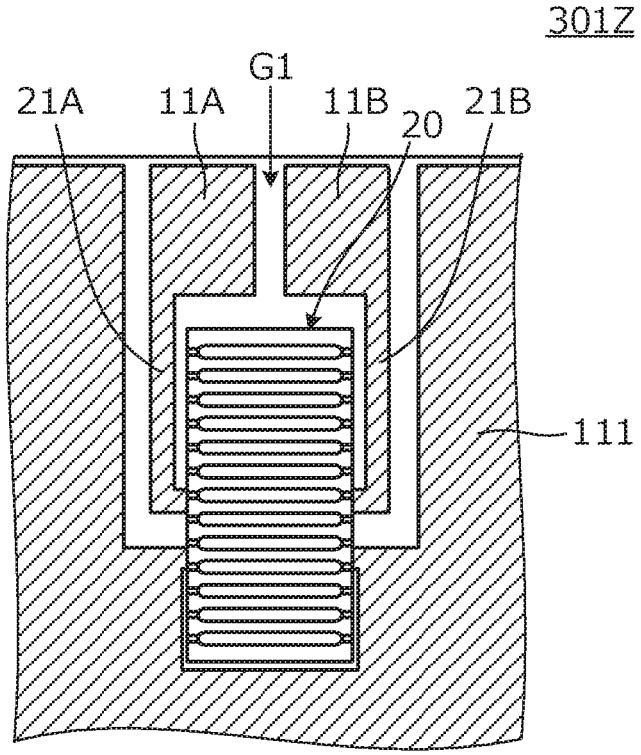
FIG. 48A is a partial plan view of the antenna device 301Z of a comparative example.
Figure 48B:
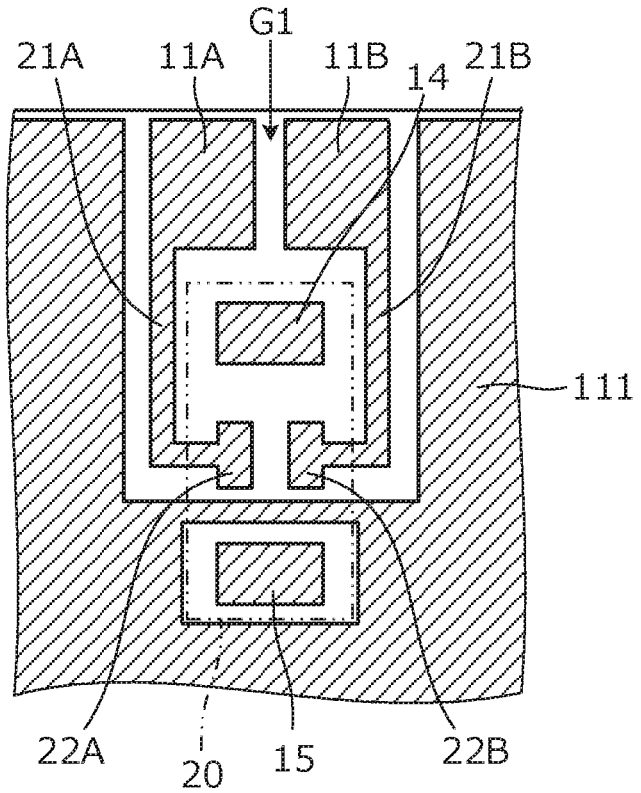
FIG. 48B is a plan view of a coil element arrangement portion prior to mounting of a coil element 20 of the antenna device 301Z.

FIG. 48A is a partial plan view of an antenna device 301Z of a comparative example, and FIG. 48B is a plan view of a coil element arrangement portion prior to mounting of a coil element 20 of the antenna device 301Z.

The antenna device 301X illustrated in FIG. 46A and FIG. 46B includes a first conductor portion 11 and does not include a loop-shaped conductor 10. The antenna device 301Y illustrated in FIG. 47A and FIG. 47B includes a loop-shaped conductor 10 and does not include a first conductor portion 11. While the antenna device 301Z illustrated in FIG. 48A and FIG. 48B includes both the loop-shaped conductor 10 and the planar conductor 111, the two points of the loop-shaped conductor are not connected to the planar conductor 111.

Figure 9:
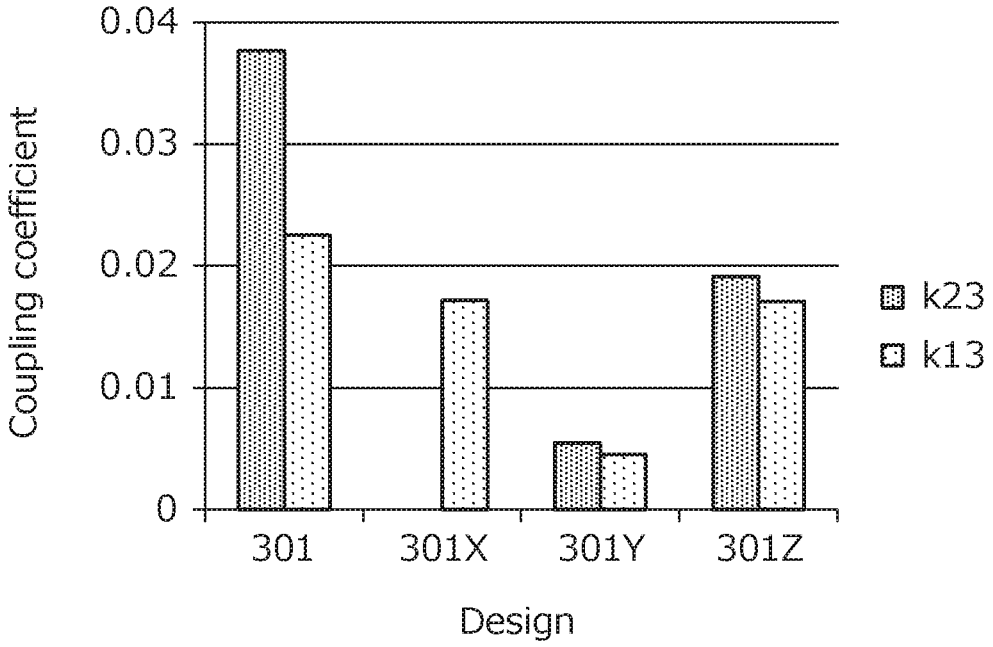
FIG. 9 is a graph showing a coupling coefficient of the antenna device 301 according to the second preferred embodiment of the present invention and each of antenna devices 301X, 301Y, and 301Z of a comparative example.

FIG. 9 is a graph showing a coupling coefficient of the antenna device 301 according to the present preferred embodiment of the present invention and each of the antenna devices 301X, 301Y, and 301Z of the comparative examples. The coupling coefficient k23 between the loop-shaped current path and the communication partner antenna 500 is the highest in the antenna device 301 according to the present preferred embodiment and the lowest (approximately equal to zero) in the antenna device 301X of the comparative example. Thus, it is assumed that the coupling between the loop-shaped conductor 10 and the communication partner antenna 500 has greatly contributed to coupling between the antenna device 301 and the communication partner antenna 500.

In addition, the coupling coefficient k13 between the coupling coil of the coil element 20 and the communication partner antenna 500 is the highest in the antenna device 301 according to the present preferred embodiment and the lowest in the antenna device 301Y of the comparative example. Thus, it is assumed that the coupling between the planar conductor 111 and the communication partner antenna 500 has contributed to the coupling between the antenna device 301 and the communication partner antenna 500.

Further, it is assumed that the reason why the coupling coefficient k23 of the antenna device 301Z is lower than the coupling coefficient k23 of the antenna device 301 is because the antenna device 301Z is not connected to the planar conductor 111 at the two points of the loop-shaped conductor and thus a current flowing through the loop-shaped conductor 10 is relatively small.

Figure 10A:
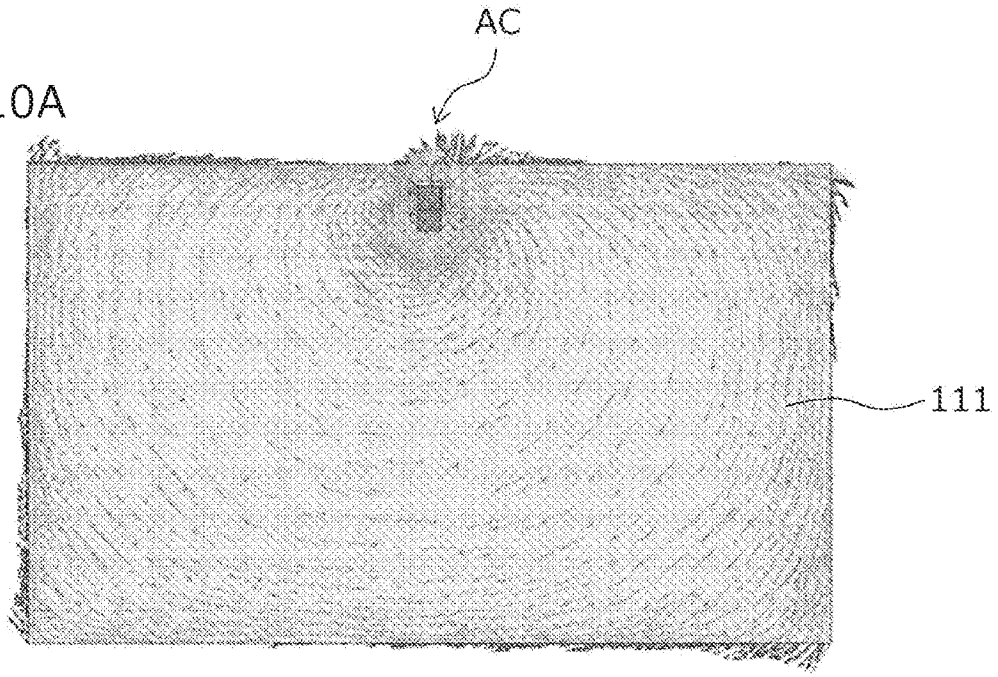
FIG. 10A is a view of the strength and direction of a current in a planar conductor 111 and a coil element arrangement portion AC of the antenna device 301 according to the second preferred embodiment of the present invention.
Figure 10B:
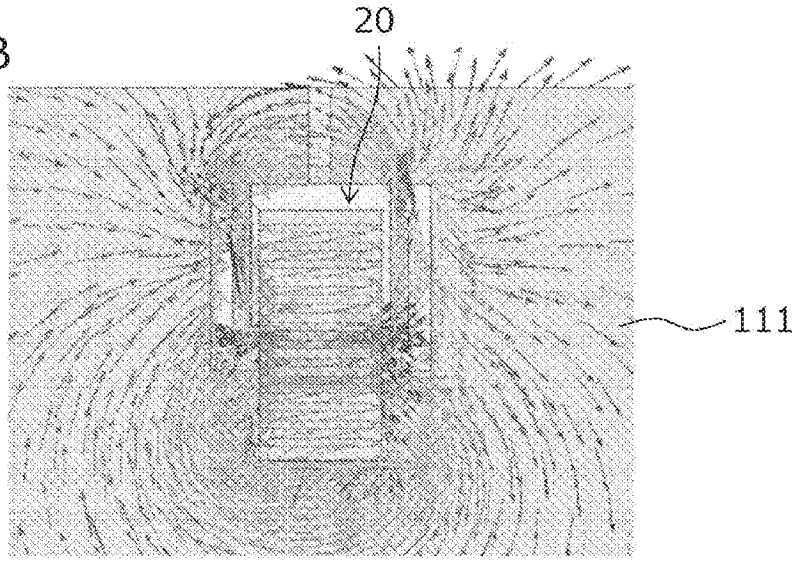
FIG. 10B is a view of the strength and direction of a current in the coil element arrangement portion AC.
Figure 11:
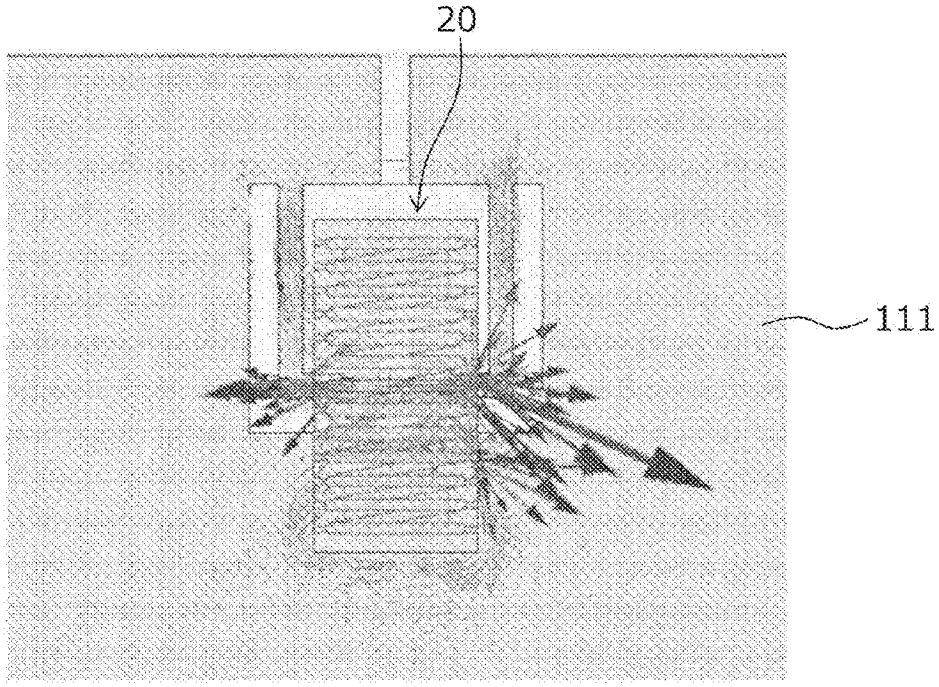
FIG. 11 is a view of the strength and direction of a current in the coil element arrangement portion AC of the antenna device 301 according to the second preferred embodiment of the present invention.

The following shows the difference in current flowing through the loop-shaped conductor 10, depending on whether or not the two points of the loop-shaped conductor are connected to the planar conductor 111. FIG. 10A is a view of the strength and direction of a current in a planar conductor 111 and a coil element arrangement portion AC of the antenna device 301 according to the present preferred embodiment of the present invention, and FIG. 10B is a view of the strength and direction of a current in the coil element arrangement portion AC. The strength and direction of a current are indicated by the concentration and direction of an arrow. FIG. 11 is a view of the strength and direction of a current in the coil element arrangement portion AC of the antenna device 301 according to the present preferred embodiment of the present invention. Unlike the way of illustration in FIG. 10B, the strength of a current at the starting point of an arrow is indicated by the size of the arrow. In FIG. 10B and FIG. 11, the capacitor 3 to be connected to the loop-shaped conductor 10 is not illustrated.

Figure 49A:
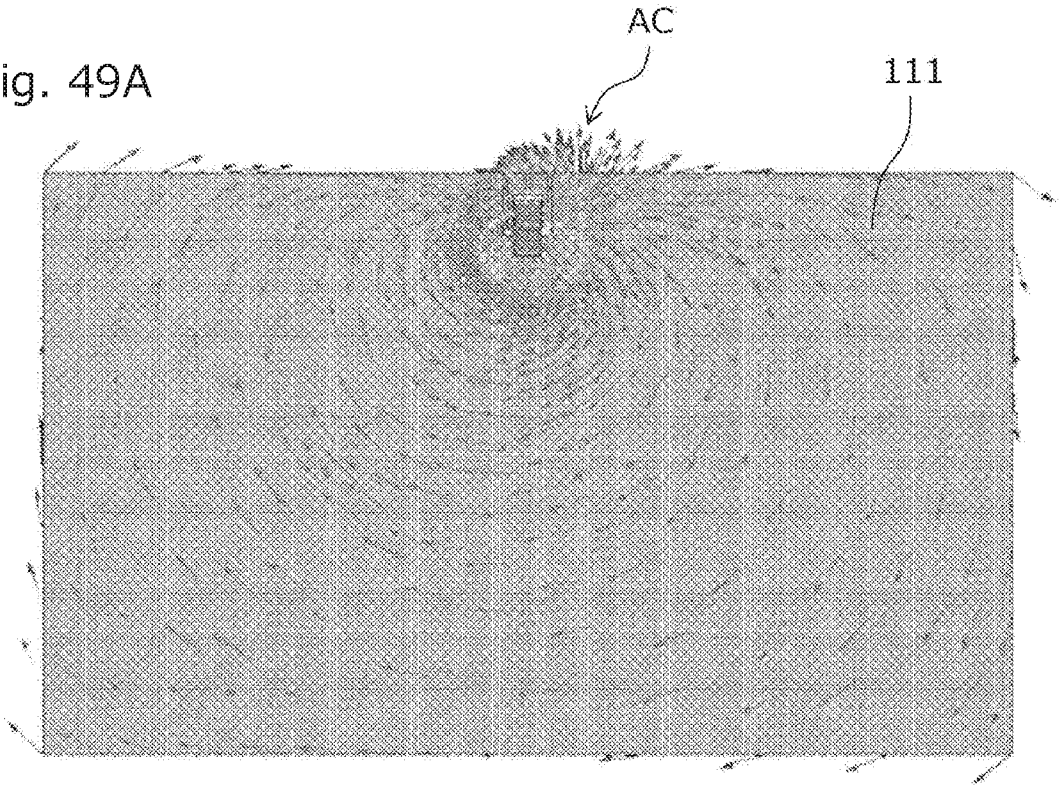
FIG. 49A is a view of the strength and direction of a current in a planar conductor 111 and a coil element arrangement portion AC of the antenna device 301Z of a comparative example.
Figure 49B:
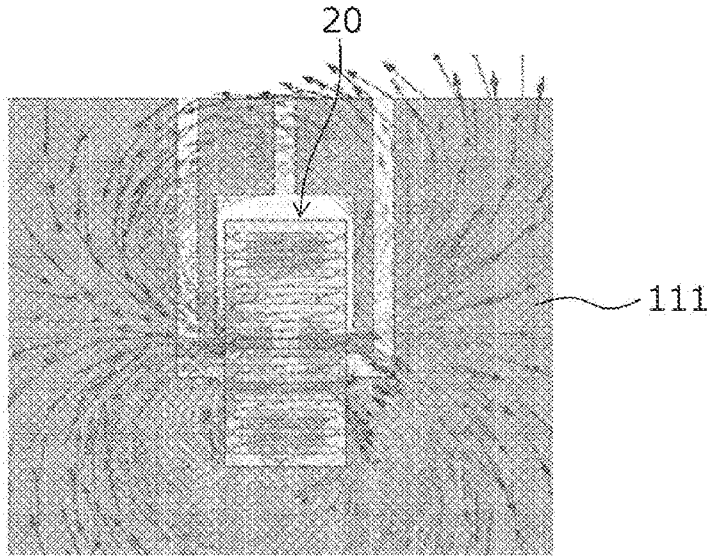
FIG. 49B is a view of the strength and direction of a current in the coil element arrangement portion AC.

In contrast, FIG. 49A is a view of the strength and direction of a current in a planar conductor 111 and a coil element arrangement portion AC of the antenna device 301Z of a comparative example, and FIG. 49B is a view of the strength and direction of a current in the coil element arrangement portion AC. The strength of the current at the starting point of an arrow is indicated by the size of the arrow. In addition, an illustration of the capacitor to be connected to the loop-shaped conductor 10 is omitted.

As is apparent from the comparison between FIG. 10B and FIG. 49B, in particular, unless the loop-shaped conductor 10 is connected to the planar conductor 111 at two points, a current flowing through the loop-shaped conductor 10 is relatively small. Thus, it can be understood that the coupling coefficient k23 of the antenna device 301 of the present preferred embodiment is higher than the coupling coefficient k23 of the antenna device 301Z of the comparative example.

Figure 12:
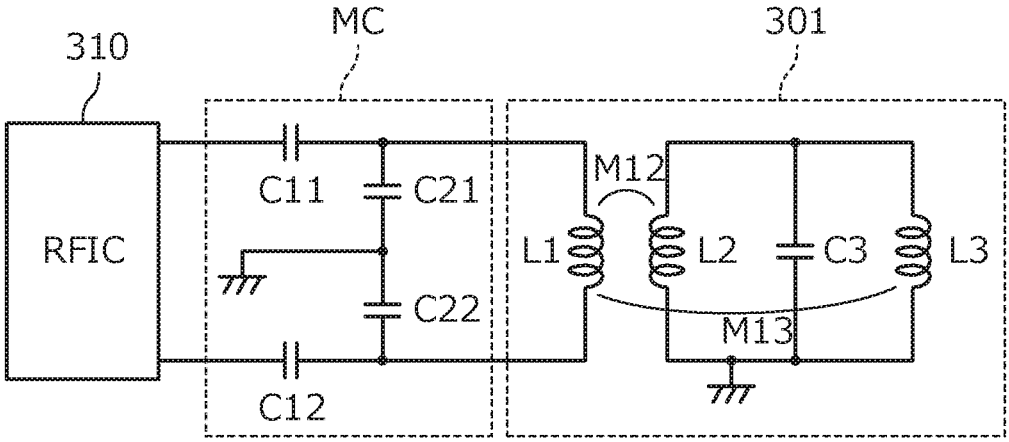
FIG. 12 is a circuit diagram of a circuit to be connected to the antenna device 301 according to the second preferred embodiment of the present invention.

FIG. 12 is a circuit diagram of a circuit to be connected to the antenna device 301 according to the present preferred embodiment of the present invention. However, an antenna device 301 portion is an equivalent circuit. In the figure, the coupling coil in the coil element 20 of the antenna device 301 is indicated by an inductor L1. In addition, the loop-shaped conductor 10 and the auxiliary conductor in the coil element 20 are indicated by one inductor L2. A capacitor C3 is equivalent to the capacitor 3 connected to the loop-shaped conductor 10. The current path that includes the inductor L2 and the capacitor C3 is equivalent to the loop-shaped current path. Further, an inductance component of a ground conductor pattern to be connected to both sides of the capacitor 3 is indicated by an inductor L3. The inductors L2 and L3 and the capacitor C3 define an LC resonant circuit. The resonant frequency of this LC resonant circuit is a frequency band used for communication.

During transmission, the inductor L1 and the inductor L2 are magnetically coupled to each other, as indicated by M12 in FIG. 12, and an induced current flows through the inductor L2 by magnetic flux that is generated from the inductor L1. In addition, the inductor L1 and the inductor L3 are magnetically coupled to each other, as indicated by M13 in FIG. 12, and an induced current flows through the inductor L3 by magnetic flux that is generated from the inductor L1. During reception, these reverse phenomena occur. In this manner, use of the current flowing through the two inductors L2 and L3 makes it possible to obtain high antenna characteristics.

It is to be noted that a matching circuit MC is not an essential component of a preferred embodiment of the present invention.

The inductor L1 is able to be defined as a primary antenna, and the resonant circuit by the inductors L2 and L3 and the capacitor C3 is able to be defined as a secondary antenna.

The inductor L1 is connected to an RFIC 310 through the matching circuit MC. The RFIC 310 is an integrated circuit provided with a wireless communication circuit for NFC (Near Field Communication) that uses a 13.56-MHz band, for example. The matching circuit MC includes capacitors C11 and C12 connected in series and capacitors C21 and C22 shunt connected to ground. This RFIC 310 or the RFIC 310 and the matching circuit MC are equivalent to a "feed circuit".

While electric power is supplied to the primary antenna (inductor L1) with a balanced circuit, this may be configured by an unbalanced circuit. In addition, the planar conductor 111 may not necessarily be a ground conductor pattern. Since the electrical connection between the primary antenna and the secondary antenna is based on magnetic field coupling, the primary antenna and the secondary antenna, even when each being balanced or unbalanced, are able to be electrically connected.

Figure 13A:
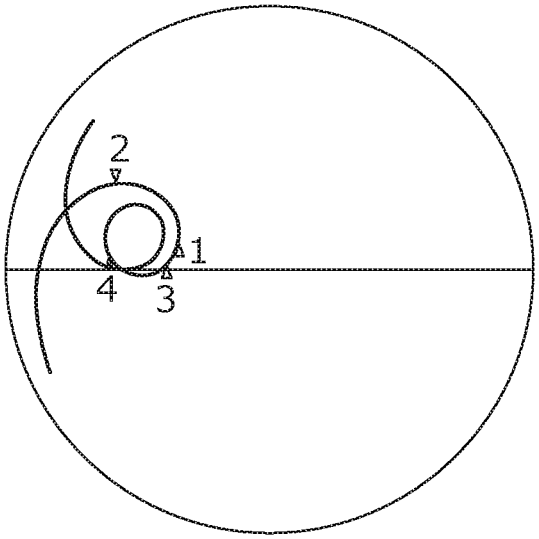
FIG. 13A is a view of a reflection coefficient, on a Smith chart, as viewed from an RFIC 310 to a matching circuit MC that are illustrated in FIG. 12.
Figure 13B:
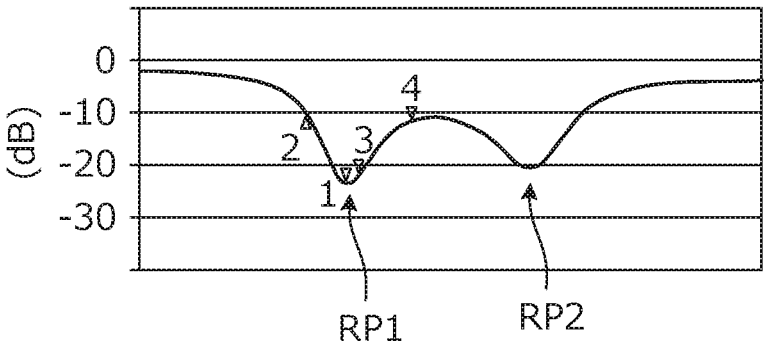
FIG. 13B is a view of a frequency characteristic of a real portion of a reflective coefficient.

FIG. 13A is a view of a reflection coefficient, on a Smith chart, as the side of the matching circuit MC that is illustrated in FIG. 12 is viewed from the side of the RFIC 310 that is illustrated in FIG. 12. FIG. 13B is a view of the frequency characteristics of a real portion of a reflective coefficient. Triangle markers 1 to 4 in FIG. 13A correspond to markers 1 to 4 in FIG. 13B.

A resonant peak RP1 illustrated in FIG. 13B mainly occurs in resonance of the primary antenna, and a resonant peak RP2 mainly occurs in resonance of the secondary antenna. In this manner, two resonances appear by multiple resonances with the primary antenna and the secondary antenna. In this example, communication is performed within a range of the two resonant peaks, and also at a frequency close to low frequencies. For example, communication is performed at a frequency indicated by the marker 3.

It is to be noted that the high and low relationship of the resonant frequency of the primary antenna and the resonant frequency of the secondary antenna may be reversed.

While, in the present preferred embodiment, the example in which the planar conductor 111 and the loop-shaped conductor 10 are conductor patterns that are provided on the same surface of the wiring board 120 is shown, the planar conductor 111 and the loop-shaped conductor 10 may be provided on a different surface or a different layer. In addition, either or both of the conductors may be provided on a surface different from a wiring board.

Third Preferred Embodiment

Figure 14A:
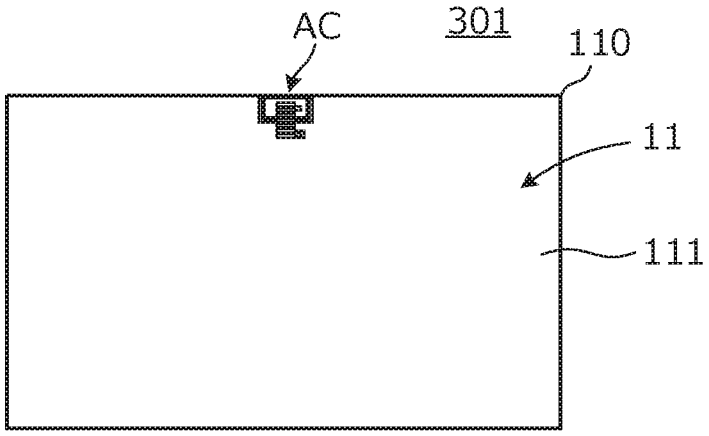
FIG. 14A is a plan view of an antenna device according to a third preferred embodiment of the present invention.
Figure 14B:
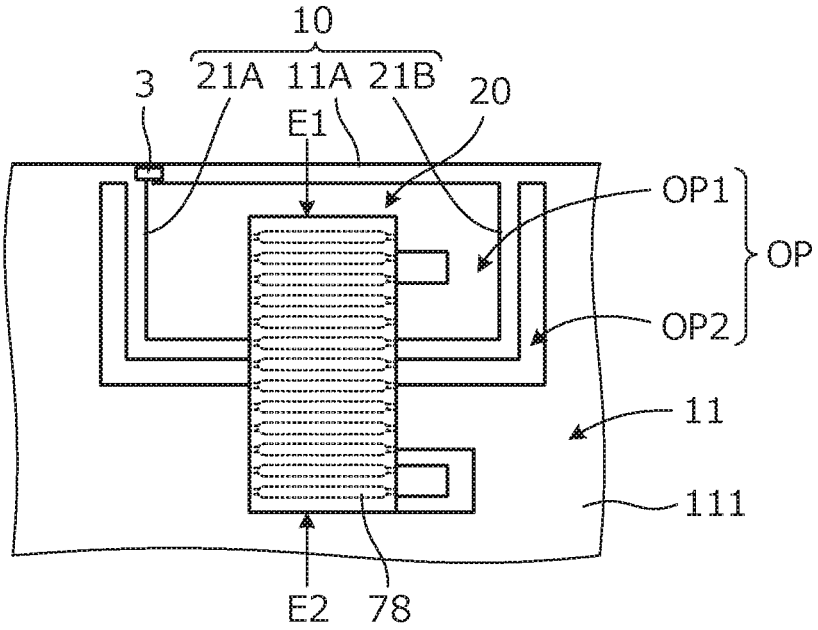
FIG. 14B is a plan view of the coil element arrangement portion AC.
Figure 14C:
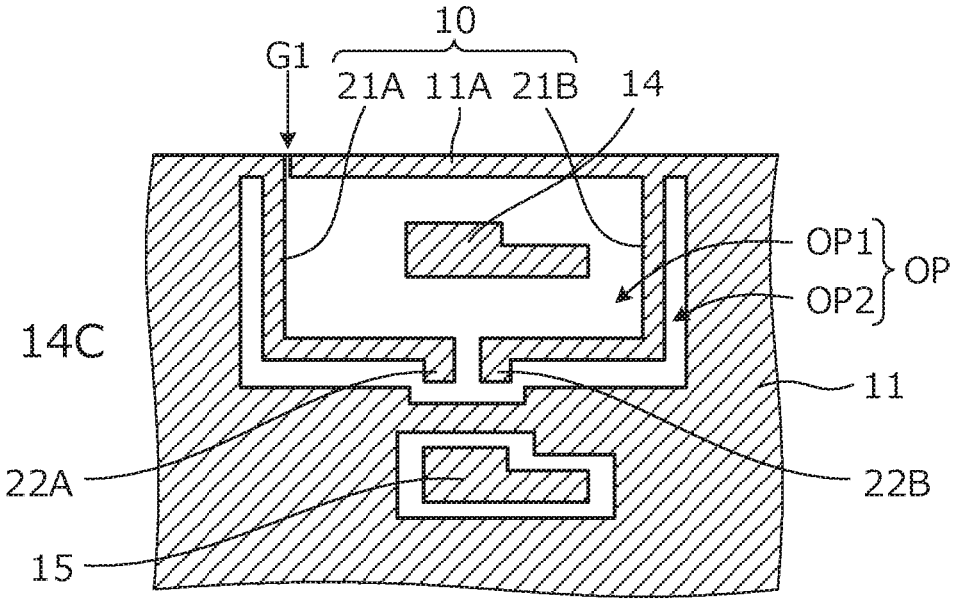
FIG. 14C is a plan view of the coil element arrangement portion prior to mounting of a coil element 20.

FIG. 14A is a plan view of an antenna device according to a third preferred embodiment of the present invention, and FIG. 14B is a plan view of the coil element arrangement portion AC. FIG. 14C is a plan view of the coil element arrangement portion prior to mounting of a coil element 20.

In the antenna device of the present preferred embodiment, the first conductor portion 11 is provided with an extension portion 11A of the first conductor, and the second conductor portions 21A and 21B, together with the extension portion 11A, configure a loop-shaped conductor. The third preferred embodiment is different from the second preferred embodiment in the shape of a conductive member that is provided on the surface of the wiring board 110 and the shape of a conductor opening OP. Other configurations are the same as the configurations described in the second preferred embodiment.

As in the present preferred embodiment, the antenna device may be structured so that the extension portion 11A may be formed in the first conductor portion 11 and this extension portion 11A and the second conductor portion 21, together with the capacitor 3, may define the loop-shaped current path.

Fourth Preferred Embodiment

Figure 15A:
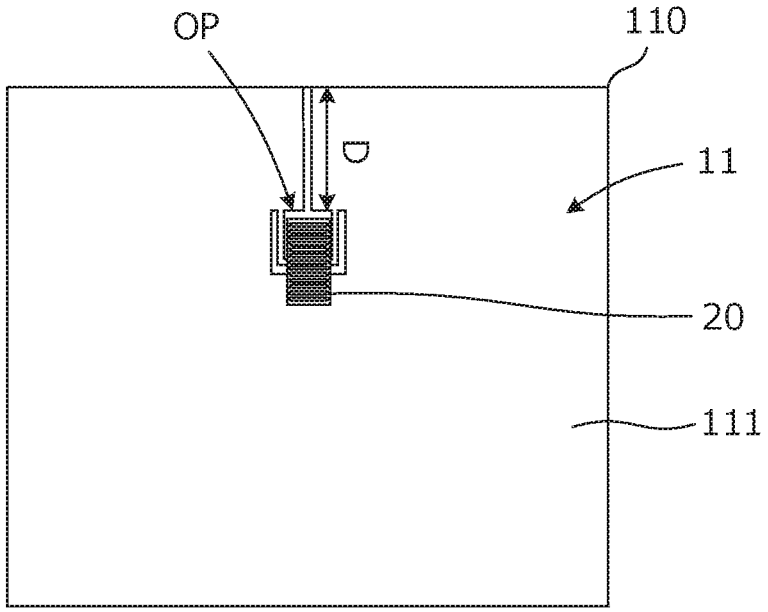
FIG. 15A and FIG. 15B are plan views of an antenna device according to a fourth preferred embodiment of the present invention.
Figure 15B:
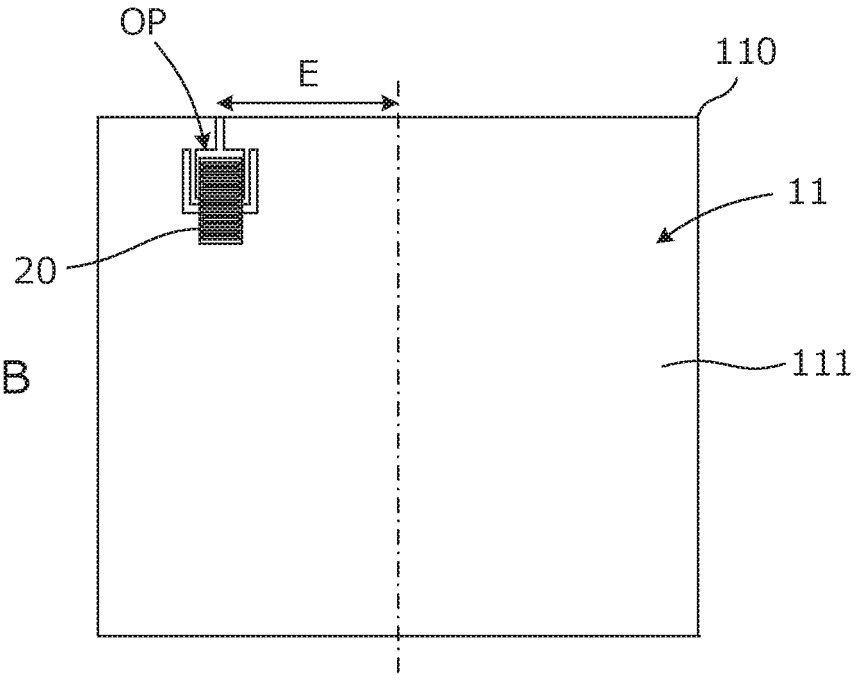

FIG. 15A and FIG. 15B are plan views of an antenna device according to a fourth preferred embodiment of the present invention. However, an illustration of the capacitor to be connected to a gap is omitted. The configuration of the conductive member of the wiring board 110 is the same as the configuration illustrated in FIG. 1B or FIG. 3B. The fourth preferred embodiment is different from the first preferred embodiment or the second preferred embodiment in the positional relationship of the conductor opening OP in the first conductor portion 11. Other configurations are the same as the configurations described in the first preferred embodiment or the second preferred embodiment.

In FIG. 15A, when a distance from the outer edge of the first conductor portion 11 to the conductor opening OP is indicated by a distance D, this distance D is greater than any distance in each of the preferred embodiments that has been illustrated.

In this manner, the distance D from the outer edge of the first conductor portion 11 to the conductor opening OP may be increased. As this distance is greater, the "loop-shaped current path" becomes longer and larger, so that the radiation characteristics of an antenna device are improved.

In FIG. 15B, when a distance along the outer edge, from the center line of the first conductor portion 11 to the conductor opening OP, is indicated by a distance E, this distance E is greater than any distance in each of the preferred embodiments that has been illustrated.

Thus, even when the position of the conductor opening OP is shifted from the center line of the first conductor portion 11, the effects of preferred embodiments of the present invention are obtained. However, as the distance E along the outer edge from the center line of the first conductor portion 11 to the conductor opening OP is greater, the strength distribution of the current flowing through the planar conductor 111 of the first conductor portion 11 is more biased, so that the radiation characteristics of an antenna device may be degraded compared with a case in which the conductor opening is in the vicinity of the center line as in the second preferred embodiment.

Figure 16A:
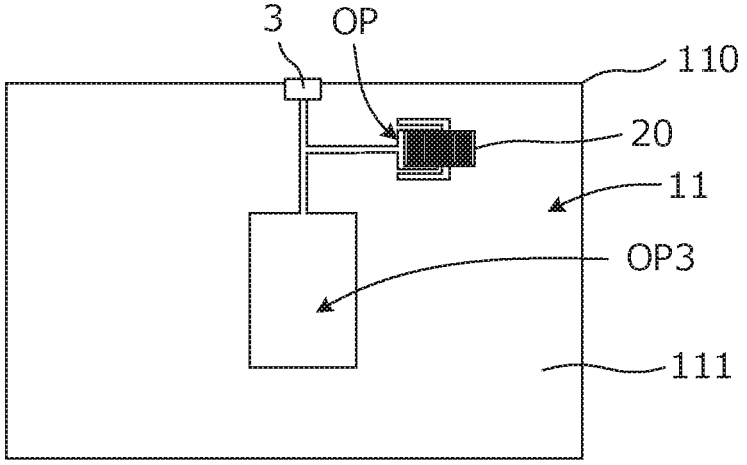
FIG. 16A, FIG. 16B, and FIG. 16C are plan views of another antenna device according to the fourth preferred embodiment of the present invention.
Figure 16B:
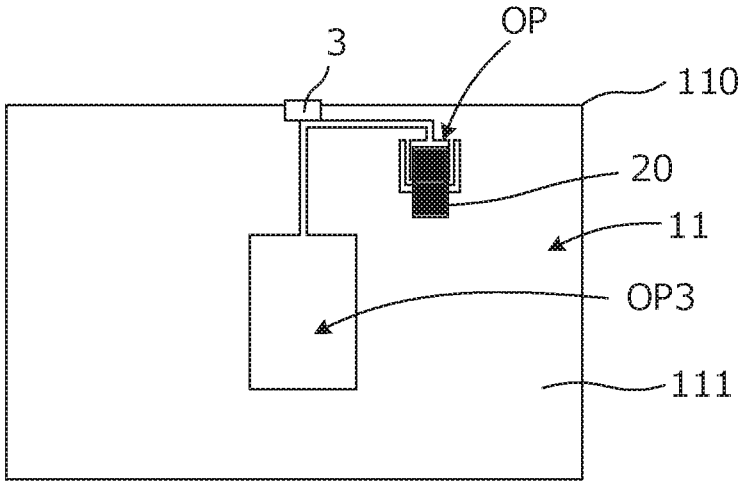
Figure 16C:
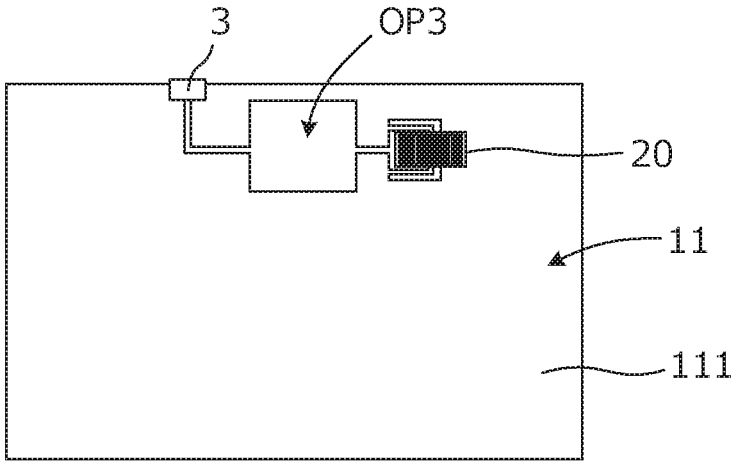

FIG. 16A, FIG. 16B, and FIG. 16C are plan views of another antenna device according to the fourth preferred embodiment of the present invention. The configuration of the conductive member of the wiring board 110 is the same as the configuration illustrated in FIG. 1B or FIG. 3B. The fourth preferred embodiment is different from the first preferred embodiment or the second preferred embodiment in that the first conductor portion 11 includes a third conductor opening OP3. Other configurations are the same as the configurations described in the first preferred embodiment or the second preferred embodiment.

Any of the examples illustrated in FIG. 16A, FIG. 16B, and FIG. 16C includes the third conductor opening OP3 formed in the first conductor portion 11. In the examples illustrated in FIG. 16A, and FIG. 16B, the conductor opening OP is connected not only to the outer edge of the first conductor portion 11 but also to the third conductor opening OP3. In the example of FIG. 16C, the third conductor opening OP3 is located between the conductor opening OP and the outer edge of the first conductor portion 11. In addition, the capacitor 3 is arranged in the vicinity of the outer edge of the first conductor portion 11.

According to the antenna device illustrated in FIG. 16A, FIG. 16B, and FIG. 16C, a current flows through the planar conductor 111 so as to circulate around the edge end of the third conductor opening OP3, the "loop-shaped current path" becomes larger and thus the radiation characteristics of an antenna device are improved.

Fifth Preferred Embodiment

Figure 17A:
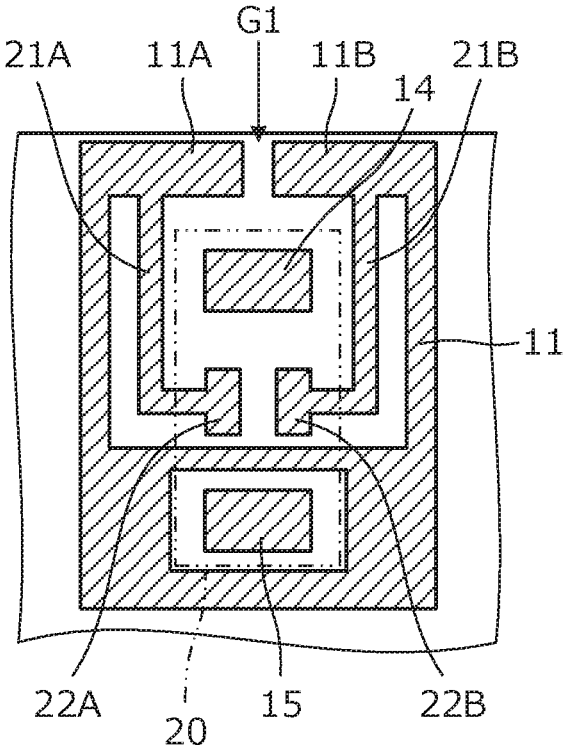
FIG. 17A is a plan view of a coil element arrangement portion prior to mounting of a coil element in an antenna device according to a fifth preferred embodiment of the present invention.
Figure 17B:
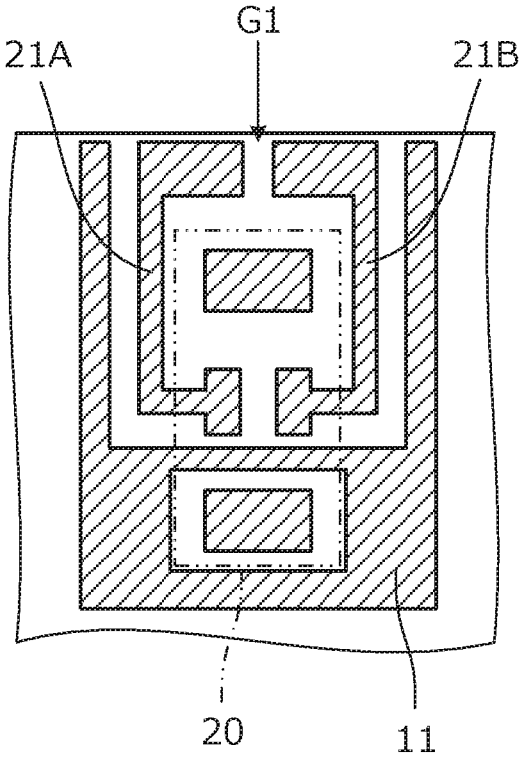
FIG. 17B is a plan view of a coil element arrangement portion in an antenna device of a comparative example.

In a fifth preferred embodiment of the present invention, a description is directed to an antenna device provided with a first conductor portion that includes a linear portion. FIG. 17A is a plan view of a coil element arrangement portion prior to mounting of a coil element 20 in an antenna device according to the fifth preferred embodiment of the present invention. The fifth preferred embodiment is different from the second preferred embodiment in that the first conductor portion 11 includes a linear portion. Other configurations are the same as the configurations described in the second preferred embodiment. FIG. 17B is a plan view of a coil element arrangement portion in an antenna device of a comparative example. Both the coil elements 20 are indicated by a two-dot chain line, and an illustration of a capacitor to be connected to a gap is omitted.

In the base material of the antenna device according to the present preferred embodiment, as illustrated in FIG. 17A, extension portions 11A and 11B of a first conductor portion and second conductor portions 21A and 21B that are electrically connected to each other are provided. The first conductor portion 11 includes a linear portion. Other configurations are the same as the configurations of the antenna device described in the second preferred embodiment. In the comparative example illustrated in FIG. 17B, the second conductor portions 21A and 21B are separated from the first conductor portion 11.

With respect to the antenna device of the present preferred embodiment illustrated in FIG. 17A and the antenna device of the comparative example illustrated in FIG. 17B, the comparison results of each of the coupling coefficient k13 (see FIG. 8) of the coupling coil of the coil element 20 and the communication partner antenna 500 and the coupling coefficient k23 of the loop-shaped conductor 10 and the communication partner antenna 500 are as follows.

| | Present Preferred Embodiment | Comparative Example |
|---|---|---|
| k13 | 0.02069 | 0.00012 |
| k23 | 0.01007 | 0.00325 |

As illustrated in the present preferred embodiment, since the coupling coefficient k23 of the loop-shaped current path and the communication partner antenna 500 is larger than the coupling coefficient of the comparative example, it is apparent that the linear portion of the first conductor portion 11 contributes to radiation. In addition, the first conductor portion 11 is partially connected to the extension portions 11A and 11B of the first conductor portion and the second conductor portions 21A and 21B, which increases the current induced in the first conductor portion 11, so that the coupling coefficient k13 similarly becomes larger with respect to the comparative example.

Sixth Preferred Embodiment

In a sixth preferred embodiment of the present invention, a description is made of an example different from the examples that have been described in the direction in which the gap connecting the outer edge of the first conductor portion 11 and the conductor opening OP is drawn out. Other configurations are the same as the configurations described in the first preferred embodiment.

Figure 18:
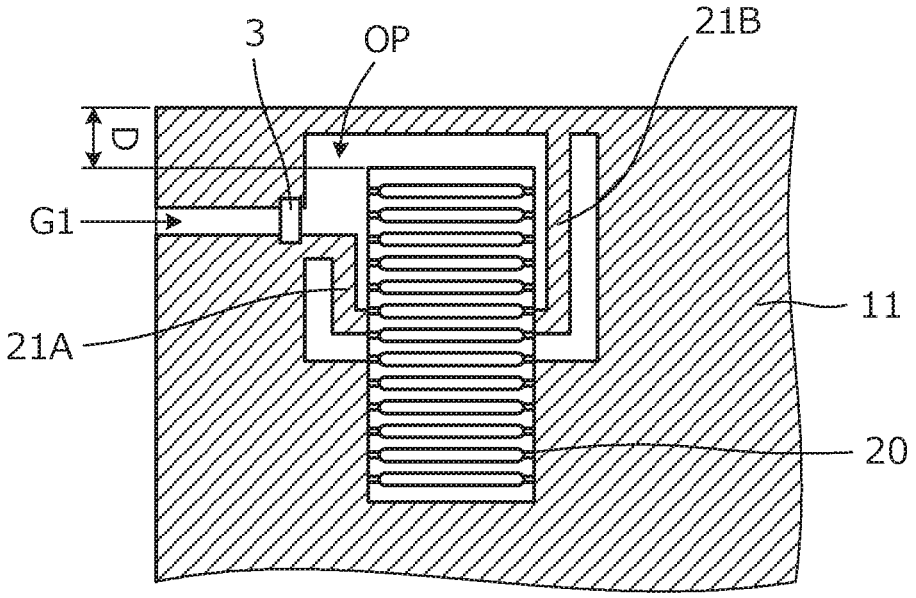
FIG. 18 is a plan view of a main portion of an antenna device according to a sixth preferred embodiment of the present invention.

FIG. 18 is a plan view of a main portion of an antenna device according to the sixth preferred embodiment of the present invention. In this example, the gap G1 connecting the outer edge of the first conductor portion 11 and the conductor opening OP is drawn out in the direction perpendicular to the coil winding axis of the coupling coil of the coil element 20. Other configurations are the same as the configurations illustrated in FIG. 3A and FIG. 3B. In the example illustrated in FIG. 18, even when the distance D from the outer edge of the first conductor portion 11 to the conductor opening OP is short, an antenna device is able to be provided.

Figure 19A:
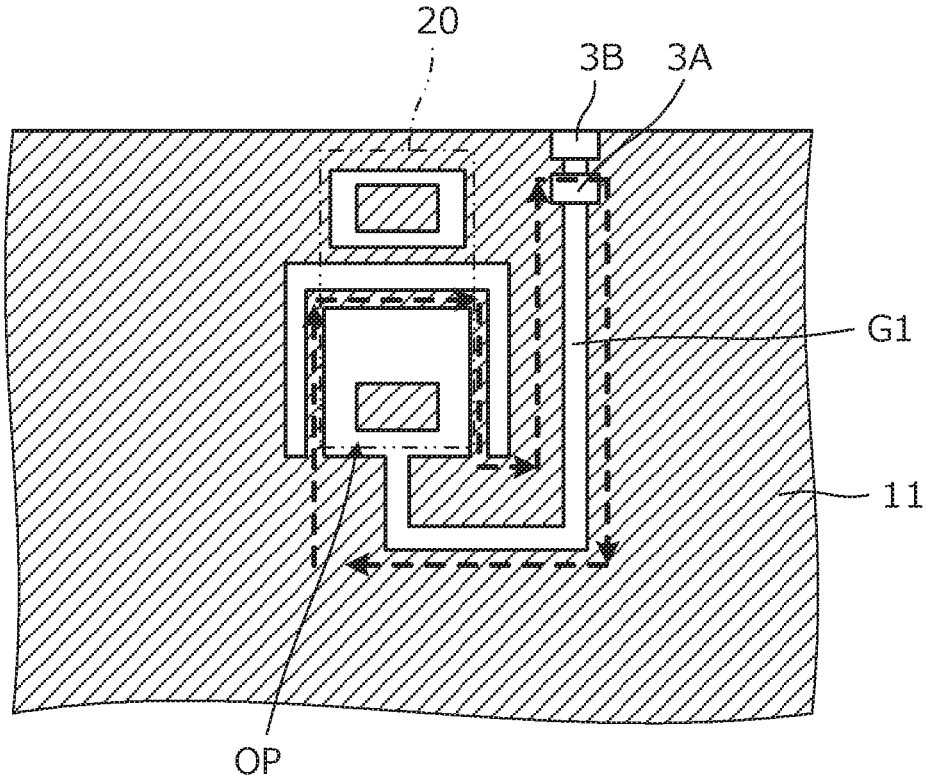
FIG. 19A and FIG. 19B are plan views of a main portion of another antenna device according to the sixth preferred embodiment of the present invention.
Figure 19B:
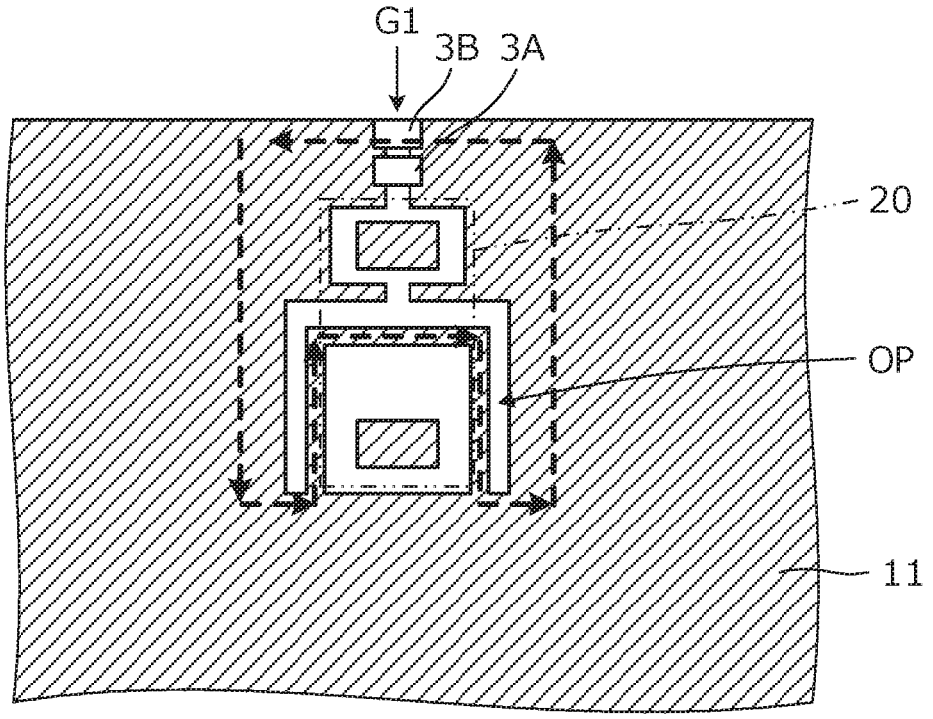

FIG. 19A and FIG. 19B are plan views of a main portion of another antenna device according to the sixth preferred embodiment of the present invention. However, the coil element 20 is indicated by a two-dot chain line. In the example illustrated in FIG. 19A, the gap connecting the outer edge of the first conductor portion 11 and the conductor opening OP is bent, and the direction in which the gap G1 is drawn out from the conductor opening OP is opposite to the direction of the outer edge of the first conductor portion 11. In the example illustrated in FIG. 19B, the gap G1 connecting the outer edge of the first conductor portion 11 and the conductor opening OP is drawn out from the opposite side of the conductor opening OP. It is to be noted that, in both examples, the two capacitors 3A and 3B are connected in parallel to each other.

In FIG. 19A and FIG. 19B, a dashed arrow indicates a current path of the "loop-shaped current path." According to the present preferred embodiment, since the current path of the "loop-shaped current path" becomes longer and larger, and since the conductor opening OP is able to be arranged at a position near the center of the first conductor portion 11, the radiation characteristics of an antenna device are improved.

In addition, in the present preferred embodiment, as with the second preferred embodiment, the coil element 20 is provided with an auxiliary conductor, and the second conductor portion may include 21A and 21B.

Seventh Preferred Embodiment

Figure 20:
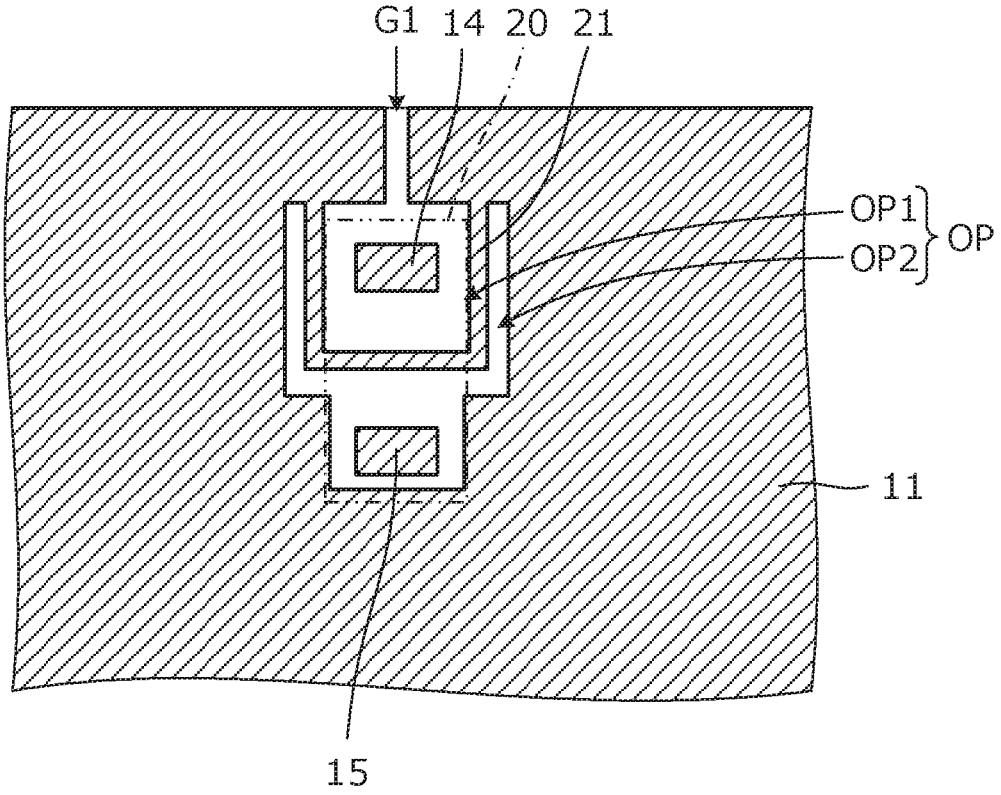
FIG. 20 is a plan view of a main portion of an antenna device according to a seventh preferred embodiment of the present invention.

FIG. 20 is a plan view of a main portion of an antenna device according to a seventh preferred embodiment of the present invention. However, the coil element 20 is indicated by a two-dot chain line.

Unlike the antenna device illustrated in FIG. 1B, the second conductor opening OP2 of the conductor opening OP is continuous with a nonconductor formed portion around the coil element connection pad 15. Other configurations are the same as the configurations described in the first preferred embodiment. Even with such a structure, the antenna device acts similarly to the antenna device described in the first preferred embodiment. However, in order to significantly reduce or prevent occurrence of magnetic flux that does not contribute to the coupling between the coupling coil of the coil element 20 and the communication partner antenna, as in the first preferred embodiment, it is preferable that the second conductor opening OP2 may not be continuous with a nonconductor formed portion around the coil element connection pad 15.

Eighth Preferred Embodiment

Figure 21:
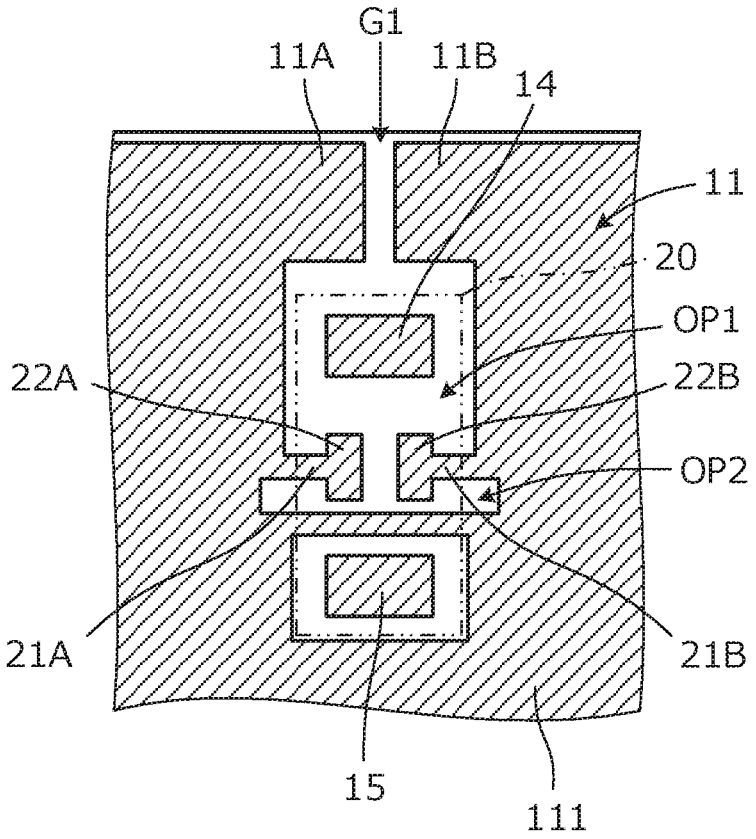
FIG. 21 is a plan view of a coil element arrangement portion prior to mounting of a coil element and a capacitor in an antenna device according to an eighth preferred embodiment of the present invention.

In an eighth preferred embodiment of the present invention, a description is made of an example in which the second conductor portion is short compared with the second conductor portion of the second preferred embodiment. Other configurations are the same as the configurations described in the second preferred embodiment. FIG. 21 is a plan view of a coil element arrangement portion prior to mounting of a coil element 20 and a capacitor in an antenna device according to the eighth preferred embodiment of the present invention.

The antenna device of the present preferred embodiment similar to the antenna device described in the second preferred embodiment, including a loop-shaped conductor defined by a portion of the first conductor portion and the second conductor portions 21A and 21B, and is provided with the planar conductor 111 that is a portion of the first conductor portion. In addition, the antenna device is also provided with the coil element connection pads 14 and 15 and the auxiliary coil connection pads 22A and 22B.

As in the present preferred embodiment, even when the second conductor is comparatively short, a loop-shaped current path is defined by the loop-shaped conductor, so that the antenna device acts similarly to the antenna device described in the second preferred embodiment.

Ninth Preferred Embodiment

In a ninth preferred embodiment of the present invention, a description is made of an antenna device in which the second conductor portion provided on the wiring board 110 has a shape of a coil of one turn or more. Other configurations are the same as the configurations described in the second preferred embodiment.

Figure 22A:
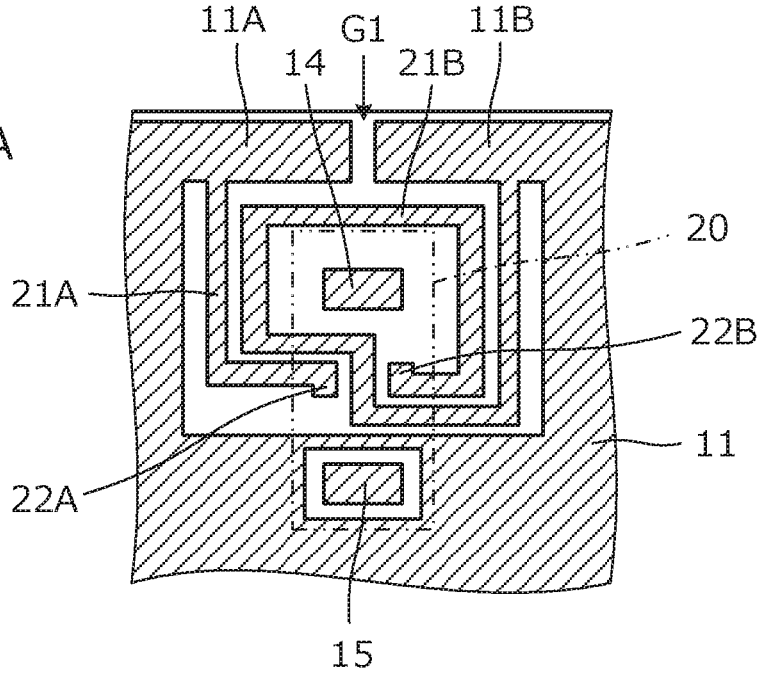
FIG. 22A is a plan view of a main portion of an antenna device according to a ninth preferred embodiment of the present invention.

FIG. 22A is a plan view of a main portion of an antenna device according to the ninth preferred embodiment of the present invention. However, an illustration of the capacitor to be connected to a gap is omitted. Unlike the antenna device illustrated in FIG. 3B, the second conductor portion 21B has a circular shape, and both the second conductor portions 21A and 21B have a rectangular spiral shape of a coil of one turn or more.

Figure 22B:
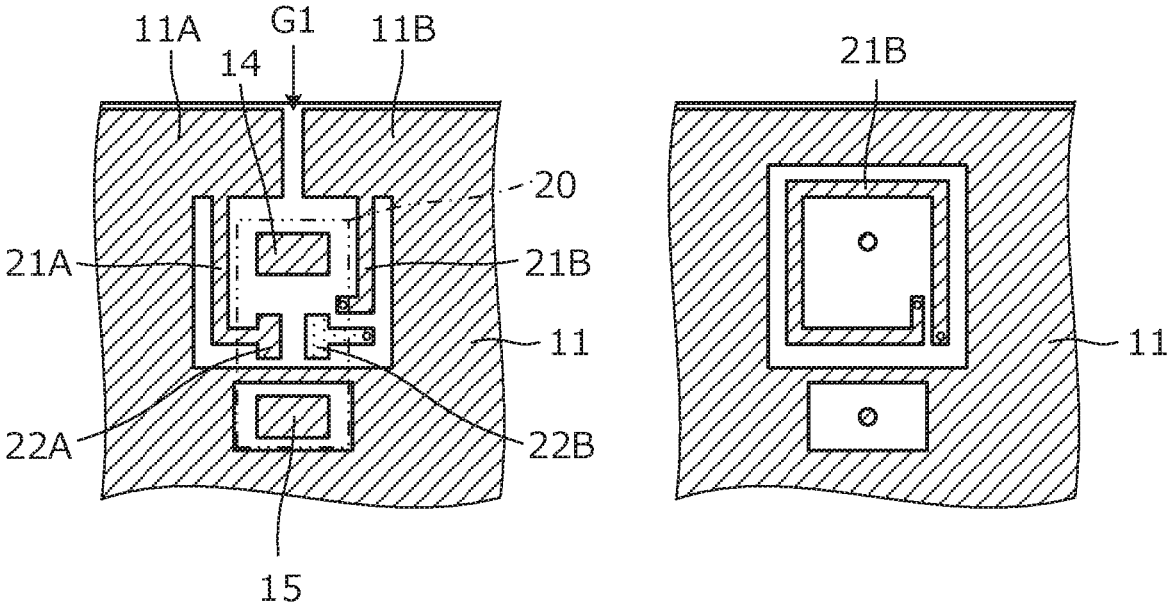
FIG. 22B is a plan view of a main portion of another antenna device according to the ninth preferred embodiment of the present invention and a plan view of a conductor pattern of an inner layer.

FIG. 22B is a plan view of a main portion of another antenna device according to the ninth preferred embodiment of the present invention and a plan view of a conductor pattern of an inner layer. The second conductor portion 21B includes a circular shape extending over a surface layer and an inner layer. Both the second conductor portions 21A and 21B define a rectangular spiral shape of a coil of one turn or more.

In any of the antenna devices illustrated in FIG. 22A and FIG. 22B, since the coupling coefficient of the coupling coil of the coil element 20 and the second conductor portions 21A and 21B is high, high antenna characteristics are obtained.

Tenth Preferred Embodiment

In a tenth preferred embodiment of the present invention, a description is made of an antenna device provided with a coil element with a planar coil shape.

Figure 23A:
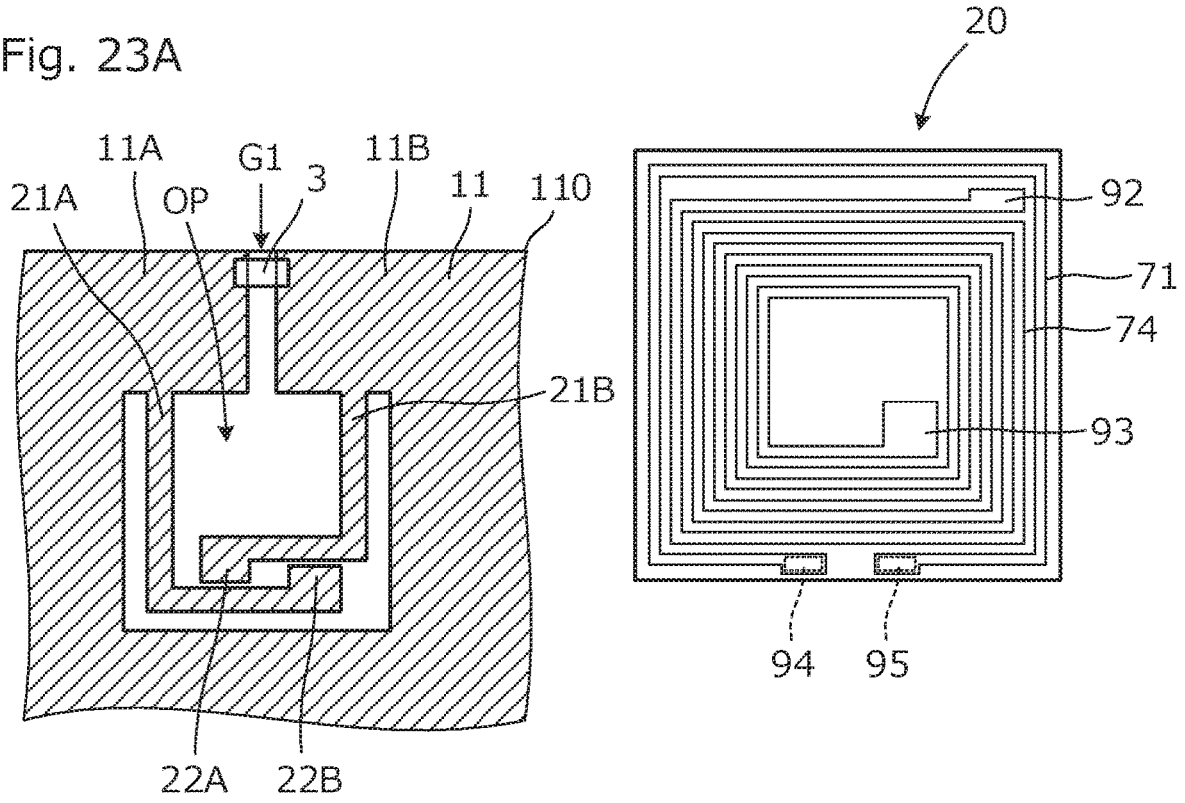
FIG. 23A is an exploded plan view of an antenna device according to a tenth preferred embodiment of the present invention.
Figure 23B:
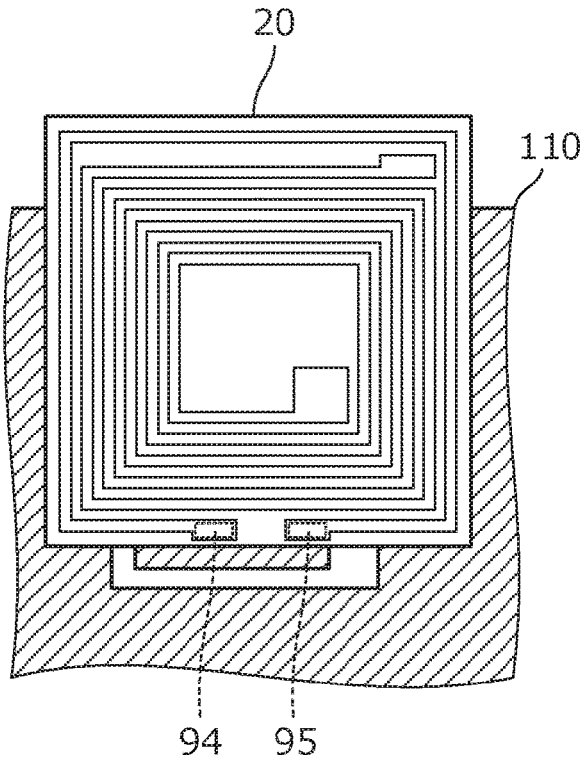
FIG. 23B is a plan view of a main portion of the antenna device.

FIG. 23A is an exploded plan view of an antenna device according to the tenth preferred embodiment of the present invention, and FIG. 23B is a plan view of a main portion of the antenna device. This antenna device, similar to the antenna device described in the second preferred embodiment, is provided with a first conductor portion 11 with extension portions 11A and 11B, and second conductor portions 21A and 21B. In addition, the antenna device is provided with the auxiliary coil connection pads 22A and 22B. The second conductor portions 21A and 21B and the extension portions 11A and 11B of the first conductor portion 11, together with the capacitor 3, define a "loop-shaped current path."

The coil element 20 is provided with a base material having flexibility, a linear conductor 74 provided on the base material and having a rectangular spiral shape, and a linear conductor 71 wound around the outside of a rectangular spiral shaped linear conductor. Both ends of the linear conductor 74 are used as terminals 92 and 93 to be connected to a feed circuit. The both ends of the linear conductor 71 are electrically connected to the terminals 94 and 95 on a bottom surface through an interlayer connection conductor. The linear conductor 74 defines and functions as a "coupling coil", and the linear conductor 71 defines and functions as an "auxiliary conductor."

As illustrated in FIG. 23B, the coil element 20 is mounted on the wiring board 110, and the terminals 94 and 95 are connected to the auxiliary coil connection pads 22A and 22B.

The coil winding axis of the coupling coil is perpendicular or substantially perpendicular to a surface of the wiring board 110, and, in a plan view of the wiring board 110, the coil opening of the coupling coil overlaps the conductor opening OP.

According to the present preferred embodiment, the coupling coil of the coil element 20 is magnetically coupled to the "loop-shaped current path."

Eleventh Preferred Embodiment

In an eleventh preferred embodiment of the present invention, a description is made of another example in which the coil winding axis direction of the coupling coil of the coil element is a direction perpendicular to the surface of the base material.

Figure 24:
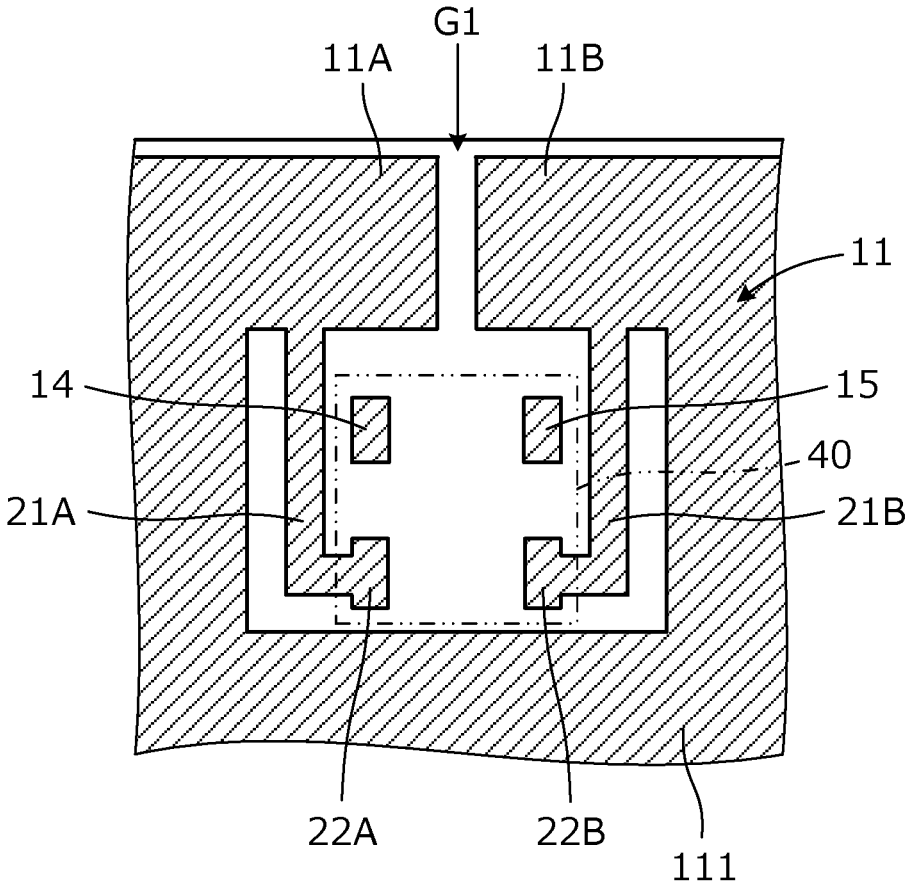
FIG. 24 is a plan view of a coil element arrangement portion prior to mounting of a coil element in an antenna device according to an eleventh preferred embodiment of the present invention.

FIG. 24 is a plan view of a coil element arrangement portion prior to mounting of a coil element 40 in an antenna device according to the eleventh preferred embodiment of the present invention. However, the coil element 40 is indicated by a two-dot chain line.

The antenna device of the present preferred embodiment, similar to the antenna device described in the second preferred embodiment, is provided with the extension portions 11A and 11B of the first conductor portion 11, the second conductor portions 21A and 21B, and the planar conductor 111 that is a portion of the first conductor portion 11. In addition, the antenna device is also provided with the coil element connection pads 14 and 15 and the auxiliary coil connection pads 22A and 22B.

The coil element connection pads 14 and 15 are not positioned so as to sandwich the positions in which the auxiliary coil connection pads 22A and 22B are arranged but are positioned in parallel to the auxiliary coil connection pads 22A and 22B.

Figure 25:
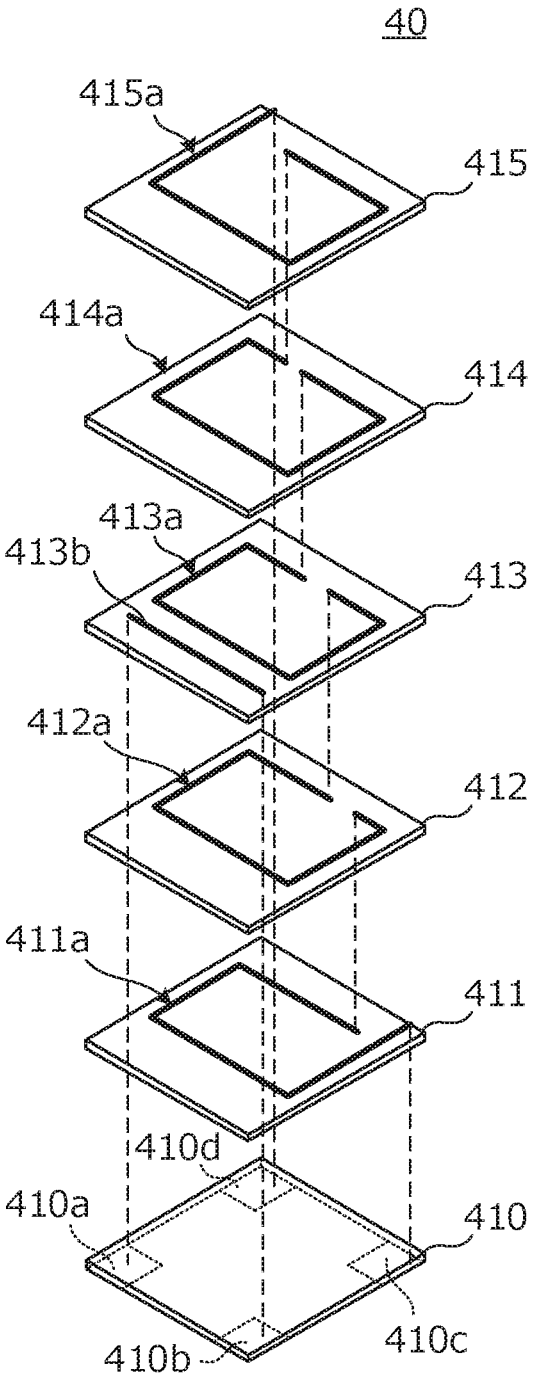
FIG. 25 is an exploded perspective view of a coil element 40 according to the eleventh preferred embodiment of the present invention.

FIG. 25 is an exploded perspective view of a coil element 40 according to the present preferred embodiment of the present invention. The coil element 40 includes a stacked body of a plurality of magnetic layers. In FIG. 25, a portion of the plurality of magnetic layers of the coil element 40 is illustrated. Coil conductor patterns 411*a*, 412*a*, 413*a*, 414*a*, and 415*a* are respectively provided on magnetic layers 411, 412, 413, 414, and 415.

The coil conductor patterns 411*a*, 412*a*, 413*a*, 414*a*, and 415*a* each have a loop shape, and are electrically connected to each other by a via conductor and thus define one coupling coil. In addition, an auxiliary coil pattern 413*b* with a linear shape is provided on the magnetic layer 413. An auxiliary coil pattern 413*b* is located near the coil conductor pattern 413*a*.

A nonmagnetic layer 410, on which input and output terminals 410*a*, 410*b*, 410*c*, and 410*d* are located, is stacked below the magnetic layer 411. The input and output terminals 410*a* and 410*b* are connected to the auxiliary coil pattern 413*b* through via conductors. The input and output terminal 410*c* is connected to one end of the coil conductor pattern 411*a*, and the input and output terminal 410*d* is connected to one end of the coil conductor pattern 415*a*. In other words, the input and output terminals 410*c* and 410*d* are input and output terminals of the coil including the coil conductor patterns 411*a* to 415*a*. It is to be noted that the magnetic layers 411, 412, 413, 414, and 415 may not necessarily be magnetic layers, may be dielectric layers, or may be a structure in which magnetic layers and dielectric layers are stacked alternately.

Figure 26:
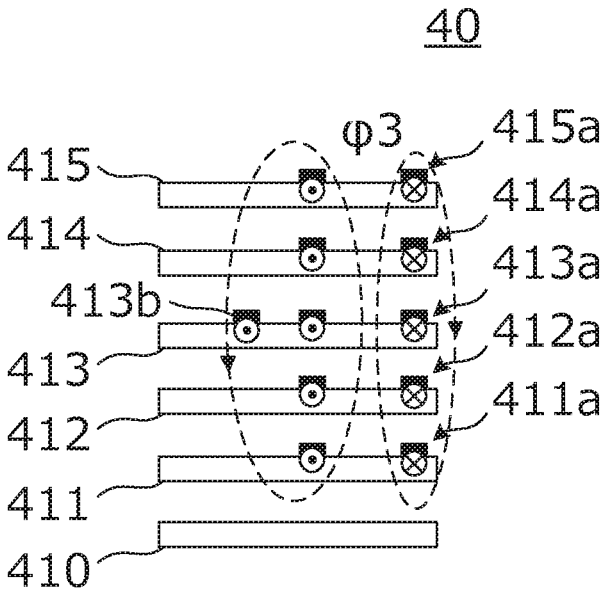
FIG. 26 is an exploded cross-sectional view of the coil element 40.

FIG. 26 is an exploded cross-sectional view of the coil element 40. The magnetic flux φ3 illustrated in FIG. 26 represents magnetic flux generated by a current flowing through a coil including the coil conductor patterns 411*a* to 415*a*. The coupling coil by the coil conductor patterns 411*a*, 412*a*, 413*a*, 414*a*, and 415*a*, and the auxiliary coil pattern 413*b* are magnetically coupled through this magnetic flux φ3.

As described in the present preferred embodiment, even when the coil winding axis direction of the coupling coil of the coil element is a direction perpendicular to the surface of the base material, a preferred embodiment of the present invention may be applied.

Twelfth Preferred Embodiment

In a twelfth preferred embodiment of the present invention, a description is particularly made of an antenna device in which a coupling coefficient k23 (see FIG. 8) of a loop-shaped conductor 10 and a communication partner antenna 500 is increased.

Figure 27:
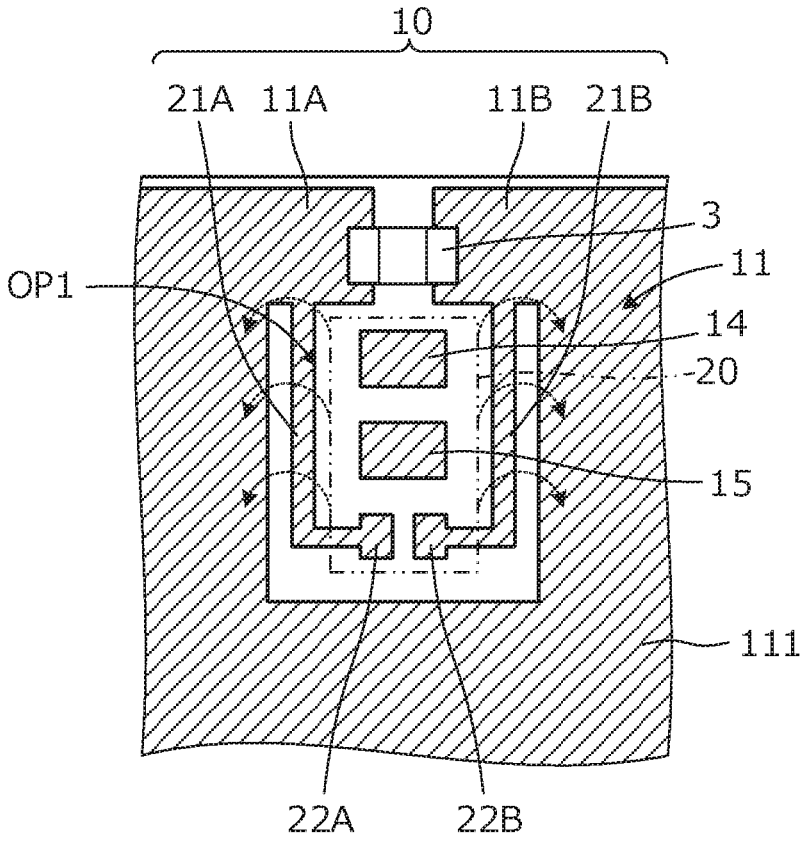
FIG. 27 is a plan view of a coil element arrangement portion in an antenna device according to a twelfth preferred embodiment of the present invention.

FIG. 27 is a plan view of a coil element arrangement portion in an antenna device according to the twelfth preferred embodiment of the present invention.

The antenna device of the present preferred embodiment, similar to the antenna device described in the second preferred embodiment, is provided with the extension portions 11A and 11B of the first conductor portion 11, the second conductor portions 21A and 21B, and the planar conductor 111 that is a portion of the first conductor portion. In addition, the antenna device is also provided with the coil element connection pads 14 and 15 and the auxiliary coil connection pads 22A and 22B. The arrangement of the terminals of the coil element 20 corresponds to the coil element connection pads 14 and 15 and the auxiliary coil connection pads 22A and 22B that are illustrated in FIG. 27. It is to be noted that the capacitor 3 is also illustrated in FIG. 27.

In the antenna device of the present preferred embodiment, a path length from a connection portion between the second conductor portions 21A and 21B and the extension portions 11A and 11B of the first conductor portion 11 to the auxiliary coil connection pads 22A and 22B is relatively long compared with a path length of the second preferred embodiment.

Figure 28:
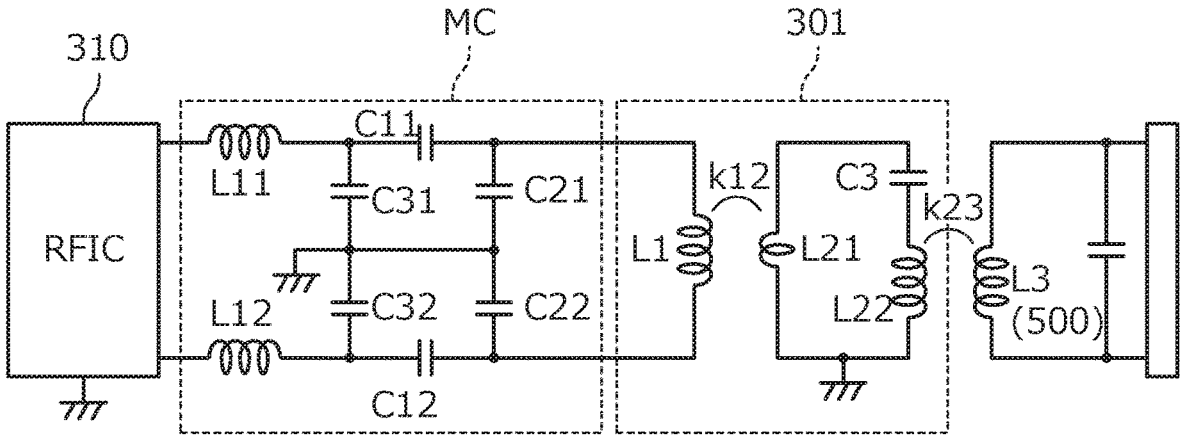
FIG. 28 is a circuit diagram of a circuit to be connected to an antenna device 301 according to the twelfth preferred embodiment of the present invention.

FIG. 28 is a circuit diagram of the antenna device 301 and a circuit to be connected to the antenna device according to the present preferred embodiment of the present invention. In the figure, the coupling coil in the coil element 20 of the antenna device 301 is indicated by an inductor L1. In addition, an inductor of the auxiliary conductor in the coil element 20 is indicated by L21, and the loop-shaped conductor 10 is indicated by an inductor L22. A capacitor C3 is equivalent to the capacitor 3 connected to the loop-shaped conductor 10. Moreover, the communication partner antenna 500 is indicated by an inductor L3.

In the example illustrated in FIG. 28, the inductors L11 and L12 and the capacitors C11, C12, C21, C22, C31, and C32 define a matching circuit MC.

The inductors L21 and L22 and the capacitor C3 define an LC resonant circuit. The resonant frequency of this LC resonant circuit is a frequency band used for communication.

The inductor L1 is able to be defined as a primary antenna, and the resonant circuit by the inductors L21 and L22 and the capacitor C3 is able to be defined as a secondary antenna. However, the inductor L22, in particular, contributes to the coupling to the communication partner antenna 500.

In the present preferred embodiment, since the path length from the connection portion of the second conductor portions 21A and 21B and the extension portions 11A and 11B of the first conductor portion to the auxiliary coil connection pads 22A and 22B is long, the first conductor opening OP1 is large, and the inductance of the inductor L22 is relatively large. Therefore, an antenna device with a large coupling coefficient k23 with the communication partner antenna 500 is obtained.

In FIG. 27, a circular arrow of a dashed line indicates magnetic flux that is generated by a current flowing through the second conductor portions 21A and 21B. In the present preferred embodiment, since, in this manner, the magnetic flux that is about to pass through the planar conductor 111 increases, a current flowing through the planar conductor 111 increases. Thus, it can be understood that the coupling coefficient k23 of the antenna device of the present preferred embodiment is high.

Figure 29A:
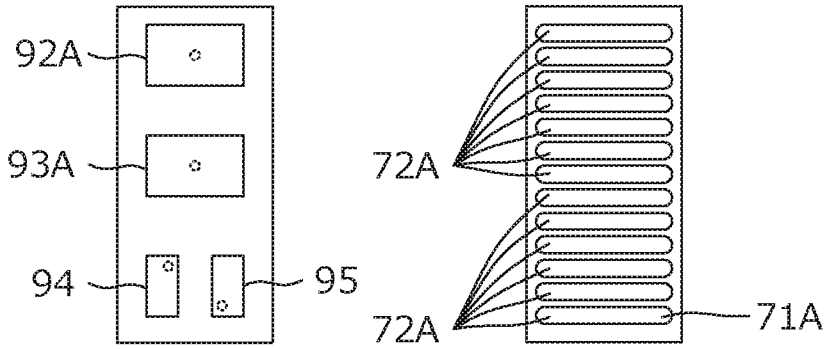
FIG. 29A shows a bottom view and plan view of a coil element according to the twelfth preferred embodiment of the present invention.
Figure 29B:
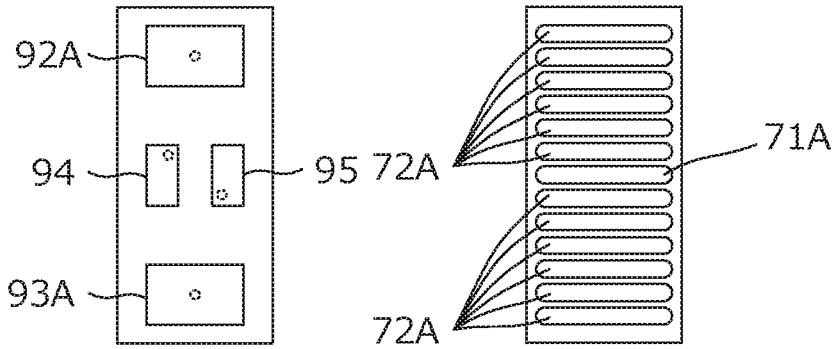
FIG. 29B shows a bottom view and plan view of the coil element according to the first preferred embodiment of the present invention as a comparative example.

FIG. 29A shows a bottom view and plan view of a coil element according to the present preferred embodiment of the present invention. FIG. 29B shows a bottom view and plan view of the coil element according to the first preferred embodiment of the present invention as a comparative example.

The terminals 94 and 95 of the coil element are connected to the auxiliary coil connection pads 22A and 22B on the wiring board. In any of the examples illustrated in FIG. 29A and FIG. 29B, the linear conductor 71A of an auxiliary coil is arranged near the terminals 94 and 95. In the present preferred embodiment, in order to lengthen the path length from the connection portion of the second conductor portions 21A and 21B and the extension portions 11A and 11B of the first conductor portion to the auxiliary coil connection pads 22A and 22B, the linear conductor 71A of the auxiliary coil is provided below the multilayer substrate.

It is to be noted that, if a wiring that connects the linear conductor 71A of the auxiliary coil and the terminals 94 and 95 is provided in the multilayer substrate, the linear conductor 71A of the auxiliary coil may not be necessarily arranged near the terminals 94 and 95. In addition, the coupling coefficient between the coupling coil and the auxiliary coil in the coil element may be determined by a position of the linear conductor 71A of the auxiliary coil with respect to the plurality of linear conductors 72A for the coupling coil.

Thirteenth Preferred Embodiment

Figure 30A:
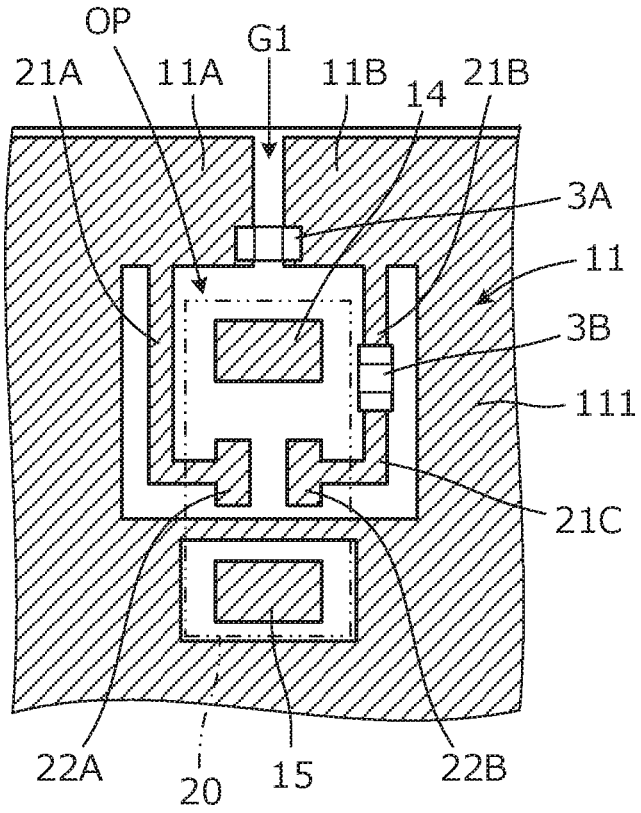
FIG. 30A is a plan view of an antenna device according to a thirteenth preferred embodiment of the present invention.

FIG. 30A is a plan view of an antenna device according to a thirteenth preferred embodiment of the present invention. This antenna device is provided with a conductive member including the extension portions 11A and 11B of the first conductor portion and the second conductor portions 21A, 21B, and 21C. In addition, the antenna device is provided with the coil element 20 that includes a coupling coil to be connected to a feed circuit. The thirteenth preferred embodiment is different from the second preferred embodiment in that the second conductor portions 21A, 21B, and 21C are configured and the capacitors 3A and 3B are provided. Other configurations are the same as the configurations described in the second preferred embodiment. FIG. 30A illustrates a state prior to placement of the coil element 20.

The extension portions 11A and 11B of the first conductor portion and the second conductor portions 21A, 21B, and 21C define a loop-shaped conductor.

The capacitor 3A is mounted so as to cross the gap G1 between the extension portions 11A and 11B of the first conductor portion. In addition, the capacitor 3B is mounted so as to cross a gap between the second conductor portions 21B and 21C. In other words, the capacitors 3A and 3B define a portion of the current path including the loop-shaped conductor.

Figure 30B:
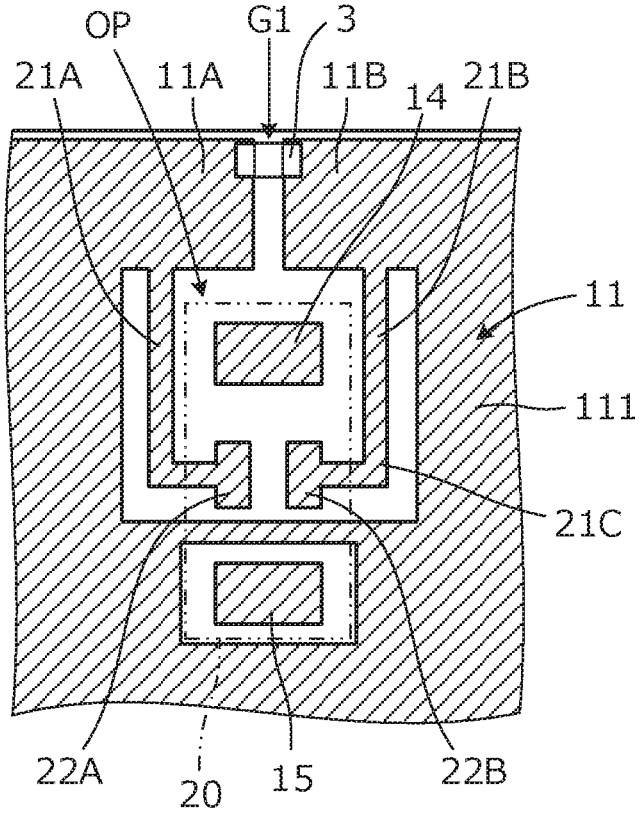
FIG. 30B is a plan view of another antenna device according to the thirteenth preferred embodiment of the present invention.

FIG. 30B is a plan view of another antenna device according to the thirteenth preferred embodiment of the present invention. This antenna device is provided with a conductive member including the extension portions 11A and 11B of the first conductor portion and the second conductor portions 21A and 21B. In addition, the antenna device is provided with the coil element 20 that includes a coupling coil to be connected to a feed circuit. FIG. 30B illustrates a state prior to placement of the coil element 20.

In FIG. 30B, the capacitor 3, compared with the second preferred embodiment, is arranged at a position near the outer edge of the first conductor portion 11, in the gap G1. Other configurations are the same as the configurations described in the second preferred embodiment.

Compared with the second preferred embodiment, in the antenna device illustrated in FIG. 30B, since the "loop-shaped current path" including the capacitor 3 is long and large, the radiation characteristics of the antenna device are high. In this manner, the capacitor, in respect of the radiation characteristics, may preferably be arranged at a position in which the "loop-shaped current path" becomes long.

Fourteenth Preferred Embodiment

In a fourteenth preferred embodiment, a description is made of an example of an antenna device including a conductor portion of a housing. The fourteenth preferred embodiment is different from the second preferred embodiment in that the antenna device includes the conductor portion of the housing. In addition, the winding directions of the coil element 20 with respect to the outer edge of the first conductor portion 11 are different, and, accordingly, the shapes of the conductive member provided on the surface of the wiring board 110 are different. Other configurations are the same as the configurations described in the second preferred embodiment.

Figure 31:
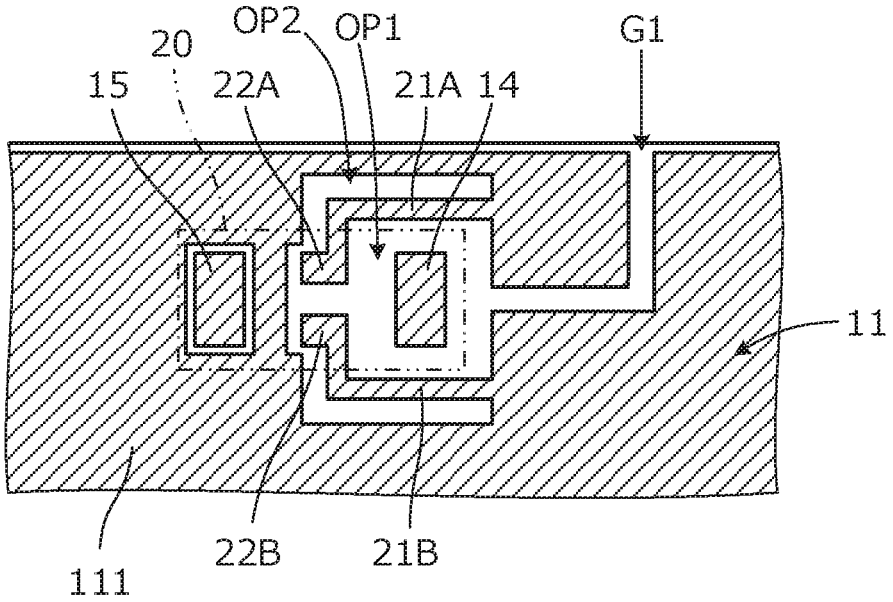
FIG. 31 is a plan view of a coil element arrangement portion of a wiring board in an antenna device according to a fourteenth preferred embodiment of the present invention.

FIG. 31 is a plan view of a coil element arrangement portion of the wiring board in the antenna device according to the fourteenth preferred embodiment of the present invention.

The antenna device of the present preferred embodiment is provided with the first conductor portion 11 and the second conductor portions 21A and 21B. In addition, the antenna device is also provided with the coil element connection pads 14 and 15 and the auxiliary coil connection pads 22A and 22B. In the present preferred embodiment, a gap G1 that is bent in the middle is provided in the first conductor portion 11.

Figure 32A:
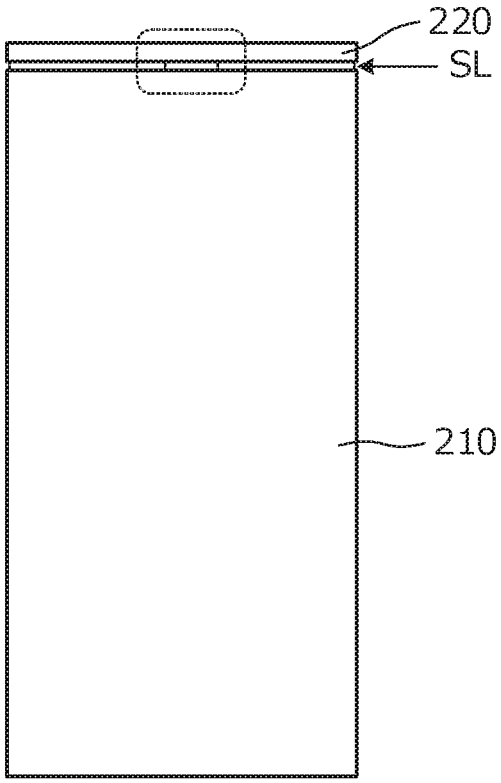
FIG. 32A is a plan view of an electronic apparatus such as a smartphone including the antenna device according to the fourteenth preferred embodiment of the present invention.
Figure 32B:
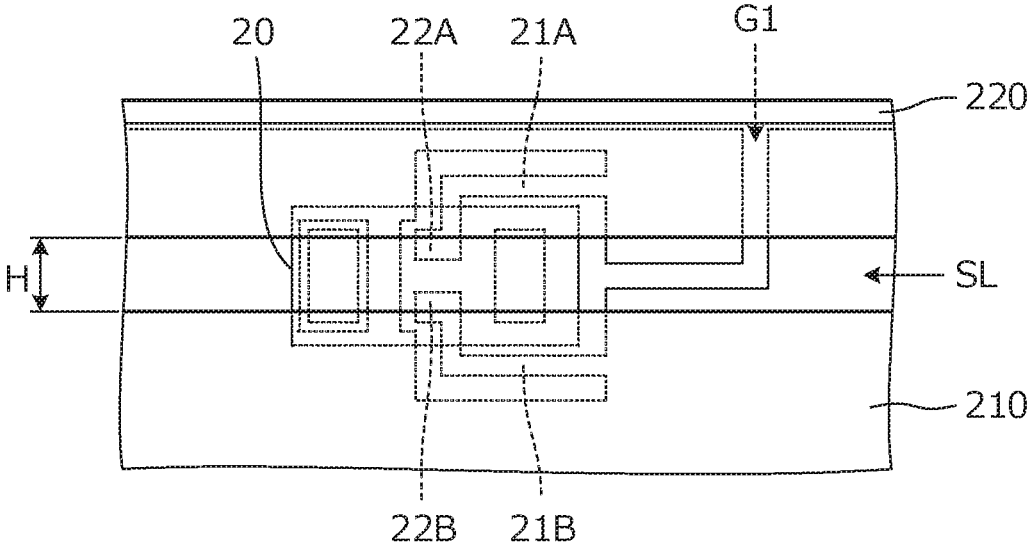
FIG. 32B is a partial plan view of an antenna device configuration portion of the electronic apparatus.

FIG. 32A is a plan view of an electronic apparatus such as a smartphone including the antenna device according to the present preferred embodiment, and FIG. 32B is a partial plan view of an antenna device configuration portion of the electronic apparatus.

The electronic apparatus has a housing and the housing is provided with a first housing conductor portion 210 and a second housing conductor portion 220. The first housing conductor portion 210 and the second housing conductor portion 220 are separated through a slit SL.

FIG. 32B is a partial plan view of a state in which the coil element 20 is mounted on the wiring board illustrated in FIG. 31 and the wiring board is stored in the housing, and an enlarged view of a portion surrounded by a dashed line in FIG. 32A. In the present preferred embodiment, the first housing conductor portion 210 and the second housing conductor portion 220 are arranged so that the coil element 20, in a plan view, may overlap the slit SL between the first housing conductor portion 210 and the second housing conductor portion 220.

Figure 33:
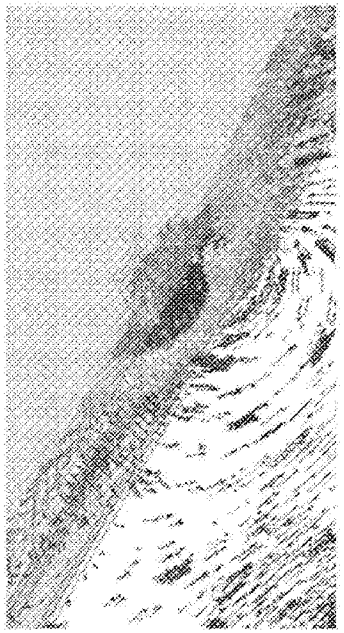
FIG. 33 is a view of a function (boost effect) as a portion of a radiation element of a first housing conductor portion 210 and a second housing conductor portion 220.

FIG. 33 is a view of a function (boost effect) as a portion of a radiation element of the first housing conductor portion 210 and the second housing conductor portion 220. The magnetic flux that leaks out of the slit SL is indicated by a collection of arrows. In this manner, the coil element 20 overlaps the slit SL between the first housing conductor portion 210 and the second housing conductor portion 220 in a plan view, so that the coil element 20, in particular, is coupled to the first housing conductor portion 210 and the second housing conductor portion 220 through the slit SL. Therefore, the booster effect is obtained not only by the loop-shaped conductor by the first conductor portion 11 and the second conductor portions 21A and 21B but also by the first housing conductor portion 210 and the second housing conductor portion 220.

Figure 34:
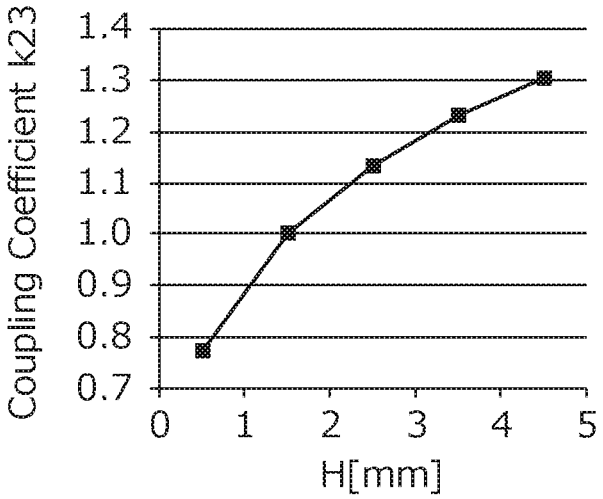
FIG. 34 is a view of a change in coupling coefficient k23 (see FIG. 8) of a loop-shaped conductor 10 and a communication partner antenna 500 with respect to a change in width H (see FIG. 32B) of a slit SL.

FIG. 34 is a view of a change in coupling coefficient k23 (see FIG. 8) of the loop-shaped conductor 10 and the communication partner antenna 500 with respect to a change in width H (see FIG. 32B) of the slit SL. In FIG. 34, a case of H=about 1.5 mm is set as a reference (k23=1.0), for example. As apparent from FIG. 34, as the width H of the slit SL is larger, the coupling coefficient k23 of the loop-shaped conductor 10 and the communication partner antenna 500 is larger.

Figure 35A:
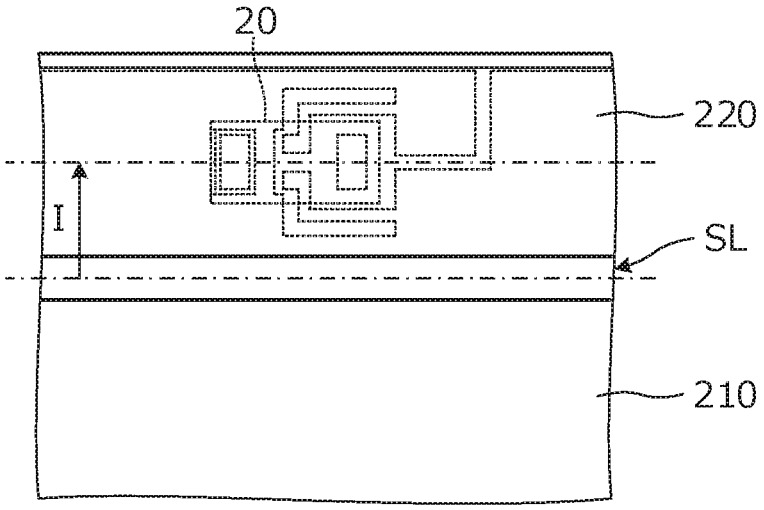
FIG. 35A, FIG. 35B, and FIG. 35C are views showing a change in position of a coil element with respect to the slit SL.
Figure 35B:
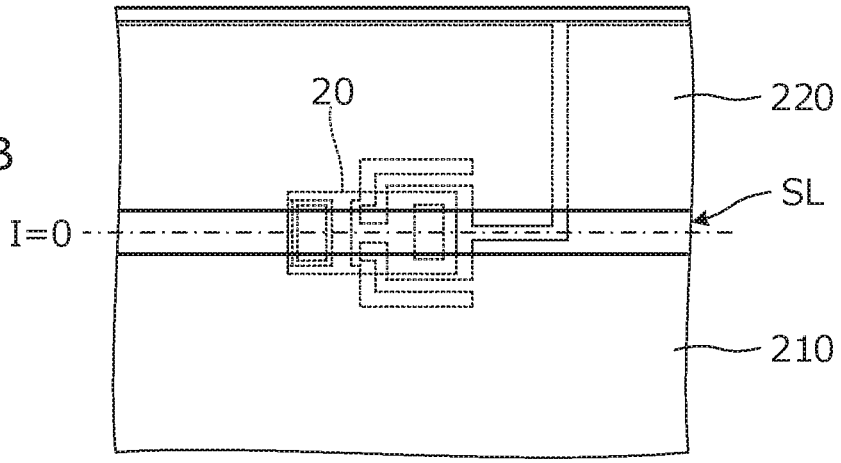
Figure 35C:
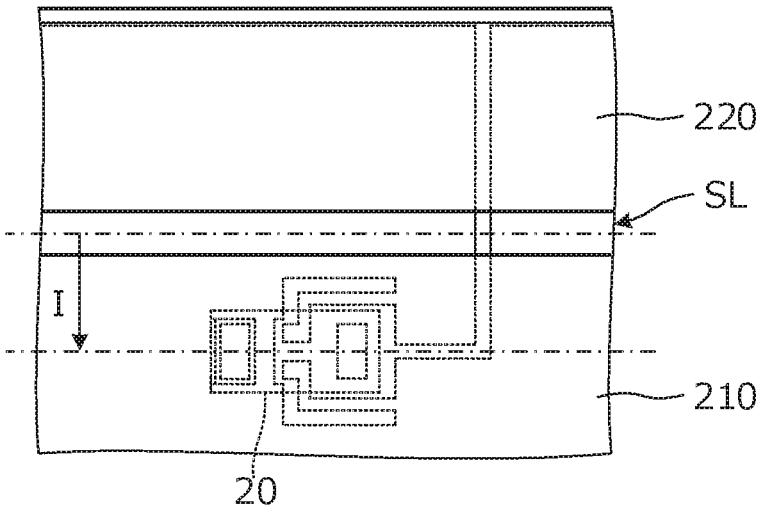
Figure 36:
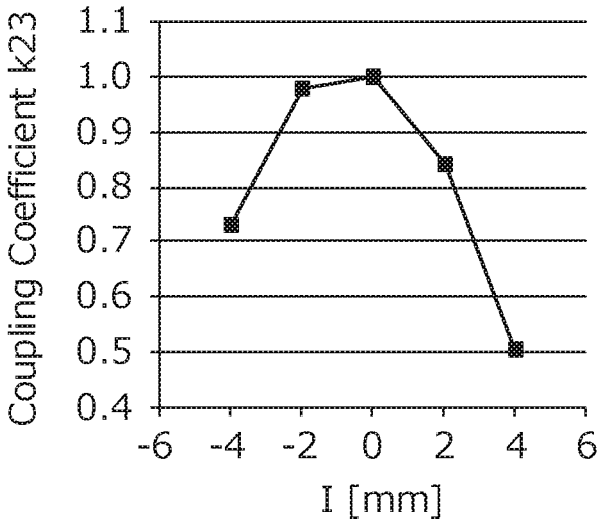
FIG. 36 is a view of a change in coupling coefficient k23 (see FIG. 8) of the loop-shaped conductor 10 and the communication partner antenna 500 with respect to a change in position of the coil element with respect to the slit SL.

FIG. 35A, FIG. 35B, and FIG. 35C are views showing a change in position of the coil element 20 with respect to the slit SL. In the present preferred embodiment, a dimension I indicates an amount of positional shift of the slit SL and the coil winding axis of the coil element 20. FIG. 36 is a view of a change in coupling coefficient k23 (see FIG. 8) of the loop-shaped conductor and the communication partner antenna 500 with respect to a change in position of the coil element 20 with respect to the slit SL.

As apparent from FIG. 35A, FIG. 35B, FIG. 35C, and FIG. 36, when the coil winding axis of the coil element 20 overlaps the center of the slit SL, the coupling coefficient k23 is the maximum and the coupling coefficient k23 is smaller as the coil winding axis is shifted more from the position.

Fifteenth Preferred Embodiment

In a fifteenth preferred embodiment of the present invention, a description is made of an example of an antenna device including a conductor portion of a housing, the example being different from the example described in the fourteenth preferred embodiment. The fifteenth preferred embodiment is different from the fourteenth preferred embodiment in that the first housing conductor portion 210 and the second housing conductor portion 220 are electrically connected to each other. Other configurations are the same as the configurations described in the fourteenth preferred embodiment.

Figure 37A:
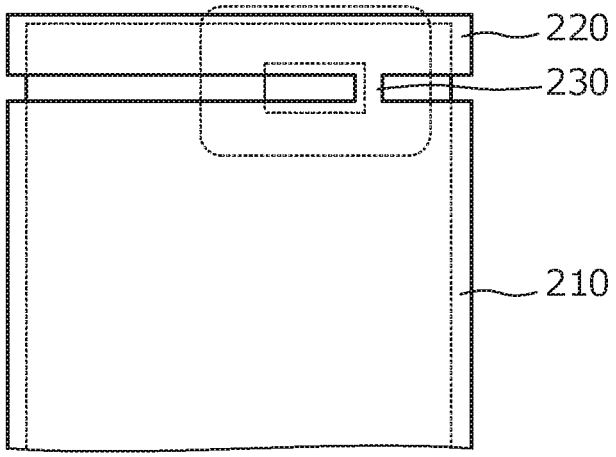
FIG. 37A is a plan view of a configuration of a conductor portion of a housing of an electronic apparatus including an antenna device according to a fifteenth preferred embodiment of the present invention.
Figure 37B:
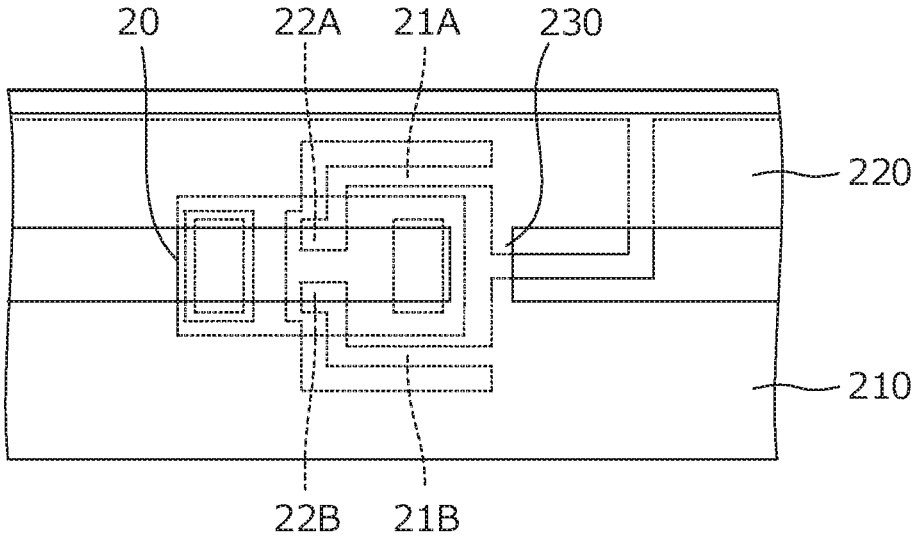
FIG. 37B is an enlarged plan view of a portion surrounded by a dashed line in FIG. 37A.

FIG. 37A is a plan view of a configuration of a conductor portion of a housing of an electronic apparatus including an antenna device according to the fifteenth preferred embodiment of the present invention. FIG. 37B is an enlarged plan view of a portion surrounded by a dashed line in FIG. 37A.

In this manner, the first housing conductor portion 210 and the second housing conductor portion 220 may be structurally and electrically connected to each other at a housing conductor connection portion 230.

Figure 38:
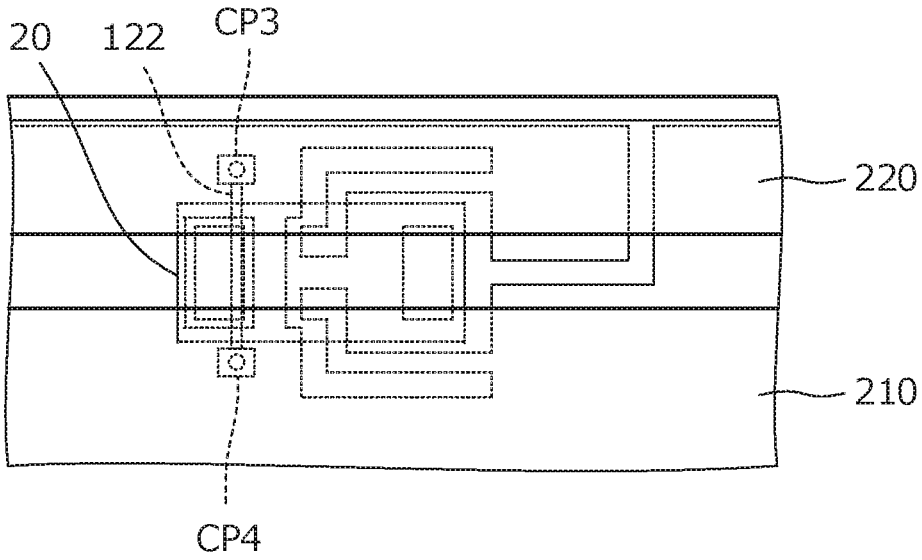
FIG. 38 is an enlarged partial plan view of another configuration of a conductor portion of a housing of an electronic apparatus including the antenna device according to the fifteenth preferred embodiment of the present invention.

FIG. 38 is an enlarged partial plan view of another configuration of a conductor portion of a housing of an electronic apparatus including the antenna device according to the present preferred embodiment of the present invention. In this example, the wiring board is provided with a conductor pattern 122, and connection portions CP3 and CP4 that are electrically connected to the both ends of this conductor pattern 122. The connection portions CP3 and CP4 are each provided with a movable probe pin. These movable probe pins are contacted with and electrically connected to the first housing conductor portion 210 and the second housing conductor portion 220. In this manner, the first housing conductor portion 210 and the second housing conductor portion 220 may be electrically connected through the conductor pattern of the wiring board.

Sixteenth Preferred Embodiment

In a sixteenth preferred embodiment of the present invention, a description is made of several relationships between the conductor portion of the housing and the arrangement position of the coil element. The sixteenth preferred embodiment is different from the first preferred embodiment or the second preferred embodiment in that the antenna device includes the conductor portion of the housing. Moreover, in the several examples of the figure, according to the positional relationship of the coil element 20 with respect to the outer edge of the first conductor portion 11, the shapes of the conductive member provided on the surface of the wiring board 110 are different. Other configurations are the same as the configurations described in the first preferred embodiment or the second preferred embodiment.

Figures 39A, 39B, 39C, 39D, 39E, 39F, 39G, 39H, 39I, 39J, 39K, 39L:
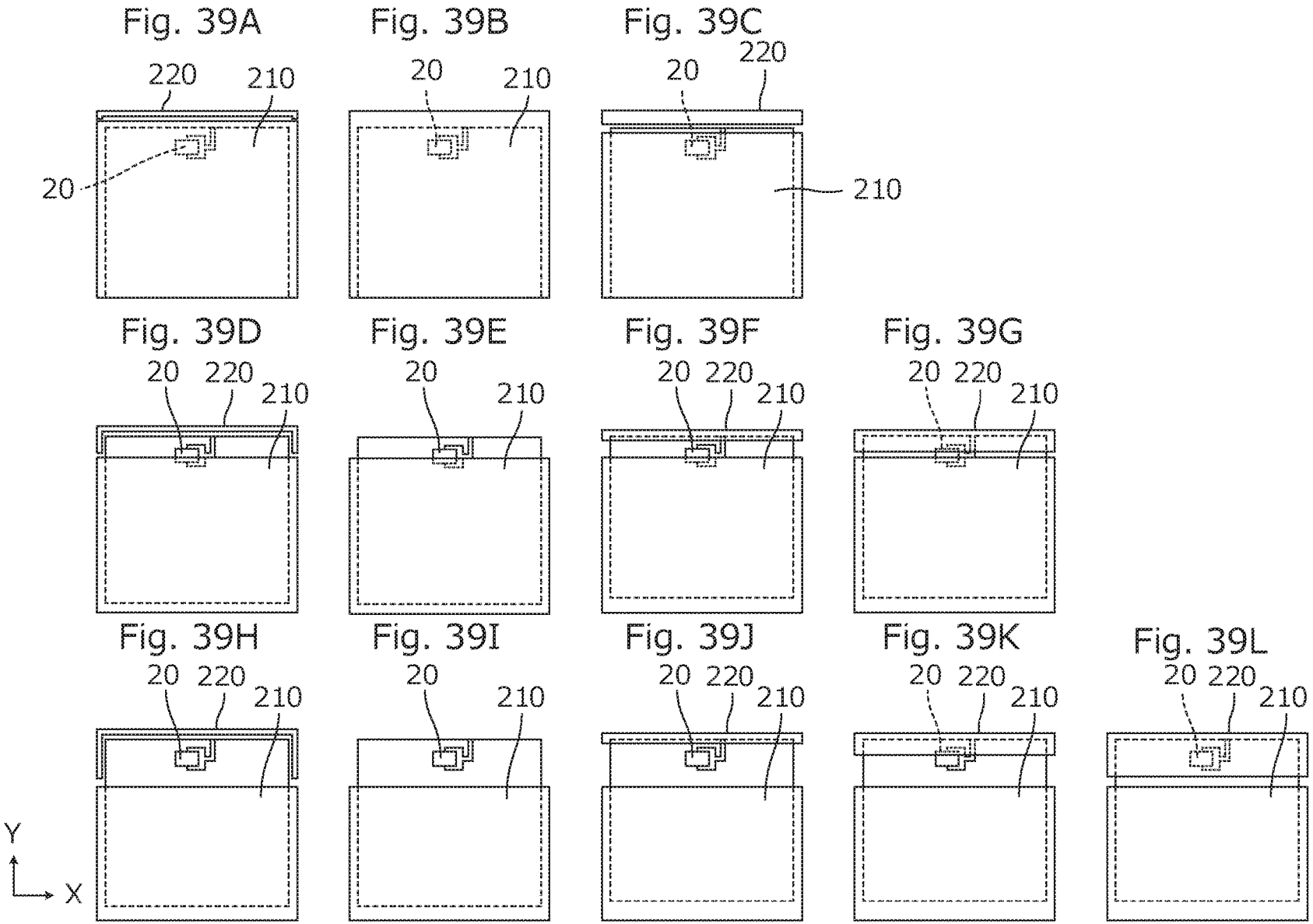
FIG. 39A to FIG. 39L are plan views of an electronic apparatus provided with an antenna device according to a sixteenth preferred embodiment of the present invention.

FIG. 39A to FIG. 39L are plan views of an electronic apparatus provided with the antenna device according to the sixteenth preferred embodiment of the present invention. The electronic apparatus is provided with the first housing conductor portion 210. Moreover, in the several examples of the figure, the electronic apparatus also has the second housing conductor portion 220. In the coil element 20, the coil winding axis extends toward a direction (X axis direction) along the outer edge of the first conductor portion. In the figure, the capacitor 3 and the second conductor portion 21 are not illustrated. In addition, the configurations of FIG. 39C, FIG. 39G, and FIG. 39L are respectively equivalent to the configurations of FIG. 35C, FIG. 35B, and FIG. 35A described in the fourteenth preferred embodiment.

In the examples illustrated in FIG. 39A, FIG. 39B, and FIG. 39C, in a plan view from outside, the whole of the coil element 20 is hidden by the first housing conductor portion 210. In the example illustrated in FIG. 39L, in a plan view from outside, the whole of the coil element 20 is hidden by the second housing conductor portion 220.

In the examples illustrated in FIG. 39D to FIG. 39K, in a plan view from outside, the whole or a portion of the coil element 20 is electromagnetically exposed from the first housing conductor portion 210 or the second housing conductor portion 220.

As illustrated in FIG. 39D to FIG. 39K, when at least a portion of the coil element 20 is electromagnetically exposed from the first housing conductor portion 210 or the second housing conductor portion 220, the magnetic flux that passes through portions other than the housing conductor portions 210 and 220 easily passes through the coupling coil of the coil element 20. In addition, the housing conductor portions 210 and 220 act as a radiation portion.

FIG. 40A to FIG. 40K are plan views of the electronic apparatus provided with another antenna device according to the sixteenth preferred embodiment of the present invention. The electronic apparatus is provided with the first housing conductor portion 210. Moreover, in the several examples of the figure, the electronic apparatus also has the second housing conductor portion 220. In the coil element 20, the coil winding axis is arranged toward a direction (Y axis direction) perpendicular to the outer edge of the first conductor portion. In the figure, the capacitor 3 and the second conductor portion 21 are not illustrated.

Figures 40A, 40B, 40C, 40D, 40E, 40F, 40G, 40H, 40I, 40J, 40K:
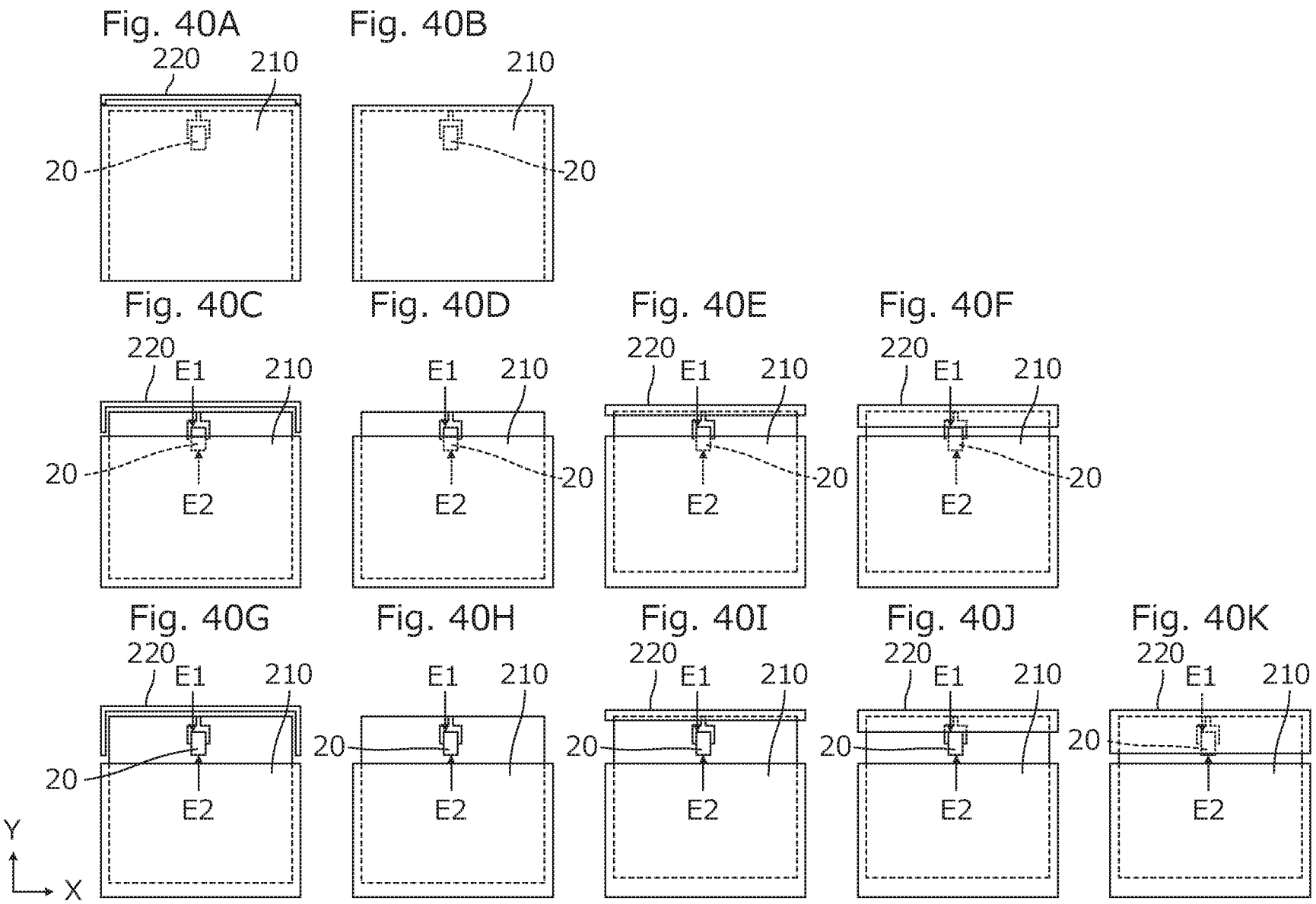
FIG. 40A to FIG. 40K are plan views of the electronic apparatus provided with another antenna device according to the sixteenth preferred embodiment of the present invention.

In the examples illustrated in FIG. 40A, and FIG. 40B, in a plan view from outside, the whole of the coil element 20 is hidden by the first housing conductor portion 210. In the examples illustrated in FIG. 40C to FIG. 40F, in a plan view, while the first end E1 (see FIG. 1B) of the coil element 20 is electromagnetically exposed, the second end E2 (see FIG. 1B) of the coil element 20 is hidden by the first housing conductor portion 210. In the examples illustrated in FIG. 40G to FIG. 40J, in a plan view, both the first end E1 and the second end E2 of the coil element 20 are exposed electromagnetically. In the example illustrated in FIG. 40K, while the first end E1 of the coil element 20 is hidden by the second housing conductor portion 220, the second end E2 is exposed electromagnetically.

In the examples illustrated in FIG. 40G to FIG. 40K, since the magnetic flux that enters and exits the second end E2 of the coil element 20 is not blocked by a housing conductor, the magnetic flux easily passes through the coupling coil of the coil element 20. In addition, the housing conductor portions 210 and 220 act as a radiation portion.

FIG. 41A to FIG. 41K are plan views of the electronic apparatus provided including another antenna device according to the sixteenth preferred embodiment of the present invention. The electronic apparatus is provided with the first housing conductor portion 210. Moreover, in the several examples of the figure, the electronic apparatus also has the second housing conductor portion 220. In the coil element 20, the coil winding axis is arranged toward a direction (Y axis direction) perpendicular to the outer edge of the first conductor portion. However, contrary to the examples illustrated in FIG. 40A to FIG. 40K, a gap G1 (see FIG. 19A) is provided so that the second end E2 of the coil element 20 may face the outer edge side of the first conductor portion. In the figure, the capacitor 3 and the second conductor portion 21 are not illustrated.

Figures 41A, 41B, 41C, 41D, 41E, 41F, 41G, 41H, 41I, 41J, 41K:
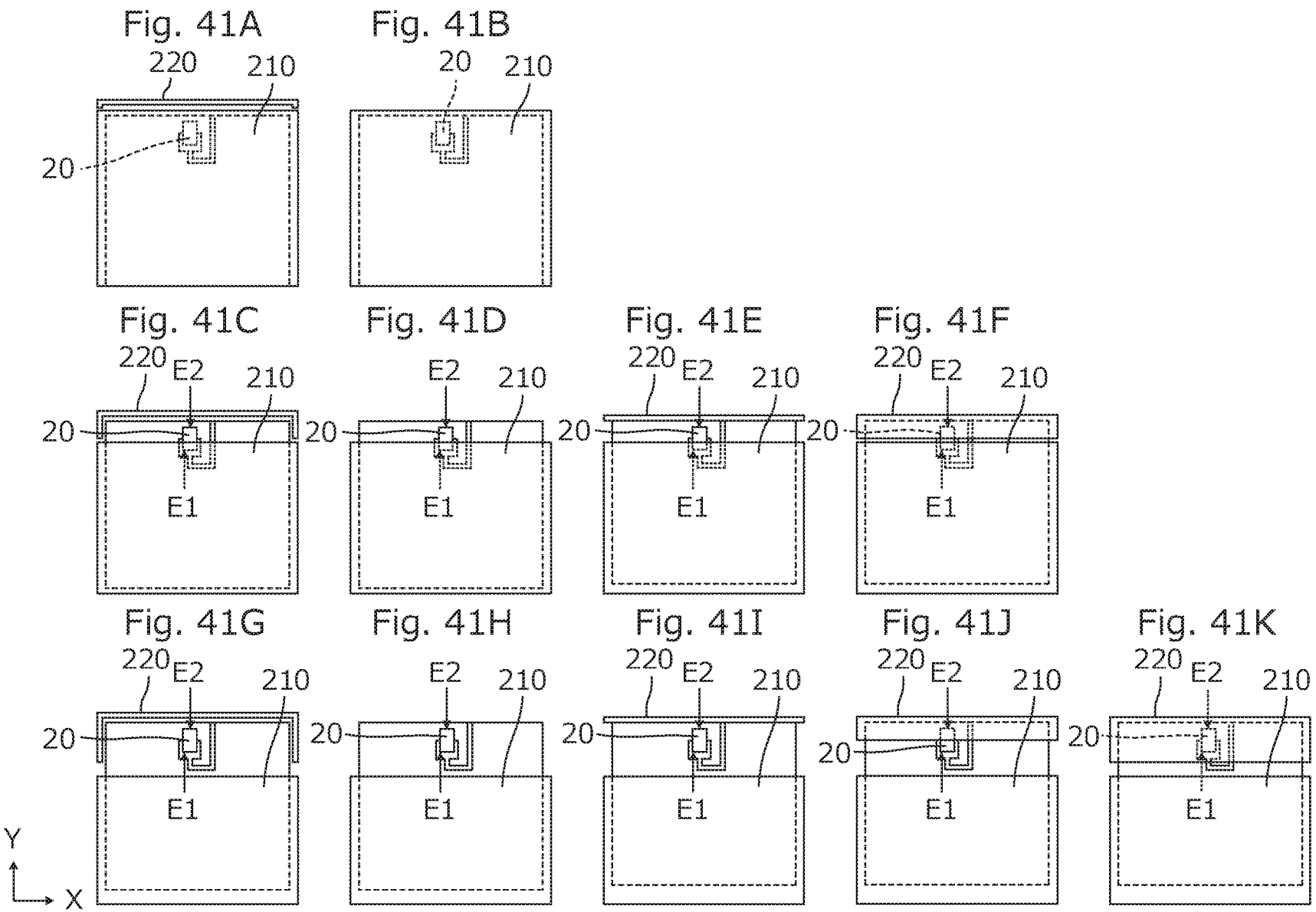
FIG. 41A to FIG. 41K are plan views of the electronic apparatus provided with further another antenna device according to the sixteenth preferred embodiment of the present invention.

In the examples illustrated in FIG. 41A, and FIG. 41B, in a plan view from outside, the whole of the coil element 20 is hidden by the first housing conductor portion 210. In the example illustrated in FIG. 41K, in a plan view from outside, the whole of the coil element 20 is hidden by the second housing conductor portion 220. In the example illustrated in FIG. 41F, in a plan view from outside, the first end E1 of the coil element 20 is hidden by the first housing conductor portion 210, and the second end E2 of the coil element 20 is hidden by the second housing conductor portion 220.

In the examples illustrated in FIG. 41C to FIG. 41E, in a plan view, while the first end E1 is hidden by the first housing conductor portion 210, the second end E2 of the coil element 20 is electromagnetically exposed.

Moreover, in the examples illustrated in FIG. 41G to FIG. 41I, in a plan view, both the first end E1 and the second end E2 of the coil element 20 are electromagnetically exposed. In the examples illustrated in FIG. 41J and FIG. 41K, in a plan view, while the first end E1 of the coil element 20 is electromagnetically exposed, the second end E2 is hidden by the second housing conductor portion 220.

In the examples illustrated in FIG. 41C to FIG. 41E, and FIG. 41G to FIG. 41I, since the magnetic flux that enters and exits the second end E2 of the coil element 20 is not blocked by a housing conductor, the magnetic flux easily passes through the coupling coil of the coil element 20. In addition, the housing conductor portions 210 and 220 define and function as a radiation portion. In particular, a distance between the first end E1 of the coil element 20 and the first housing conductor portion 210 may preferably be small, or the first end E1 of the coil element 20 may preferably be hidden by the first housing conductor portion 210. This is because, among the magnetic flux that passes the coil element 20, the ratio of the magnetic flux that passes the conductor opening OP (see FIG. 19A) located in the first conductor portion 11 is increased.

As illustrated in the present preferred embodiment, while various configurations are able to be adopted for the positional relationship of the first housing conductor portion 210 or the second housing conductor portion 220, and the coil element 20, in consideration of a distance relationship in particular, the coil element 20 and the edge end portion of the first housing conductor portion 210 or the second housing conductor portion 220 may preferably be adjacent to each other within at least two pieces of the coil element 20.

Seventeenth Preferred Embodiment

In a seventeenth preferred embodiment of the present invention, a description is made of an example of an antenna device that uses a conductor portion of a housing as a portion of a radiation element.

Figure 42A:
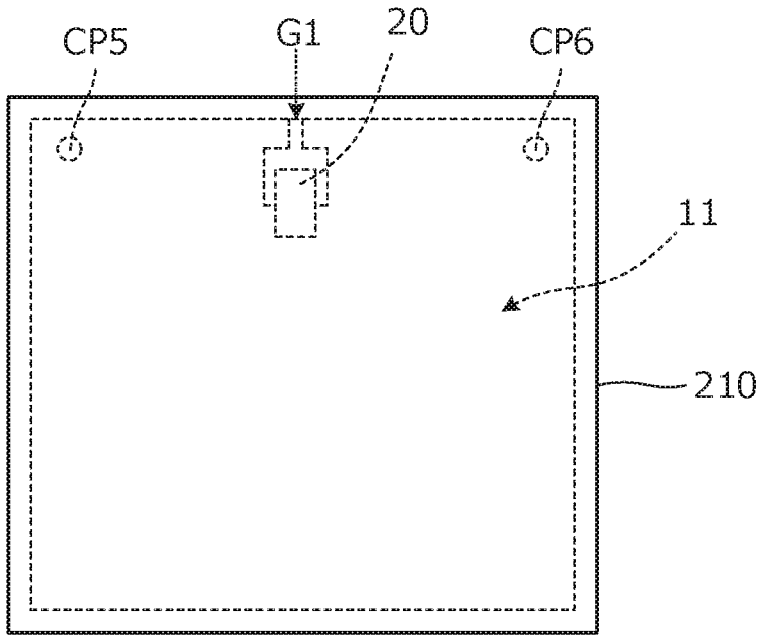
FIGS. 42A, 42B, and 42C each are plan views of an antenna device according to a seventeenth preferred embodiment of the present invention.
Figure 42B:
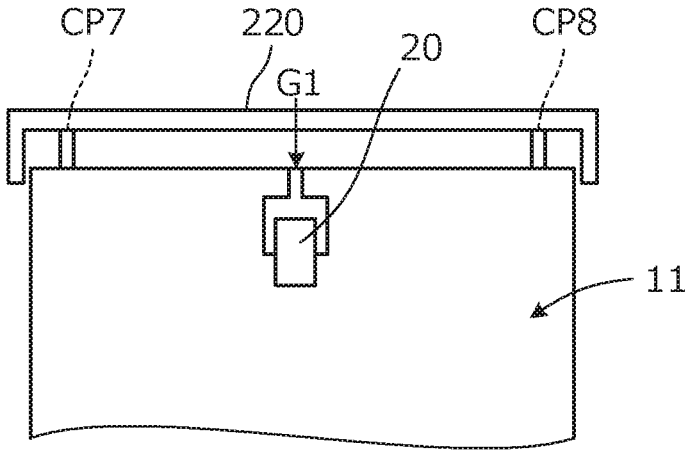
Figure 42C:
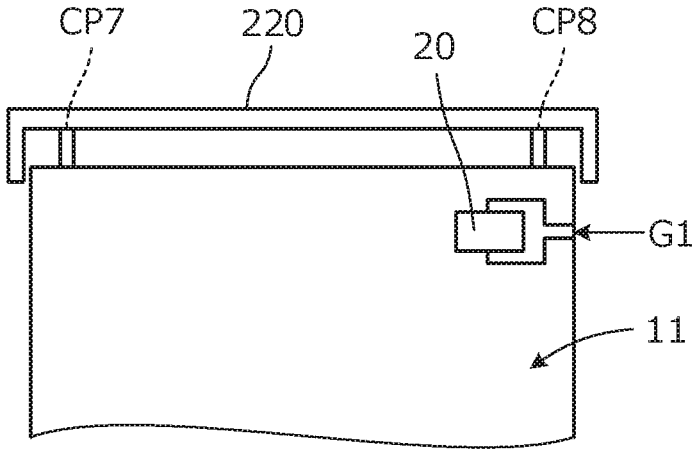

FIGS. 42A, 42B, and 42C each are plan views of an antenna device according to the seventeenth preferred embodiment of the present invention.

The antenna device illustrated in FIG. 42A is an example in which the first housing conductor portion 210 is connected to the first conductor portion 11 provided on the wiring board, through two connection portions CP5 and CP6. Each of the connection portions CP5 and CP6 may be a spring pin or the like, and, in a state in which the wiring board is incorporated in the housing, two points of the first conductor portion 11 are connected to the first housing conductor portion 210.

The antenna device illustrated in FIG. 42B and FIG. 42C is an example in which the second housing conductor portion 220 is connected to the first conductor portion 11 provided on the wiring board, through two connection portions CP7 and CP8.

In the example illustrated in FIG. 42A and FIG. 42B, two points on both sides that sandwich the gap G1 of the first conductor portion 11 are connected to the first housing conductor portion 210 or the second housing conductor portion 220, and, in the example illustrated in FIG. 42C, two points on one side of the gap G1 of the first conductor portion 11 are connected to the second housing conductor portion 220.

In this manner, the first conductor portion 11 is connected in parallel to the conductor portion of the housing at a plurality of portions, so that the path of an induced current is increased and radiation characteristics are improved.

Eighteenth Preferred Embodiment

In an eighteenth preferred embodiment of the present invention, a description is made of an antenna device that uses a conductor portion of a housing of an electronic apparatus as a planar conductor and an electronic apparatus provided with such an antenna device. The eighteenth preferred embodiment is different from the first preferred embodiment in that the first conductor portion is structured to use a portion of the conductor portion of the housing.

Figure 43A:
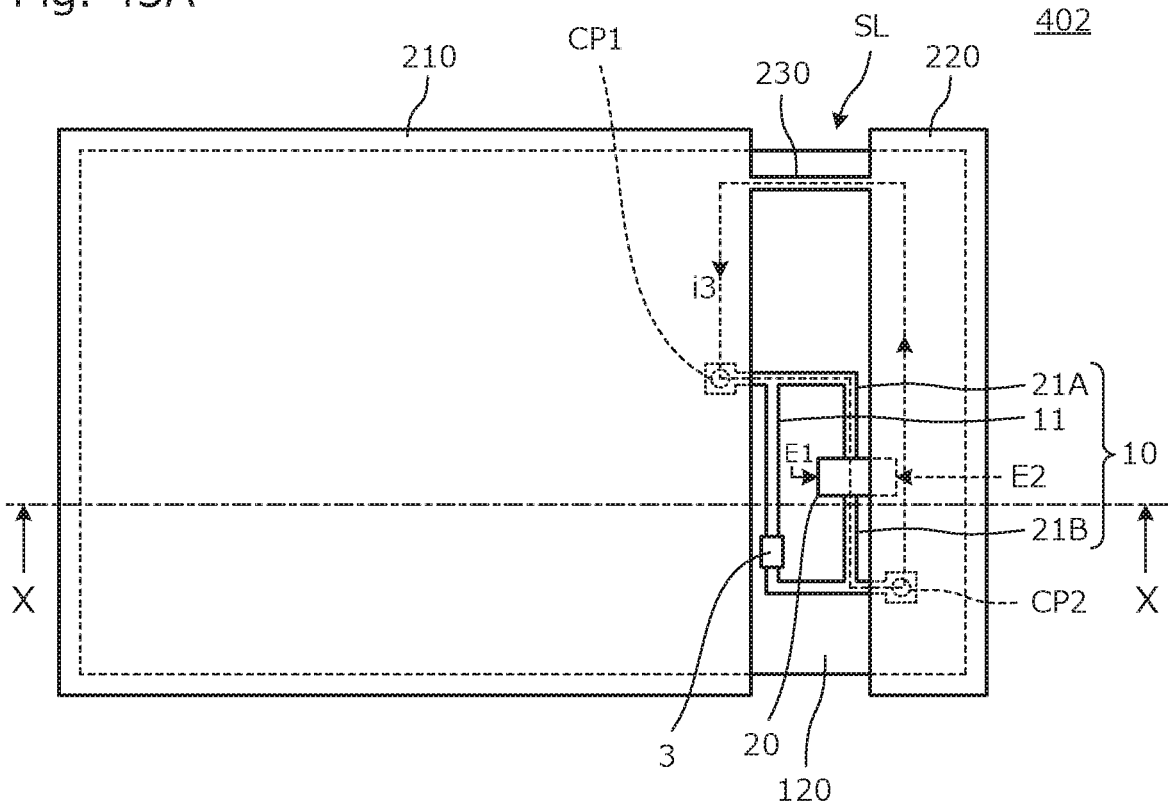
FIG. 43A is a plan view of a main portion of an electronic apparatus 402 according to an eighteenth preferred embodiment of the present invention.
Figure 43B:
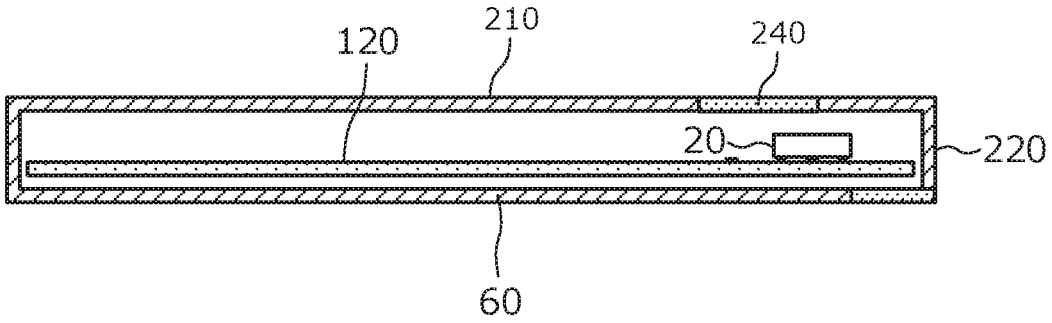
FIG. 43B is a sectional view of an X-X portion in FIG. 43A.

FIG. 43A is a plan view of a main portion of an electronic apparatus 402 according to the eighteenth preferred embodiment of the present invention, and FIG. 43B is a sectional view of an X-X portion in FIG. 43A. However, in FIG. 43A, a housing resin portion 240 to be described later is not illustrated.

The electronic apparatus 402 is a portable electronic device such as a smartphone, for example, and is provided with the first housing conductor portion 210 and the second housing conductor portion 220 on the side opposite to a surface on which a display and operation panel 60 is provided. The first housing conductor portion 210 and the second housing conductor portion 220 are connected by a housing conductor connection portion 230. The slit SL between the first housing conductor portion 210 and the second housing conductor portion 220 is provided (blocked) with the housing resin portion 240. In the present preferred embodiment, the first housing conductor portion 210, the second housing conductor portion 220, and the housing conductor connection portion 230 are equivalent to a "conductive member".

The wiring board 120 is provided inside of the first housing conductor portion 210 and the second housing conductor portion 220. The loop-shaped conductor 10 including the second conductor portions 21A and 21B and the first conductor portion 11 is provided on the wiring board 120. In addition, the coil element 20, and the capacitor 3 of a chip shape are mounted on the wiring board 120. Further, a chip capacitor and an RFIC 310 that define the matching circuit MC illustrated in FIG. 12 in the second preferred embodiment are mounted on the wiring board 120.

The coil element 20 is the same as the coil element 20 illustrated in the second preferred embodiment, and includes the coil conductor of the coupling coil that is wound in a helical shape around a winding axis, and the second end E2 of the coil element 20 and the first end E1 of the coil element 20 that face each other across this coil conductor. The coil element 20 is further provided with an auxiliary conductor, and the auxiliary conductor, together with the loop-shaped conductor 10 and the capacitor C3, defines a loop-shaped current path.

In a plan view of the first housing conductor portion 210 and the second housing conductor portion 220, the second end E2 of the coil element 20 is closer to the second housing conductor portion 220 than to the inside of the loop of the loop-shaped conductor 10, and the first end E1 of the coil element 20 is closer to the inside of the loop than to the second housing conductor portion 220. Such an arrangement of the coil element 20 causes the coupling coil in the coil element 20 to be magnetically coupled to the conductive member including the loop-shaped current path and the second housing conductor portion 220.

Connection portions CP1 and CP2 are each provided with a movable probe pin. These movable probe pins are respectively in contact with and electrically connected to the first housing conductor portion 210 and the second housing conductor portion 220. Therefore, the first housing conductor portion 210, the second housing conductor portion 220, the housing conductor connection portion 230, and the second conductor portions 21A and 21B define a current path. The current i3 in FIG. 43A conceptually indicates a current flowing through this current path. This current path is equivalent to a path of the current flowing through the planar conductor 111 illustrated in the second preferred embodiment. In other words, this causes the conductive member including the first housing conductor portion 210 and the second housing conductor portion 220 of the housing to be used (also served) as one of the radiation elements.

According to the present preferred embodiment, as in the first preferred embodiment, since the coupling coil in the coil element 20 is arranged so as to be magnetically coupled to the conductive member and the loop-shaped current path, a current flowing through the conductive member when the coupling coil of the coil element 20 is coupled to the conductive member and a current flowing through the loop-shaped current path when the coupling coil of the coil element 20 is coupled to the loop-shaped current path that the loop-shaped conductor 10 forms are superimposed, so that the function of the loop-shaped conductor 10 and the conductive member as a radiator is improved.

Nineteenth Preferred Embodiment

In a nineteenth preferred embodiment of the present invention, a description is made of an antenna device that uses a conductor portion of a housing of an electronic apparatus as a planar conductor and an electronic apparatus provided with such an antenna device. The nineteenth preferred embodiment is different from the eighteenth preferred embodiment in that the antenna device includes a ground conductor pattern. Other configurations are the same as the configurations described in the eighteenth preferred embodiment.

Figure 44:
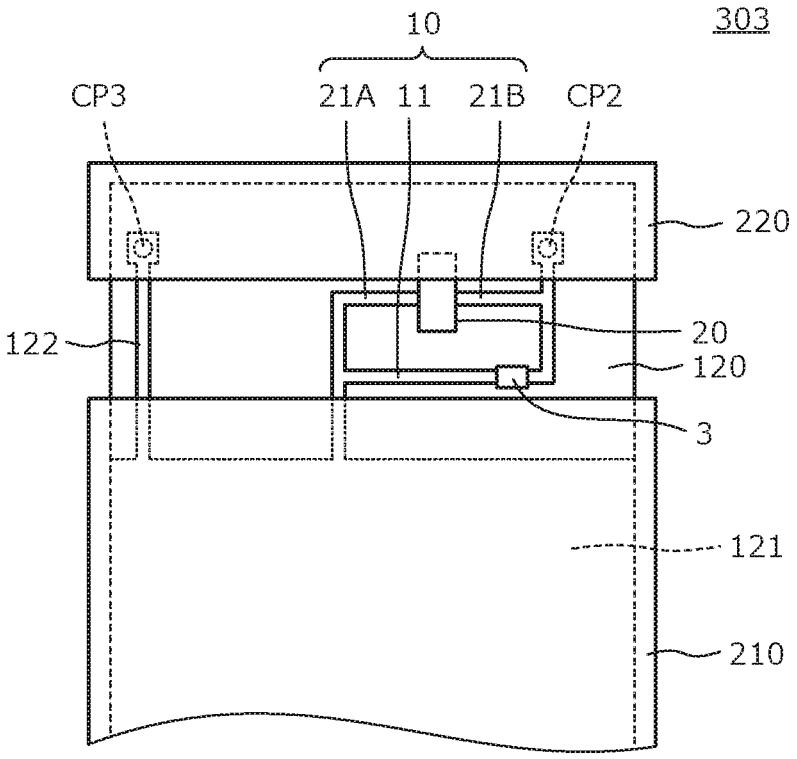
FIG. 44 is a plan view of a main portion of an electronic apparatus 303 according to a nineteenth preferred embodiment of the present invention.

FIG. 44 is a plan view of a main portion of an electronic apparatus 303 according to the nineteenth preferred embodiment of the present invention. However, a housing resin portion is not illustrated in FIG. 44.

Unlike the antenna device of the eighteenth preferred embodiment, the first conductor portion 11 and the second conductor portion 21A are connected to a ground conductor pattern 121 provided on the wiring board 120. In addition, a conductor pattern 122 is extended from the ground conductor pattern 121, and a connection portion CP3 is provided at the tip. This connection portion CP3 is provided with a movable probe pin, and this movable probe pin is in contact with and is electrically connected to the second housing conductor portion 220. Thus, in the present preferred embodiment, the ground conductor pattern 121, the conductor pattern 122, the second housing conductor portion 220, and the second conductor portions 21A and 21B define a current path. In the present preferred embodiment, the ground conductor pattern 121, the second housing conductor portion 220, and the conductor pattern 122 are equivalent to a "conductive member".

Other configurations are the same as the configurations of the antenna device described in the eighteenth preferred embodiment.

Twentieth Preferred Embodiment

In a twentieth preferred embodiment of the present invention, a description is made of an antenna device that uses a conductor portion of a housing of an electronic apparatus as a planar conductor and an electronic apparatus provided with such an antenna device. The twentieth preferred embodiment is different from the eighteenth preferred embodiment in that the first housing conductor portion 210 and the second housing conductor portion 220 are connected to each other through the conductor pattern 122 provided on the wiring board 120. Other configurations are the same as the configurations described in the eighteenth preferred embodiment.

Figure 45:
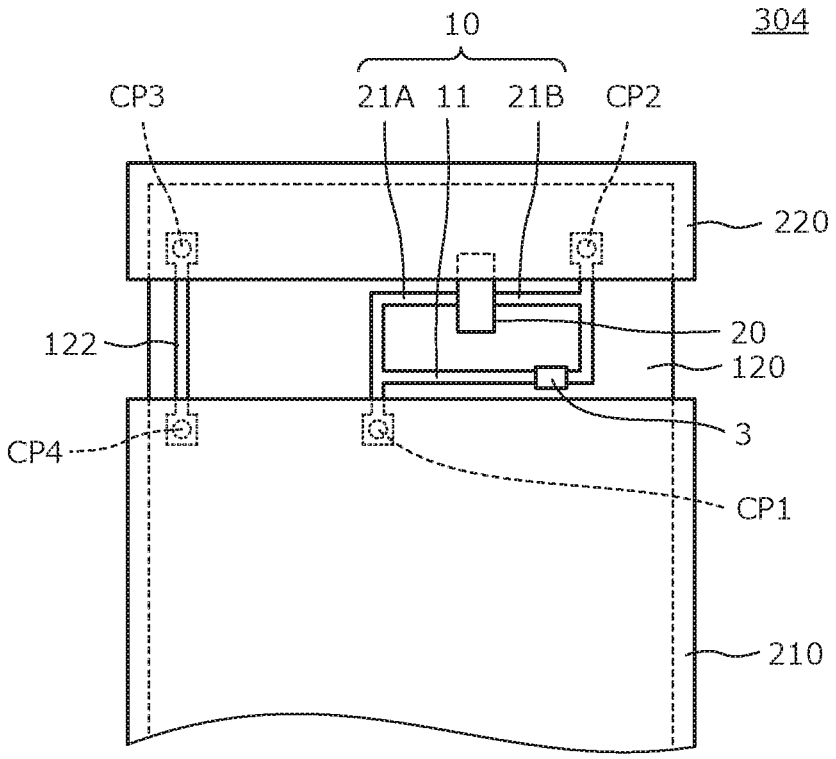
FIG. 45 is a plan view of a main portion of an electronic apparatus 304 according to a twentieth preferred embodiment of the present invention.

FIG. 45 is a plan view of a main portion of an electronic apparatus 304 according to the twentieth preferred embodiment of the present invention. However, a housing resin portion is not illustrated in FIG. 45.

Unlike the antenna device of the eighteenth preferred embodiment, the first housing conductor portion 210 and the second housing conductor portion 220 are connected to each other through the conductor pattern 122 provided on the wiring board 120. In other words, the connection portions CP3 and CP4 are provided at the both ends of the conductor pattern 122, these connection portions CP3 and CP4 are each provided with movable probe pins, and these movable probe pins are respectively in contact with and are electrically connected to the first housing conductor portion 210 and the second housing conductor portion 220 of the housing. Thus, in the present preferred embodiment, the first housing conductor portion 210, the conductor pattern 122, the second housing conductor portion 220, and the second conductor portions 21A and 21B define a current path. In the present preferred embodiment, the first housing conductor portion 210, the second housing conductor portion 220, and the conductor pattern 122 are equivalent to a "conductive member".

Other configurations are the same as the configurations of the antenna device described in the eighteenth preferred embodiment.

While the above several preferred embodiments have described examples in which the conductor portion of the electronic apparatus preferably is used as the "first conductor portion" or the "second conductor portion," a metal portion such as a chassis or a battery inside the electronic apparatus may be used as the "first conductor portion" or the "second conductor portion", for example.

While each preferred embodiment has described the example in which the components mounted on the wiring board or the like are chip components such as a chip capacitor, the present invention is not limited to this. For example, the components may be a lead terminal type component or an element provided on a flexible base material.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:
- a base material;
- a conductive member disposed on the base material;
- a coil element mounted to a surface of the base material and being a multilayer structure, the coil element including:
  - a coupling coil including a coil opening; and
  - input and output terminals to be connected to the coupling coil and a feed circuit; and
- a capacitor; wherein
- the conductive member includes:
  - a planar conductor pattern;
  - a conductor opening defined by an inner edge of the conductive member; and
  - a gap that connects the conductor opening and an outer edge of the conductive member;
- the capacitor crosses the gap;
- the conductive member together with the capacitor defines a loop-shaped current path;
- the coupling coil is magnetically coupled to the loop-shaped current path;
- the coupling coil includes a coil winding axis that is perpendicular or substantially perpendicular to the surface of the base material;
- in a plan view of the base material, all of the coil opening overlaps the conductor opening; and
- the conductive member includes a plurality of coil element connection pads disposed in the conductor opening in a plan view of the base material, and connected to the input and output terminals.

2. The antenna device according to claim 1, wherein at least a portion of the conductive member is a ground conductor pattern.

3. The antenna device according to claim 1, wherein the capacitor is adjacent to the outer edge of the conductive member.

4. The antenna device according to claim 1, wherein
- the loop-shaped current path defines a resonant circuit; and
- a resonant frequency of the resonant circuit is a communication frequency band.

5. The antenna device according to claim 1, wherein the coupling coil includes coil conductor patterns including portions overlapping each other in a direction in which layers of the multilayer structure are stacked.

6. An electronic apparatus comprising:
- an antenna device including:
  - a base material;
  - a conductive member disposed on the base material;
  - a coil element mounted to a surface of the base material and being a multilayer structure, the coil element including:
    - a coupling coil including a coil opening; and
    - input and output terminals to be connected to the coupling coil and a feed circuit; and
  - a capacitor; wherein the conductive member includes:

a planar conductor pattern;

a conductor opening defined by an inner edge of the conductive member; and a gap that connects the conductor opening and an outer edge of the conductive member;

the capacitor crosses the gap;

the conductive member together with the capacitor defines a loop-shaped current path;

the coupling coil is magnetically coupled to the loop-shaped current path;

the coupling coil includes a coil winding axis that is perpendicular or substantially perpendicular to the surface of the base material;

in a plan view of the base material, all of the coil opening overlaps the conductor opening; and the conductive member includes a plurality of coil element connection pads disposed in the conductor opening in a plan view of the base material, and connected to the input and output terminals.

* * * * *